US011669038B2

(12) United States Patent
Kawakami et al.

(10) Patent No.: US 11,669,038 B2
(45) Date of Patent: Jun. 6, 2023

(54) IMAGE FORMING APPARATUS HAVING DETACHABLE DEVELOPER CARTRIDGE

(71) Applicant: CANON KABUSHIKI KAISHA, Tokyo (JP)

(72) Inventors: Takuya Kawakami, Shizuoka (JP); Yosuke Kashiide, Tokyo (JP); Makoto Hayashida, Shizuoka (JP); Noriyuki Komatsu, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/548,799

(22) Filed: Dec. 13, 2021

(65) Prior Publication Data

US 2022/0206429 A1 Jun. 30, 2022

(30) Foreign Application Priority Data

Dec. 25, 2020 (JP) ..... JP2020-217022

(51) Int. Cl.
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1842* (2013.01); *G03G 2221/1869* (2013.01)

(58) Field of Classification Search
CPC ..... G03G 21/1647; G03G 21/1676; G03G 21/1842; G03G 21/1846; G03G 2221/1684; G03G 2221/1869
See application file for complete search history.

(56) References Cited

U.S. PATENT DOCUMENTS

| | | | |
|---|---|---|---|
| 7,773,911 | B2 | 8/2010 | Kawamura |
| 8,559,845 | B2 | 10/2013 | Okabe et al. |
| 9,134,691 | B2 | 9/2015 | Okabe et al. |
| 9,377,752 | B2 | 6/2016 | Komatsu et al. |
| 9,423,768 | B2 | 8/2016 | Okabe et al. |
| 9,841,723 | B2 | 12/2017 | Okabe et al. |
| 10,216,139 | B2 | 2/2019 | Okabe et al. |
| 2018/0101124 | A1* | 4/2018 | Kanno |
| 2018/0101125 | A1 | 4/2018 | Okabe et al. |
| 2021/0149333 | A1* | 5/2021 | Sato |

FOREIGN PATENT DOCUMENTS

| | | | |
|---|---|---|---|
| JP | 2007-213024 | A | 8/2007 |
| JP | 2010-078873 | A | 4/2010 |
| JP | 2011-059510 | A | 3/2011 |

* cited by examiner

*Primary Examiner* — Sophia S Chen
(74) *Attorney, Agent, or Firm* — Venable LLP

(57) ABSTRACT

A cartridge includes a projection portion provided in a first region of an upper surface of a frame in a vertical direction. The projection portion projects more upward than second regions between which the first region is interposed. An inside of the projection portion is a space that is part of a developer accommodating portion. The projection portion is configured to pass through a space under an abutting portion while being elastically deformed by the abutted portion being pressed by the abutting portion after the cartridge is transitioned from the first posture to the second posture in accordance with movement of the cartridge in the attaching direction.

11 Claims, 37 Drawing Sheets

IMAGE FORMING APPARATUS HAVING DETACHABLE DEVELOPER CARTRIDGE

BACKGROUND OF THE INVENTION

Field of the Invention

The present invention relates to an image forming apparatus that forms an image on a recording medium.

Description of the Related Art

In an image forming apparatus of an electrophotographic system, a configuration in which one or members for executing an image forming process is disposed in a replaceable cartridge that is attachable to and detachable from an image forming apparatus body. Hereinafter, the image forming apparatus body will be referred to as an apparatus body. In addition, a configuration in which a cartridge is attached to a movable member that is movable with respect to the apparatus body, and then the movable member is inserted in the apparatus body to complete attachment of the cartridge to the apparatus body is known.

Japanese Patent Laid-Open No. 2011-59510 discloses an image forming apparatus including a process frame that is slidable between an attached position and a drawn-out position with respect to the apparatus body, and a developing cartridge attachable to and detachable from the process frame. This developing cartridge is, in the state of being attached to the process frame, movable between a detaching position where the developing cartridge can be detached from the process frame, and an image forming position where a developing roller in the developing cartridge is pressed against a photosensitive drum in the process frame. That is, the posture of the developing cartridge can be changed in the state of being attached to the process frame. In addition, the apparatus body is provided with an abutting member that abuts the developing cartridge in accordance with the movement of the process frame from the drawn-out position to the attached position and thus moves the developing cartridge positioned at the detaching position to the image forming position. Further, this document discloses that a handle for gripping the developing cartridge also serves as an abutted portion abutted by the abutting member.

A casing of the developing cartridge disclosed in the document described above is provided with a recess shape for securing a space for an operator to put fingers in under the handle. However, since such a recess shape recessed toward the inside of the developing cartridge is provided, the capacity of the space that can accommodate developer in the casing is reduced.

SUMMARY OF THE INVENTION

The present invention provides an image forming apparatus in which a capacity of a cartridge can be increased while enabling posture change of the cartridge in accordance with movement of a movable member.

According to one aspect of the invention, an image forming apparatus includes an apparatus body including an abutting portion, a cartridge including a frame having a developer accommodating portion configured to accommodate developer, a developing roller configured to bear the developer in the developer accommodating portion, and an abutted portion configured to be abutted by the abutting portion, and a movable member including an attachment portion to and from which the cartridge is attachable and detachable, the movable member being movable between a first position and a second position in a direction perpendicular to a rotation axis direction of the developing roller, the first position being a position where the movable member is drawn out from the apparatus body such that the cartridge is attachable to and detachable from the attachment portion, the second position being a position where the cartridge attached to the attachment portion is accommodated in the apparatus body, wherein the abutted portion is configured to, in a case where the movable member is moved in an attaching direction from the first position toward the second position in a state in which the cartridge having a first posture is attached to the attachment portion, be abutted by the abutting portion of the apparatus body such that the cartridge is transitioned from the first posture to a second posture different from the first posture and the movable member reaches the second position in a state in which the cartridge having the second posture is attached to the attachment portion, wherein the cartridge includes a projection portion provided in a first region of an upper surface of the frame in a vertical direction, the first region including a center position of the cartridge in the rotation axis direction of the developing roller, the projection portion projecting more upward than second regions of the upper surface between which the first region is interposed in the rotation axis direction, wherein at least a part of the first region is positioned downstream in the attaching direction from a center position of the upper surface in the attaching direction, wherein an inside of the projection portion is a space that is part of the developer accommodating portion, wherein the abutted portion is part of the projection portion, and wherein the projection portion is configured to, after the posture of the cartridge is transitioned from the first posture to the second posture in accordance with movement of the cartridge in the attaching direction, pass through a space under the abutting portion while being elastically deformed by the abutted portion being pressed by the abutting portion of the apparatus body.

According to another aspect of the invention, an image forming apparatus includes an apparatus body including an abutting portion, a cartridge including a frame having a developer accommodating portion configured to accommodate developer, a developing roller configured to bear the developer in the developer accommodating portion, and an abutted portion configured to be abutted by the abutting portion, and a movable member including an attachment portion to and from which the cartridge is attachable and detachable, the movable member being movable between a first position and a second position in a direction perpendicular to a rotation axis direction of the developing roller, the first position being a position where the movable member is drawn out from the apparatus body such that the cartridge is attachable to and detachable from the attachment portion, the second position being a position where the cartridge attached to the attachment portion is accommodated in the apparatus body, wherein the abutted portion is configured to, in a case where the movable member is moved in an attaching direction from the first position toward the second position in a state in which the cartridge having a first posture is attached to the attachment portion, be abutted by the abutting portion of the apparatus body such that the cartridge is transitioned from the first posture to a second posture different from the first posture and the movable member reaches the second position in a state in which the cartridge having the second posture is attached to the attachment portion, wherein the cartridge includes a projection portion provided in a first region of an upper surface of the frame in a vertical direction, the first region including a center position of the cartridge in the rotation axis direction of the developing roller, the projection portion projecting more upward than second regions of the upper surface between which the first region is interposed in the rotation axis direction, wherein at least part of the first region is positioned downstream in the attaching direction of a center position of the upper surface in the attaching direction, wherein an inside of the projection portion is a space that is part of the developer accommodating portion, wherein the abutted portion is a rib provided on the frame differently from the projection portion, the rib projecting more upward than an upper surface of the projection portion, and wherein the rib is configured to pass through a space under the abutting portion while being pressed and elastically deformed by the abutting portion after the posture of the cartridge is transitioned from the first posture to the second posture in accordance with movement of the cartridge in the attaching direction.

According to still another aspect of the invention, an image forming apparatus includes an apparatus body including an abutting portion, a cartridge including a frame having a developer accommodating portion configured to accommodate developer, a developing roller configured to bear the developer in the developer accommodating portion, and an abutted portion configured to be abutted by the abutting portion; and a movable member including an attachment portion to and from which the cartridge is attachable and detachable, the movable member being movable between a first position and a second position in a direction perpendicular to a rotation axis direction of the developing roller, the first position being a position where the movable member is drawn out from the apparatus body such that the cartridge is attachable to and detachable from the attachment portion, the second position being a position where the cartridge attached to the attachment portion is accommodated in the apparatus body, wherein the abutted portion is configured to, in a case where the movable member is moved in an attaching direction from the first position toward the second position in a state in which the cartridge having a first posture is attached to the attachment portion, be abutted by the abutting portion of the apparatus body such that the cartridge is transitioned from the first posture to a second posture different from the first posture and the movable member reaches the second position in a state in which the cartridge having the second posture is attached to the attachment portion, wherein the cartridge includes a handle configured to be gripped when handling the cartridge, wherein the handle includes a first end portion connected to an upper surface of the frame in a vertical direction at a position on a first side with respect to a center position of the cartridge in the rotation axis direction of the developing roller, a second end portion connected to the upper surface of the frame in the vertical direction at a position on a second side with respect to the center position of the cartridge in the rotation axis direction, and a rib extending in the rotation axis direction at a position above the upper surface and interconnecting the first end portion and the second end portion, wherein a first region of the upper surface of the frame overlapping with the rib as viewed in the vertical direction is at least not recessed downward as compared with second regions of the upper surface between which the first region is interposed in the rotation axis direction, wherein the abutted portion is provided on the rib, and wherein the rib is configured to pass through a space under the abutting portion while being pressed and elastically deformed by the abutting portion after the cartridge is transitioned from the first posture to the second posture in accordance with movement of the cartridge in the attaching direction.

Further features of the present invention will become apparent from the following description of exemplary embodiments with reference to the attached drawings.

DESCRIPTION OF THE EMBODIMENTS

Embodiments of the present disclosure will be described in detail with reference to drawings. To be noted, the functions, materials, shapes, relative positions, and the like of constituent parts described in the embodiments below should not limit the scope of the invention more than the description of the scope of claims unless otherwise described. In addition, in the description below, the functions, materials, shapes, and the like of members that are already described once and mentioned again are the same as described the first time unless otherwise described.

In addition, in the description below, a direction in which the rotation axis of a developing roller 6 extends will be referred to as an "X direction", a "rotation axis direction", or a "longitudinal direction". In addition, a direction that intersects with the X direction and serves as the vertical direction (i.e., gravity direction) when an image forming apparatus 1 is placed on a horizontal surface will be referred to as the "Z direction". In addition, a direction intersecting with the X direction and the Z direction will be referred to as a "Y direction". The X direction and the Z direction intersect with each other preferably at a right angle. The Z direction and the Y direction intersect with each other preferably at a right angle. The Y direction and the X direction intersect with each other preferably at a right angle. In addition, in the description below, the side on which a front door 17 is provided with respect to the image forming apparatus 1 will be referred to as a front side, or a first side in the Y direction, and a side opposite to the front side will be referred to as a rear side, or a second side in the Y direction. In addition, as viewed from the front side, the left side of the image forming apparatus 1, or a first side in the X direction, will be referred to as a drive side, and the right side, or a second side in the X direction, will be referred to as a nondrive side.

First Embodiment

A cartridge and an image forming apparatus according to a first embodiment of the present disclosure will be described with reference to FIGS. 1 to 9C.

Configuration of Image Forming Apparatus

Figure 2:
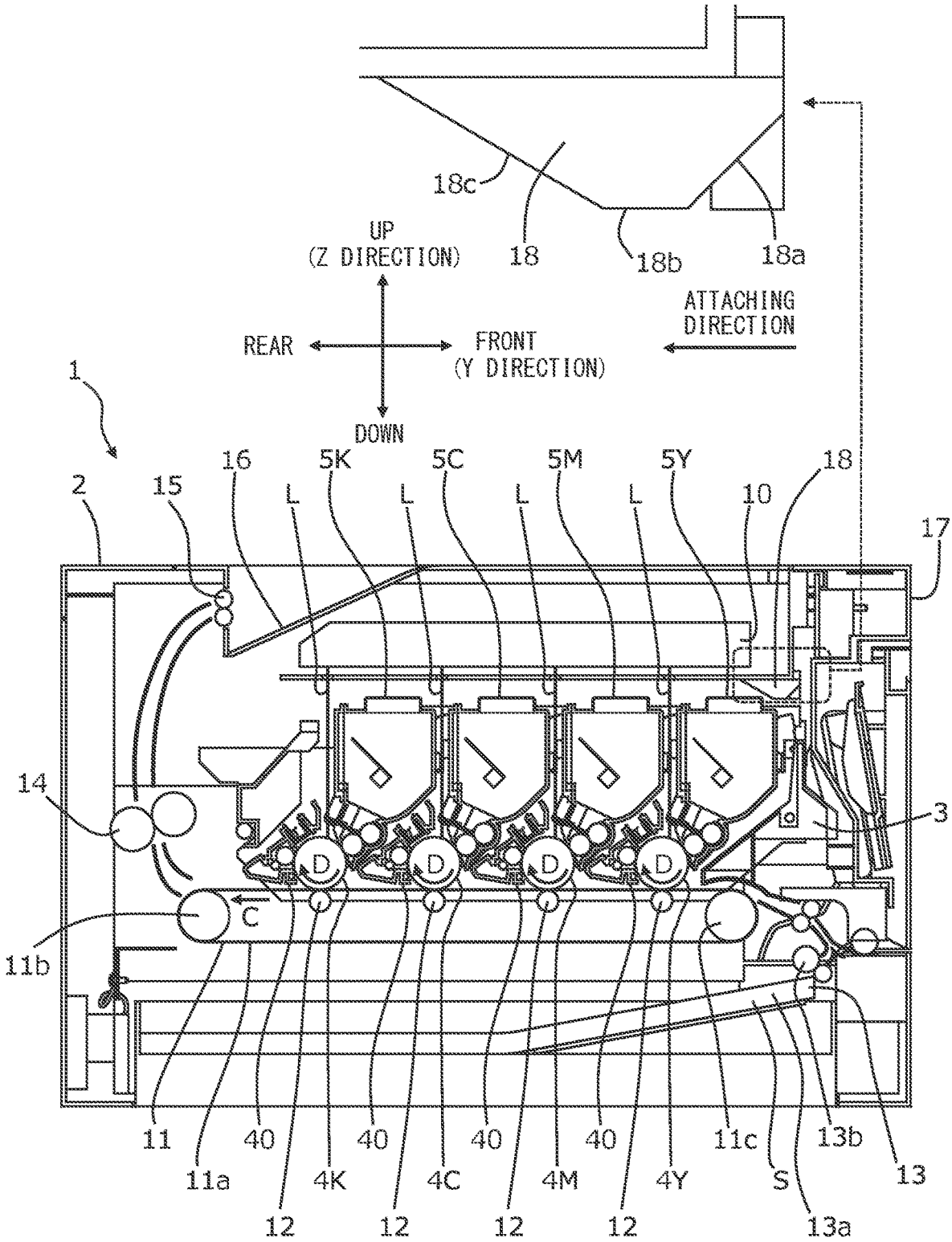
FIG. 2 is a section view of an image forming apparatus according to the first embodiment.
Figure 3A:
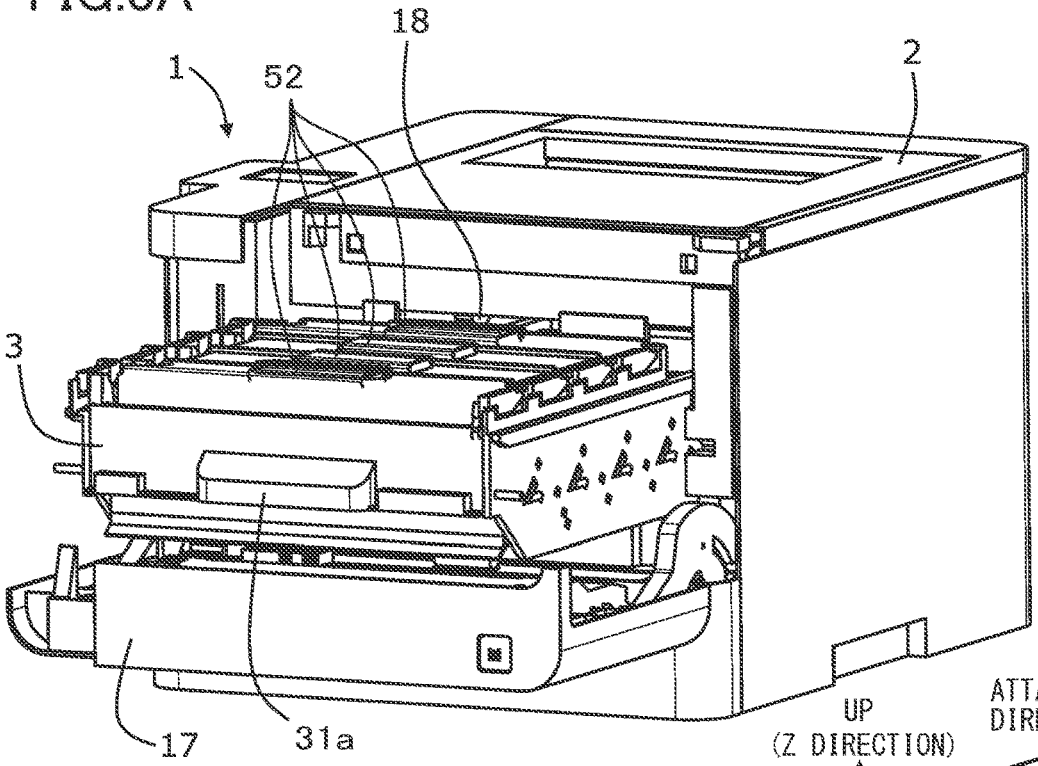
FIG. 3A is a perspective view of the image forming apparatus according to the first embodiment.
Figure 3A:
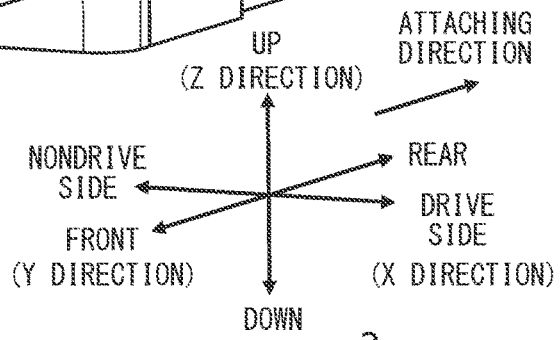
Figure 3B:
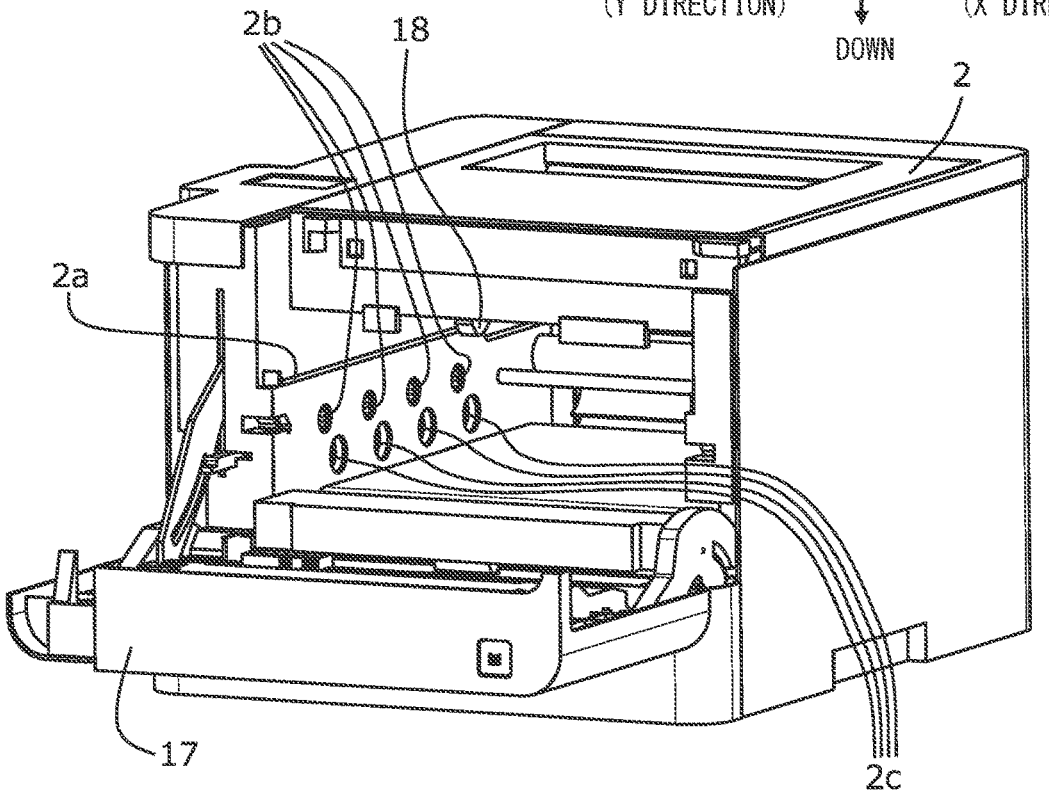
FIG. 3B is a perspective view of the image forming apparatus according to the first embodiment in a state in which the cartridge tray has been removed.
Figure 4:
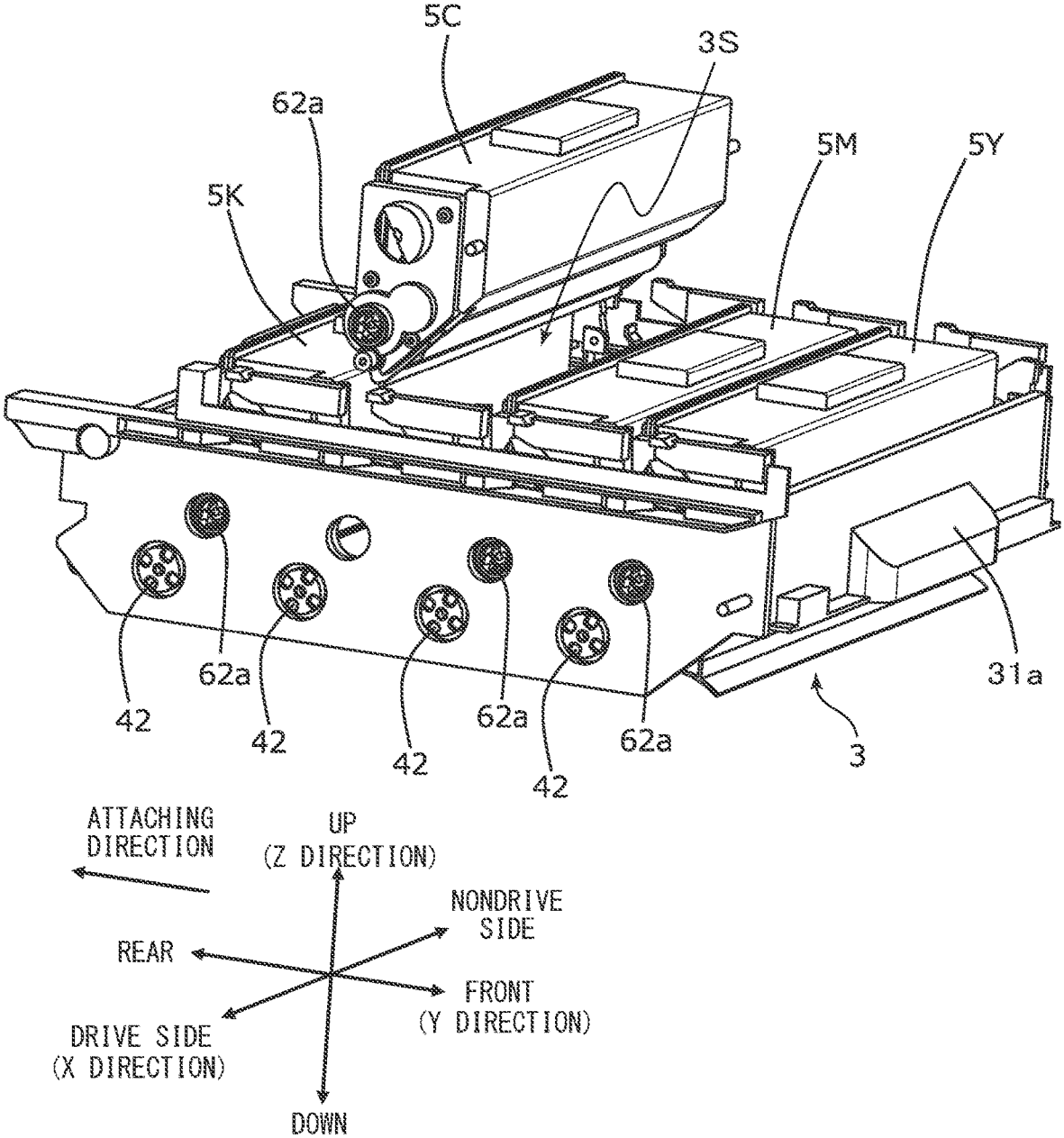
FIG. 4 is a perspective view of the cartridge tray and developing cartridges according to the first embodiment.
Figure 5:
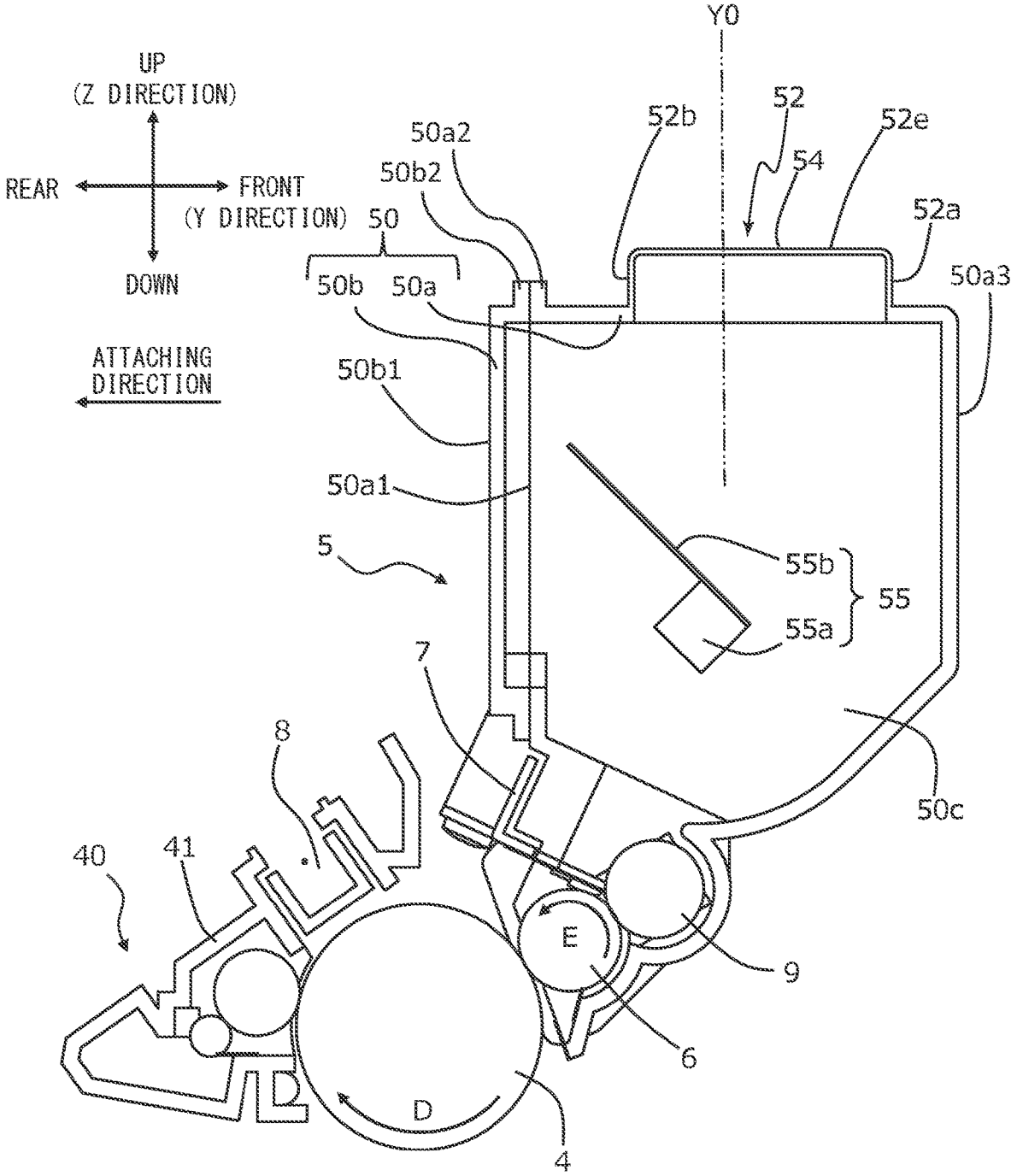
FIG. 5 is a section view of a developing cartridge and a drum unit according to the first embodiment.

First, a configuration of the image forming apparatus 1 will be described. FIG. 2 is a section view of the image forming apparatus 1 according to the present embodiment. FIG. 3A is a perspective view of the image forming apparatus 1 according to the present embodiment, and illustrates a state in which the front door 17 is open and a cartridge tray 3 that serves as a movable member is drawn out. FIG. 3B is a diagram in which illustration of the cartridge tray 3 and developing cartridges 5Y, 5M, 5C, and 5K is omitted from FIG. 3A. FIG. 4 is a perspective view of the cartridge tray 3 and the developing cartridges 5Y to 5K according to the present embodiment. FIG. 5 is a section view of the developing cartridge 5Y and a drum unit 40 according to the present embodiment. To be noted, the section views of FIGS. 2 and 5 each illustrate a cross-section taken along a virtual plane perpendicular to the rotation axis direction of a developing roller 6, that is, the X direction, as viewed in the X direction.

The image forming apparatus 1 illustrated in FIG. 2 is a color laser printer employing an electrophotographic image forming process. The image forming apparatus 1 forms a color image on a recording medium S by using developer containing toner supplied from the developing cartridges 5Y, 5M, 5C, and 5K serving as cartridges according to the present embodiment. Examples of the recording medium S include paper sheets for printing. The image forming apparatus 1 according to the present embodiment includes, as an image forming portion, an image forming engine that forms a color image by using four photosensitive drums 4Y, 4M, 4C, and 4K arranged in the Y direction, and the four developing cartridges 5Y, 5M, 5C, and 5K. The photosensitive drums 4Y, 4M, 4C, and 4K are each an electrophotographic photosensitive member serving as an image bearing member according to the present embodiment, and are each a member in which a photosensitive layer formed from an inorganic photoconductor or the like is provided on an outer circumferential portion of a drum-shaped or cylindrical base body.

The four developing cartridges 5Y, 5M, 5C, and 5K accommodate developer of different colors from each other, for example, respectively accommodate developer of yellow, cyan, magenta, and black. To be noted, as the developer, any of one-component developer consisting of magnetic toner, one-component developer consisting of nonmagnetic toner, and two-component developer including nonmagnetic toner and magnetic carrier may be used. The number of the developing cartridges, the photosensitive drums, or the like may be any number selected in accordance with the number of colors to be used, and may be 1 to 3 or 5 or more. To be noted, in the present embodiment, the photosensitive drums 4Y to 4K have substantially the same configuration and perform substantially the same operation except that the colors of the images to be formed thereby are different from each other, and the same applies to the developing cartridges 5Y to 5K. A developing cartridge 5 and a photosensitive drum 4 which are used in the description below and in which Y, M, C, and K are omitted can be used as each of the developing cartridges 5Y to 5K and each of the photosensitive drums 4Y to 4K in the image forming apparatus 1 of FIG. 2.

The image forming apparatus 1 includes an image forming apparatus body, which will be hereinafter referred to as an apparatus body 2, a cartridge tray 3 including the photosensitive drums 4 and movable with respect to the apparatus body 2, and the developing cartridges 5Y to 5K attachable to and detachable from the cartridge tray 3. The apparatus body 2 includes an exposing unit 10, an electrostatic transfer unit 11, a feeding unit 13, a fixing unit 14, a discharge unit 15, and a front door 17.

The exposing unit 10 is provided above the developing cartridges 5Y to 5K and the cartridge tray 3, and outputs laser light L toward the photosensitive drums 4Y to 4K in accordance with image information representing an image to be printed on the recording medium S. The exposing unit 10 functions as an exposing portion that exposes the surface of the photosensitive drums 4Y to 4K in a scanning manner with the laser light L.

The developing cartridges 5 that are developing units serving as developing portions for forming developer images on the exposed surface of the photosensitive drums 4Y to 4K by development are provided in correspondence with the photosensitive drums 4Y to 4K. A developing process in which the developer images are formed on the surface of the photosensitive drums 4 will be described later.

The electrostatic transfer unit 11 is provided below the developing cartridges 5Y to 5K and the cartridge tray 3. The electrostatic transfer unit 11 includes a transfer belt 11*a* that circulates, that is, rotates and conveys while opposing and in contact with all the photosensitive drums 4Y to 4K. As the transfer belt 11*a*, a resin film, a multi-layer film member in which a resin layer is provided on a rubber base layer, or the like is used. This transfer belt 11*a* is stretched over a driving roller 11*b* and a driven roller 11*c*. The transfer belt 11*a* is configured to electrostatically attract the recording medium S on the outer circumferential surface thereof on the upper side in FIG. 2, and circulate while conveying the recording medium S while bringing the recording medium S into contact with the photosensitive drums 4Y to 4K sequentially.

Transfer rollers 12 abutting the inner circumferential surface of the transfer belt 11*a* are arranged at positions opposing the photosensitive drums 4Y to 4K. A predetermined voltage serving as a bias voltage or a transfer voltage is applied to the transfer rollers 12 so as to transfer developer images from the photosensitive drums 4Y to 4K onto the recording medium S.

The feeding unit 13 is provided below the electrostatic transfer unit 11. The feeding unit 13 includes a feeding tray 13*a* accommodating a stack of the recording media S, and a feeding roller 13*b* serving as a feeding portion that feeds the recording media S one by one from the feeding tray 13*a*.

The fixing unit 14 and the discharge unit 15 are provided in an upper portion of the apparatus body 2. The fixing unit 14 is a fixing portion that heats and pressurizes a developer image transferred onto the recording medium S to fix the developer image to the recording medium S. The discharge unit 15 is a discharge portion that discharges the recording medium S having passed through the fixing unit 14 onto a discharge tray 16.

The cartridge tray 3 includes four drum units 40 in which the photosensitive drums 4Y to 4K respectively corresponding to the four developing cartridges 5Y to 5K are respectively provided. Further, as illustrated in FIG. 5, the drum units 40 each include a drum frame member 41, and a charging unit 8 serving as a charging portion. As illustrated in FIG. 3, the cartridge tray 3 is configured such that the cartridge tray 3 can be drawn out to the front side in the Y direction along tray draw-out rails 2*a* serving as guide portions provided in the apparatus body 2 after opening the front door 17 of the image forming apparatus 1.

As illustrated in FIG. 5, the developing cartridge 5 used as each of the developing cartridges 5Y to 5K includes a developing frame member 50 serving as a frame, and a developing roller 6 rotatable about a rotation shaft supported by the developing frame member 50 and extending in the X direction. The developing frame member 50 includes a developer accommodating portion 50*c* formed therein and configured to accommodate developer. The developing roller 6 is a developer bearing member that bears developer on the surface thereof. In addition, the developing cartridge 5 includes a supply roller 9 that supplies the developer to the developing roller 6, and a regulation blade 7 serving as a regulation member that comes into contact with the surface of the developing roller 6 to regulate the layer thickness of the developer borne on the surface of the developing roller 6.

As illustrated in FIG. 4, the developing cartridges 5Y to 5K are attachable to and detachable from the cartridge tray 3 serving as a movable member of a cartridge supporting member of the present embodiment along the Z direction. For example, FIG. 4 illustrates a state in which the developing cartridge 5C is detached from the cartridge tray 3, and the other developing cartridges 5Y, 5M, and 5K are attached to the cartridge tray 3. In this manner, by attaching and detaching the developing cartridges 5Y to 5K to and from four slots 3S serving as attachment portions provided in the cartridge tray 3, the developing cartridges 5Y to 5K can be replaced in accordance with the use conditions.

As described above, the developing cartridges 5Y to 5K are attachable to and detachable from the cartridge tray 3, and the cartridge tray 3 is movable between a first position serving as a drawn-out position and a second position serving as an attached position or accommodated position with respect to the apparatus body 2 in a state in which the developing cartridges 5Y to 5K are attached thereto. The first position serving as a drawn-out position is a position of the cartridge tray 3 where the developing cartridges 5Y to 5K attached to the cartridge tray 3 are positioned outside of the apparatus body 2 and attachable to and detachable from the cartridge tray 3. The second position serving as an attached position or accommodated position is a position of the cartridge tray 3 where the developing cartridges 5Y to 5K are positioned inside the apparatus body 2, the developing cartridges 5Y to 5K take an image forming posture described later, and thus a developing process can be executed. The cartridge tray 3 is movable between the first position and the second position along the Y direction, which is a direction perpendicular to the rotation axis of the developing roller 6. To be noted, a direction from the first position toward the second position will be referred to as an attaching direction in the description below.

The attachment and detachment of the developing cartridges 5Y to 5K to and from the cartridge tray 3, and the movement of the cartridge tray 3 with respect to the apparatus body 2 will be described in detail below.

Image Forming Process

Next, the image forming process or image forming operation will be described with reference to FIGS. 2 and 5. While the image forming process is executed, the photosensitive drums 4Y to 4K are rotationally driven in an arrow D direction at a predetermined peripheral speed. The transfer belt 11*a* of the electrostatic transfer unit 11 is also rotationally driven in an arrow C direction at a peripheral speed corresponding to the speed of the photosensitive drums 4Y to 4K. First, the surface of the photosensitive drums 4Y to 4K is uniformly charged to a predetermined polarity and potential by the charging units 8. Then, the exposing unit 10 outputs laser light L corresponding to image signals of respective colors, and exposes the surface of the photosensitive drums 4Y to 4K in a scanning manner. As a result of this, electrostatic latent images corresponding to the respective image signals are formed on the surface of the photosensitive drums 4Y to 4K.

In each of the developing cartridges 5Y to 5K, the developer in the developing frame member 50 is borne on the developing roller 6 rotationally driven in an arrow E direction at a predetermined speed. The developer borne on the developing roller 6 is supplied to the surface of the developing roller 6 by the supply roller 9. Then, the developer supplied to the developing roller 6 enters a gap between the developing roller 6 and the regulation blade 7, and is borne on the developing roller 6 as a thin layer of a uniform thickness. The developer borne on the developing roller 6 is supplied to the electrostatic latent image formed on the photosensitive drum 4. As a result of this, the developer attaches to the electrostatic latent image, and the electrostatic latent image is developed into a visual image. That is, a developer image or a toner image is formed on the surface of the photosensitive drum 4. In the present embodiment, the normal charging polarity of the developer is set to a positive polarity. Therefore, a voltage that is positively polarized as compared with the potential of the electrostatic latent images formed on the surface of the photosensitive drums 4Y to 4K is applied to the developing rollers 6 from an unillustrated power source. As a result of the settings described above, the developer charged to a positive polarity is transferred from the developing rollers 6 onto the electrostatic latent images on the photosensitive drums 4.

In addition, the recording media S are fed one by one at a predetermined control timing while being separated from each other, and the fed recording medium S is electrostatically attracted by the transfer belt 11*a* and conveyed. Then, the recording medium S moves to a transfer portion where the photosensitive drum 4Y and the transfer belt 11*a* oppose each other. At this time, control is performed such that the timing when the recording medium S is conveyed to the transfer portion is synchronized with the rotation of the photosensitive drum 4Y, and such that the position of the recording medium S and the position of the developer image on the surface of the photosensitive drum 4Y match in the transfer portion.

When the recording medium S passes through the transfer portions that are opposing portions between the photosensitive drums 4Y to 4K and the transfer rollers 12, the developer images on the photosensitive drums 4Y to 4K are, by an electric field formed in the transfer portions, sequentially transferred onto the recording medium S conveyed by the transfer belt 11*a*. At this time, a voltage of a negative polarity, which is a polarity opposite to the normal charging polarity of the developer, is applied to the transfer rollers 12 from an unillustrated power source. As a result of this, the developer having a positive polarity is electrically attracted toward the recording medium S, and thus the developer images on the photosensitive drums 4Y to 4K are transferred onto the recording medium S.

The recording medium S onto which a developer image of four colors has been transferred is separated from the transfer belt 11*a* and conveyed to the fixing unit 14. The developer image on the recording medium S is fixed by the fixing unit 14. Then, the recording medium S is discharged by the discharge unit 15 onto the discharge tray 16.

In addition, the developer remaining on the photosensitive drums 4Y to 4K without being transferred is collected by corresponding ones of the developing cartridges 5Y to 5K and reused. Specifically, the surface of the photosensitive drums 4Y to 4K having passed the transfer portions is once charged to a positive polarity by the charging units 8 such that the surface potential of the photosensitive drums 4Y to 4K is higher on the positive polarity side than the voltage applied to the developing rollers 6. As a result of this, when the remaining developer charged to a positive polarity on the surface of the photosensitive drums 4Y to 4K moves to the opposing portions between the photosensitive drums 4Y to 4K and the developing rollers 6, the remaining developer is electrically collected into the developing frame members 50.

Detailed Configuration of Drum Units and Developing Cartridges

Figure 1:
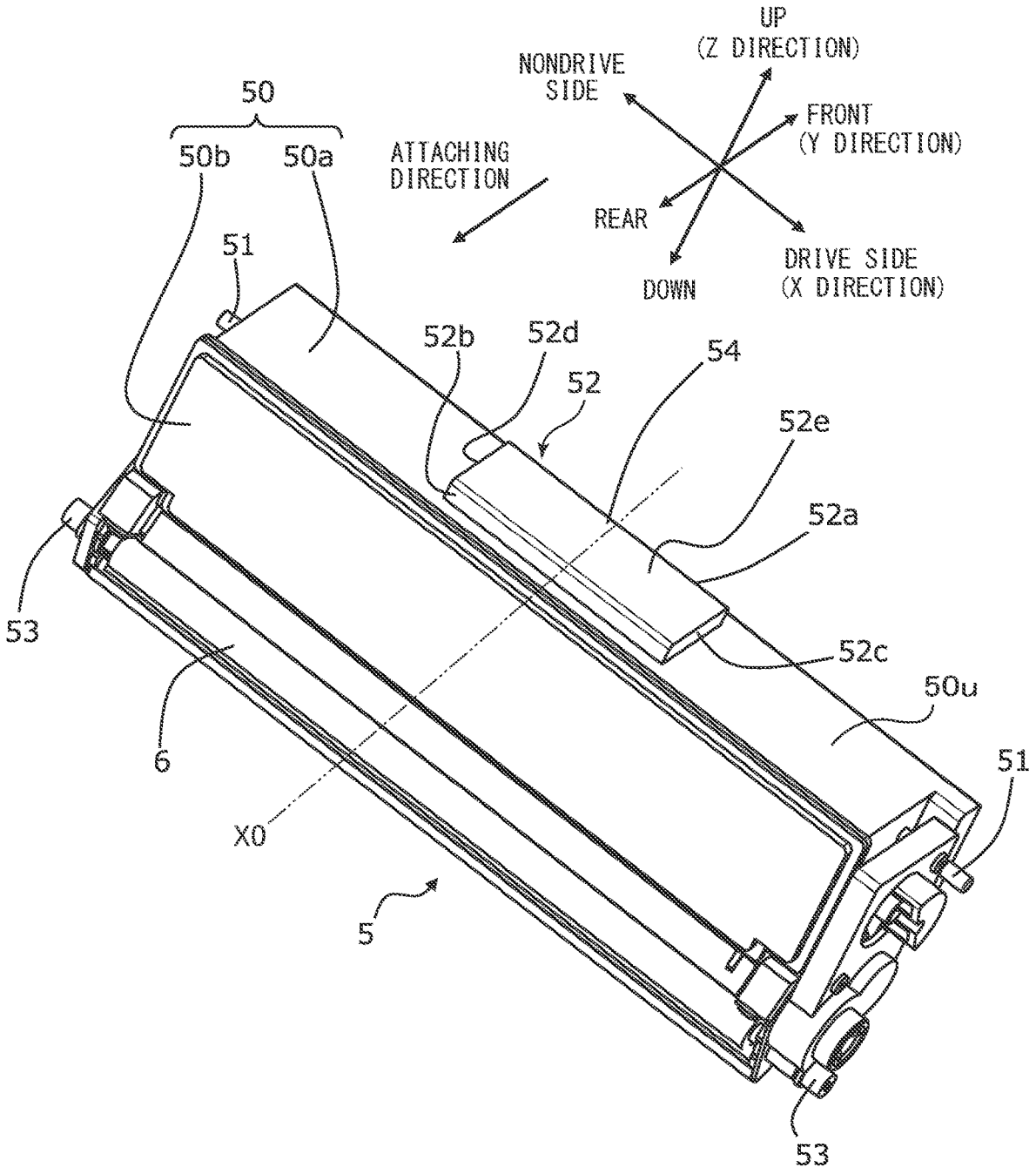
FIG. 1 is a perspective view of a developing cartridge according to a first embodiment.
Figure 6:
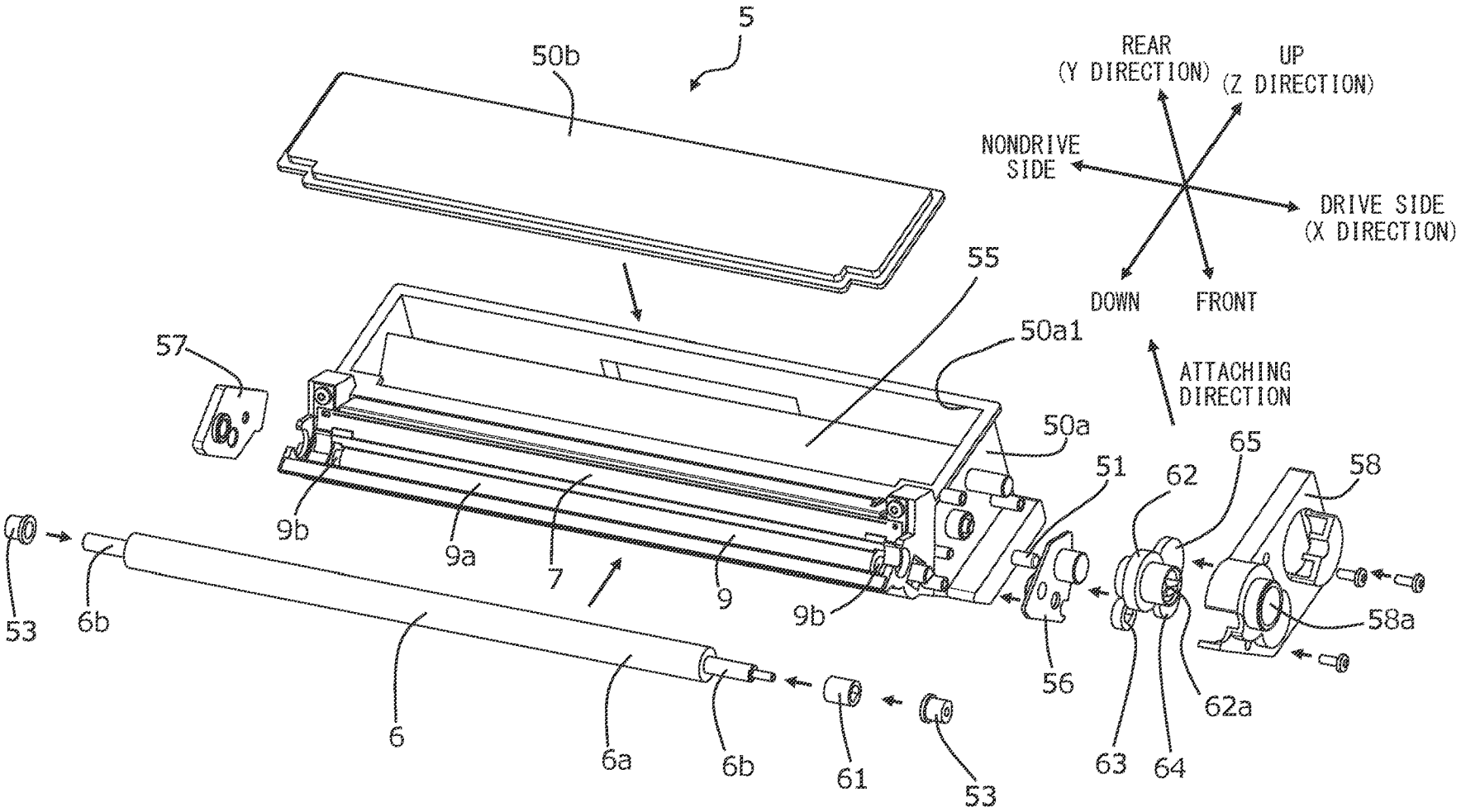
FIG. 6 is an exploded view of the developing cartridge according to the first embodiment.

A configuration of the drum units 40 and the developing cartridges 5 will be described in detail with reference to FIGS. 1, 5, and 6. FIG. 1 is a perspective view of the developing cartridge 5 according to the present embodiment. FIG. 6 is an exploded perspective view of the developing cartridge 5 according to the present embodiment, and the attaching direction of each part is indicated by an arrow. The developing cartridge 5 of FIGS. 1, 5, and 6 can be used as any one of the four developing cartridges 5Y to 5K illustrated in FIG. 2 and the like by accommodating developer of an appropriate color. In addition, four drum units 40 each illustrated in FIGS. 1, 5, and 6 are provided in the cartridge tray 3 described above, and the photosensitive drums 4 provided in the drum units 40 respectively function as the photosensitive drums 4Y to 4K illustrated in FIG. 2 and the like.

As illustrated in FIG. 5, the drum units 40 each include the photosensitive drum 4, the drum frame member 41, and the charging unit 8. The photosensitive drum 4 is attached to the drum frame member 41 so as to be rotatable about a rotation shaft extending in the X direction, that is, in the state of being rotatable about an axis extending in the X direction. In addition, a drum input coupling 42 for transmitting a driving force to the photosensitive drum 4 is provided on the drive side of the photosensitive drum 4 in the X direction as illustrated in FIG. 4. The drum input coupling 42 is configured to engage with a drum driving coupling 2*c* of the apparatus body 2 illustrated in FIG. 3B so as to receive a driving force from the apparatus body 2 and transmit the driving force to the photosensitive drum 4. The charging unit 8 is provided along the X direction, and is supported by the drum frame member 41 in the vicinity of the photosensitive drum 4. The charging unit 8 is electrically connected to the apparatus body 2.

The developing cartridges 5 each include the developing frame member 50 including the developer accommodating portion 50*c*, the developing roller 6, the supply roller 9, and the regulation blade 7 as described above. The developer accommodating portion 50*c* is provided with an agitation member 55. In addition, as illustrated in FIG. 6, the developing cartridge 5 also includes a drive-side bearing member 56, a side cover 58, and a non-drive side bearing member 57. Further, the developing cartridge 5 includes a developing gear 61, a supply gear 63, a developing input gear 62, an agitation gear 65, and an idler gear 64 for driving each member of the developing cartridge 5.

The developing roller 6 is a roller that is rotatable in an arrow E direction illustrated in FIG. 5 about a rotation shaft extending in the X direction, and is constituted by a roller body 6*a* and a roller shaft 6*b* as illustrated in FIG. 5. That is, the developing roller 6 is a roller in which the roller body 6*a* serving as an elastic portion is formed on the outer circumferential portion of the roller shaft 6*b* extending in the X direction. As the material for the roller body 6*a*, for example, rubber or sponge having elasticity is used. As the material for the roller shaft 6*b*, metal or resin having conductivity is used. In addition, the developing gear 61 is provided on the drive side of the roller shaft 6*b* in the X direction, and a pair of guide members 53 are attached or coupled to respective end portions of the roller shaft 6*b* in the X direction so as to be rotatable with respect to the roller shaft 6*b*. The guide members 53 each have a cylindrical shape centered on an axis in the X direction.

The supply roller 9 comes into contact with the developing roller 6 and supplies the developer to the surface of the developing roller 6, and is rotatable about a rotation shaft extending in the X direction. In addition, the supply roller 9 is constituted by a roller body 9*a* and a roller shaft 9*b*, and as the material for the roller body 9*a*, for example, rubber or sponge having elasticity is used. As the material for the roller shaft 9*b*, metal or resin having conductivity is used. In addition, the supply gear 63 is provided at a side end portion of the roller shaft 9*b* on the drive side in the X direction.

The developing frame member 50 supports the regulation blade 7, rotatably supports the agitation gear 65, and rotatably supports a first end of the idler gear 64. As illustrated in FIG. 5, the agitation member 55 is provided inside the developing frame member 50, and is constituted by a shaft portion 55*a* rotatable about a rotation shaft extending in the X direction, and a sheet portion 55*b* that is a flexible sheet projecting from the shaft portion 55*a* in a direction intersecting with the X direction. The agitation member 55 agitates the developer in the developing frame member 50, and conveys the developer toward the supply roller 9. As illustrated in FIG. 6, the agitation gear 65 is coupled to an end portion of the shaft portion 55*a* on the drive side in the X direction.

The drive-side bearing member 56 is fixed to the developing frame member 50 on the drive side in the X direction, and rotatably supports the roller shafts 6*b* and 9*b* of the developing roller 6 and the supply roller 9. The non-drive side bearing member 57 is fixed to the developing frame member 50 on the non-drive side in the X direction, and rotatably supports the roller shafts 6*b* and 9*b* of the developing roller 6 and the supply roller 9.

The side cover 58 is fixed to the developing frame member 50 on the drive side in the X direction, and rotatably supports a second end of the idler gear 64. In addition, the side cover 58 has a function of covering and protecting the supply gear 63, the developing input gear 62, the idler gear 64, and the agitation gear 65. Further, a through hole 58*a* is provided in the side cover 58 at a position corresponding to the developing input gear 62 such that a coupling portion 62*a* of the developing input gear 62 that will be described later is exposed through the through hole 58*a* when the developing cartridge 5 is viewed from the drive side in the X direction.

The developing input gear 62 includes the coupling portion 62*a* for engaging with the developing driving coupling 2*b* of the apparatus body 2 illustrated in FIG. 3B to receive a driving force. The driving force input to the developing input gear 62 is transmitted to the developing roller 6 through the developing gear 61, and to the supply roller 9 through the supply gear 63. Similarly, the driving force input to the developing input gear 62 is transmitted to the agitation member 55 through the idler gear 64 and the agitation gear 65.

The two guide members 53 provided at the respective end portions of the roller shaft 6*b* of the developing roller 6 are configured to project to the outside from the respective end portions of the developing cartridge 5 in the X direction. Particularly, one of the guide members 53 projects to a first side, that is, the drive side in the X direction with respect to the drive-side bearing member 56 rotatably supporting the end portion of the roller shaft 6*b* on the drive side. In addition, the other of the guide members 53 projects to a second side, that is, the non-drive side in the X direction with respect to the side non-drive side bearing member 57 rotatably supporting the end portion of the roller shaft 6*b* on the non-drive side.

The developing frame member 50 is formed by connecting (or joining or integrating) a first frame member 50*a* and a second frame member 50*b* together by a method such as ultrasonic welding or adhesion. The first frame member 50*a* has an opening 50*a*1, and the second frame member 50*b* blocks or covers the opening 50*a*1 of the first frame member 50*a*. In the present embodiment, the first frame member 50*a* is formed to surround the developer accommodating portion 50*c* on both sides in the X direction, both sides in the Z direction, and a first side in the Y direction, that is, the front side, and serves as a main part of the developing frame member 50. In contrast, the second frame member 50*b* is a lid-shaped member connected to the first frame member 50*a* so as to block the opening 50*a*1 of the first frame member 50*a* opening toward a second side in the Y direction, that is, the rear side. To be noted, the first frame member 50*a* includes a flange 50*a*2 serving as a first flange that surrounds the opening 50*a*1, and the second frame member 50*b* includes a flange 50*b*2 serving as a second flange that opposes the flange 50*a*2. The first frame member 50*a* and the second frame member 50*b* are connected to each other in a state in which the flanges 50*a*2 and 50*b*2 are in firm contact with each other such that the developer is not leaked.

As illustrated in FIG. 1, the developing frame member 50 includes the developer accommodating portion 50*c* that is formed in a box shape elongated in the X direction and accommodates developer therein. In addition, the developing frame member 50 includes a pair of bosses 51 projecting to the outside from respective end portions thereof in the X direction and each having a cylindrical shape centered on an axis in the X direction. The bosses 51 each function as a pressed portion pressed by a pressing portion.

Projection Portion of Developing Frame Member

Here, in a region (i.e., first region) or part including a center position X0 of the developing frame member 50 in the X direction on an upper surface 50*u* serving as a top surface of the developing frame member 50, a projection portion 52 projecting upward in the Z direction as compared with parts or regions (i.e., second regions) between which the region (i.e., first region) including the center position X0 is provided in the X direction is provided. The center position X0 of the developing frame member 50 in the X direction is a center position between outer end surfaces in the X direction of the pair of bosses 51 provided at respective end portions of the developing cartridge 5 in the X direction. To be noted, the projection portion 52 projects higher upward in the Z direction than upper ends of the flanges 50*a*2 and 50*b*2 of the first frame member 50*a* and the second frame member 50*b* slightly projecting upward in the Z direction from the upper surface 50*u* of the developing frame member 50.

In addition, as illustrated in FIG. 5, at least part of the projection portion 52 is positioned upstream of a center position Y0 of the upper surface 50*u* of the developing frame member 50 in the attaching direction of the cartridge tray 3. In addition, the center position of the projection portion 52 in the attaching direction, that is, the Y direction, is positioned upstream of the center position Y0 of the upper surface 50*u* of the developing frame member 50 in the attaching direction. The attaching direction of the cartridge tray 3 is a movement direction of the cartridge tray 3 being inserted in the apparatus body 2 from the first position toward the second position described above in the Y direction. In addition, the center position Y0 of the upper surface 50*u* of the developing frame member 50 in the attaching direction or the Y direction is a center position between an upper end of a surface 50*b*1 on the rear side and an upper end of a surface 50*a*3 on the front side in the Y direction in a cross-section of the developing frame member 50 taken at the center position X0 in the X direction.

The inside of the projection portion 52 is a hollow space or cavity serving as part of the developer accommodating portion 50*c*. That is, the projection portion 52 constitutes the developer accommodating portion 50*c*, which is a space capable of accommodating the developer to be supplied to the developing roller 6, together with part of the developing frame member 50 other than the projection portion 52. Therefore, the developer accommodating portion 50*c* can be expanded upward, and thus the capacity for accommodating the developer can be increased. For example, as compared with a case where the projection portion 52 is not provided and the upper surface 50*u* of the developing frame member 50 is formed as a flat surface, the capacity of the developer accommodating portion 50*c* is increased in the present embodiment by the amount corresponding to the space of an approximate rectangular parallelepiped shape inside the projection portion 52. If the capacity of the developer accommodating portion 50*c* is large, more developer can be accommodated in the developing cartridge 5, thus the frequency of replenishment of developer can be reduced, and the usability can be improved. To be noted, the capacity of the developer accommodating portion 50*c* is obtained by subtracting the volume occupied by the developing roller 6, the supply roller 9, the agitation member 55, and the like inside the developing frame member 50 from the inner volume of the developing frame member 50.

In addition, the thickness of the wall constituting the projection portion 52 is smaller than the thickness of the wall constituting part of the developing frame member 50 different from the projection portion 52 as illustrated in FIG. 5. Therefore, the projection portion 52 is more likely to elastically deform than the part of the developing frame member 50 different from the projection portion 52 when an external force is applied to the projection portion 52. To be noted, as the material for the projection portion 52, the same synthetic resin as the other part of the developing frame member 50 can be used, and in this case, for example, the projection portion 52 and the other part than the projection portion 52 of the first frame member 50*a* can be simultaneously molded by injection molding. In addition, a configuration in which the thickness of only part of the wall constituting the projection portion 52 is smaller than the thickness of the wall of the other part of the developing frame member 50 may be employed, and a configuration in which the thickness of the entirety of the wall constituting the projection portion 52 is smaller than the thickness of the wall of the other part of the developing frame member 50 may be employed.

The projection portion 52 of the present embodiment includes a first portion 52*a* on the front side in the Y direction, a second portion 52*b* on the rear side in the Y direction, a third portion 52*c* on the drive side in the X direction, a fourth portion 52*d* on the non-drive side in the X direction, and a fifth portion 52*e* on the upper side in the Z direction. The first portion 52*a* to the fourth portion 52*d* are portions connected to the upper surface 50*u* of the developing frame member 50 and extending upward from the upper surface 50*u* in the Z direction. Among these, the first portion 52*a* and the second portion 52*b* are surfaces opposing each other in the Y direction, and the third portion 52*c* and the fourth portion 52*d* are surfaces opposing each other in the X direction. The upper ends of the first portion 52*a* to the fourth portion 52*d* are connected to the peripheral edge of the fifth portion 52*e*. In the projection portion 52, a space having an approximate rectangular parallelepiped shape above a virtual plane along the upper surface 50*u* of the developing frame member 50 is defined by these five walls.

To be noted, in the present embodiment, all the walls i.e., portions 52*a* to 52*e*, constituting the projection portion 52 are formed to have a thickness smaller than the thickness of the wall of the part of the developer accommodating portion 50*c* other than the projection portion 52. However, in a configuration in which the projection portion 52 can be elastically deformed when an external force is applied thereto, a configuration in which the thickness of only part of the wall thereof is smaller than the thickness of the part of the developer accommodating portion 50*c* other than the projection portion 52 may be employed. For example, the first portion 52*a*, the second portion 52*b*, the third portion 52*c*, and the fourth portion 52*d* may be formed thin, and the fifth portion 52*e* may be formed to have the same thickness as the wall of the other part of the developer accommodating portion 50*c*. In addition, for example, a configuration in which only lower end portions, that is, root portions of the first portion 52*a*, the second portion 52*b*, the third portion 52*c*, and the fourth portion 52*d* are formed to be thinner than the wall of the other part of the developer accommodating portion 50*c* may be employed. Further, the configuration is not limited to the configuration in which the thickness of the wall constituting the projection portion 52 is made small, and the elastic deformation of the projection portion 52 may be facilitated by providing a plurality of notches or grooves parallel to each other in a wall constituting the projection portion 52.

In the present embodiment, the thickness of the wall of the projection portion 52 is set to 0.5 mm to 1.0 mm whereas the thickness of the wall of the part of the developer accommodating portion 50*c* other than the projection portion 52 is set to 1.4 mm to 2.0 mm. The thickness of the wall of the projection portion 52 is preferably set to 25% to 75% of the wall of the part of the developer accommodating portion 50*c* other than the projection portion 52.

Here, the projection portion 52 also serves as an abutted portion abutted by an abutting portion 18 of the apparatus body 2 illustrated in FIGS. 2A and 2B when moving the cartridge tray 3 from the first position to the second position as will be described later. Specifically, among the first portion 52*a*, the second portion 52*b*, and the fifth portion 52*e*, part corresponding to a range where the abutting portion 18 is provided in the X direction functions as an abutted portion 54.

The projection portion 52 also functions as a handle configured to be gripped by hand when handling the developing cartridge 5. For example, an operator may grip the developing cartridge 5 by gripping the first portion 52*a* and the second portion 52*b* of the projection portion 52. In addition, the operator may grip the developing cartridge 5 by gripping the first portion 52*a* of the projection portion 52 and the surface 50*b*1 on the rear side of the second frame member 50*b*. In addition, the operator may grip the developing cartridge 5 by gripping the second portion 52*b* of the projection portion 52 and the surface 50*a*3 on the front side of the first frame member 50*a*. As described above, the projection portion 52 projects upward from the upper surface of the developing frame member 50, and thus has a shape easy to grip. Therefore, the operator may grip the developing cartridge 5 in any posture the operator is comfortable with in addition to the examples described above.

To be noted, one or more ribs or ridges extending in the X direction may be provided on at least one side surface of the projection portion 52 in the Y direction, that is, at least one of the first portion 52*a* and the second portion 52*b*, such that the operator can grip the developing cartridge 5 more stably. In addition, instead of the rib, recess or projection dots may be arranged on a side surface of the projection portion 52 in a lattice shape, surface roughening treatment may be performed on the side surface, or a rubber sheet having a high friction coefficient may be stuck to the side surface. In addition, instead of a configuration in which the operator grips the projection portion 52 or the side surface of the developing frame member 50, a configuration in which a handle for the operator to grip may be additionally provided at a position different from the projection portion 52 on the upper surface 50*u* of the developing frame member 50.

Details of Configuration of Apparatus Body

Figure 7:
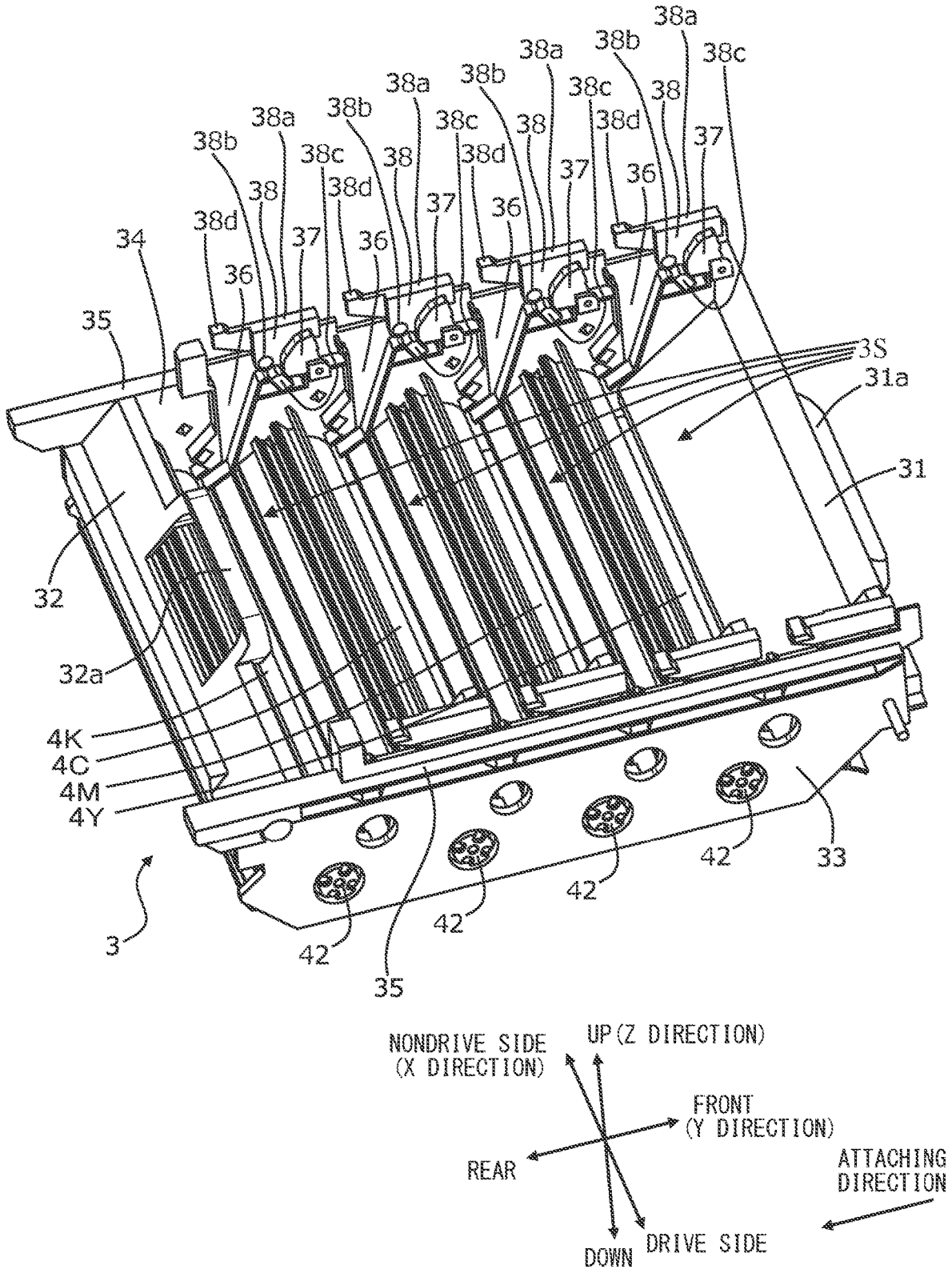
FIG. 7 is a perspective view of the cartridge tray according to the first embodiment.
Figure 8:
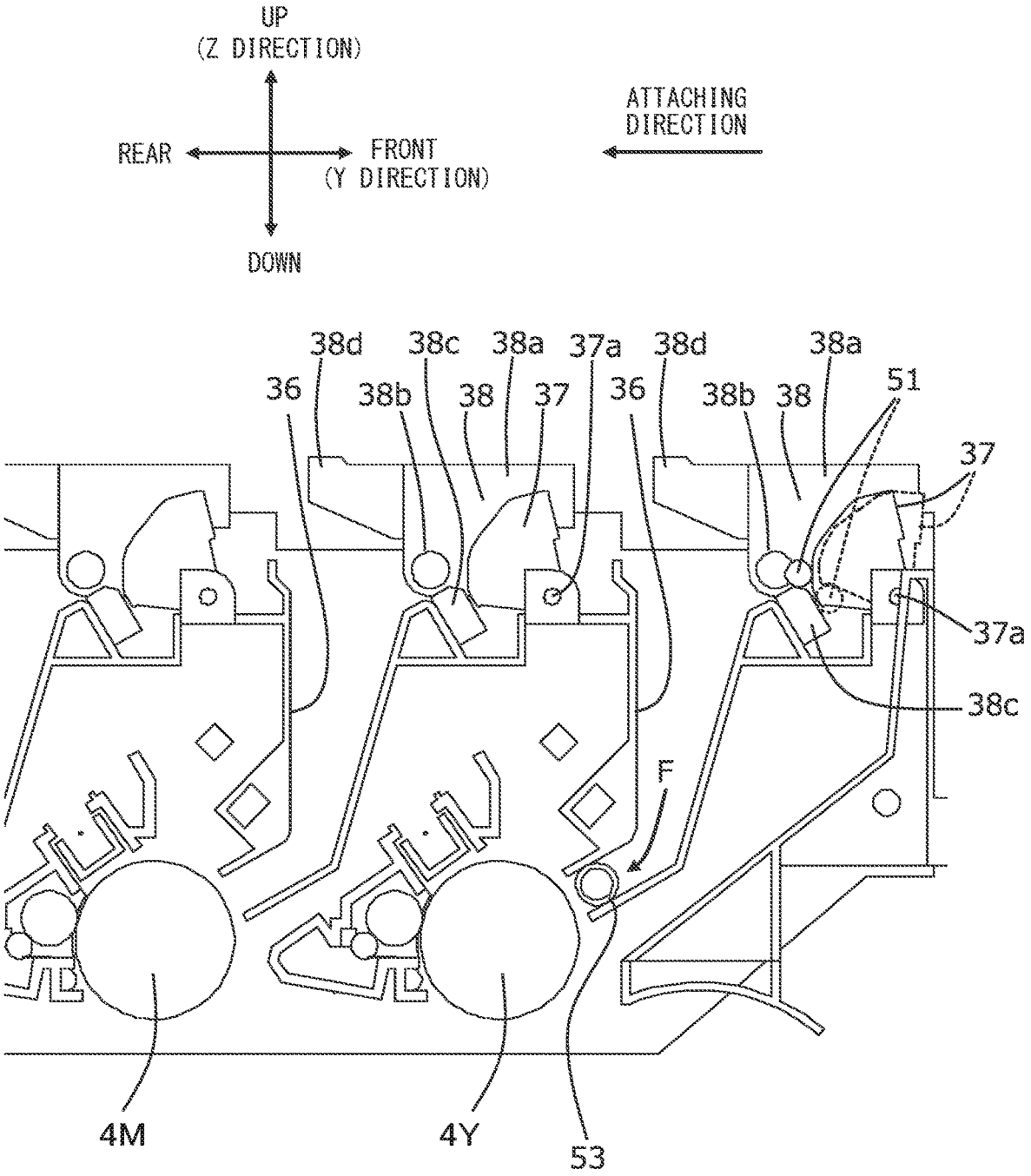
FIG. 8 is a section view of the cartridge tray according to the first embodiment.

Details of configuration of the apparatus body 2 will be described with reference to FIGS. 2, 3, 7, and 8. FIG. 7 is a perspective view of the cartridge tray 3 according to the present embodiment. FIG. 8 is a section view of the cartridge tray 3 according to the present embodiment, and illustrates a cross-section taken along a virtual plane perpendicular to the X direction as viewed from the inside toward the non-drive side in the X direction. To be noted, for the sake of convenience of description, in FIG. 8, only the bosses 51 and the guide members 53 of the developing cartridge 5 are illustrated, and the other parts of the developing cartridge 5 are omitted.

As illustrated in FIG. 2, the abutting portion 18 is provided in the apparatus body 2. The abutting portion 18 has a predetermined length in the X direction, and has a trapezoidal shape whose lower side is shorter than the upper side thereof as viewed in the X direction. In addition, the abutting portion 18 includes a first abutting portion 18*a* on the front side, a horizontal portion 18*b* on the lower side, and a second abutting portion 18*c* on the rear side. The abutting portion 18 is a member fixed to the frame member of the apparatus body 2.

In addition, as illustrated in FIG. 3, the abutting portion 18 is disposed approximately at the center of the apparatus body 2 in the X direction so as to abut the abutted portion 54 of the developing cartridge 5 at a position below the exposing unit 10. That is, the position of the abutting portion 18 in the X direction and the positions of the projection portions 52 of the developing cartridges 5Y to 5K attached to the cartridge tray 3 in the X direction preferably overlap at least partially. Preferably, the center positions X0 of the developing cartridges 5Y to 5K attached to the cartridge tray 3 in the X direction illustrated in FIG. 1 and the center position of the abutting portion 18 in the X direction are arranged so as to be aligned with each other. Further, the abutting portion 18 is disposed at a position where the abutting portion 18 is exposed in a state in which the front door 17 serving as an opening/closing member on the front side of the image forming apparatus 1 in the Y direction is open.

As illustrated in FIG. 7, the cartridge tray 3 includes a front stay 31 and a rear stay 32 extending in the X direction, and a drive-side side plate 33 and a non-drive side side plate 34 extending in the Y direction. The front stay 31 and the rear stay 32 oppose each other in the Y direction, and the drive-side side plate 33 and the non-drive side side plate 34 oppose each other in the X direction. A front handle 31*a* serving as a first operation portion is provided at a center portion in the X direction of the front side of the front stay 31 in the Y direction, and a rear handle 32*a* serving as a second operation portion is provided at a center portion in the X direction of the upper end of the rear stay 32. The four drum units 40 including the photosensitive drums 4Y to 4K are disposed between the front stay 31 and the rear stay 32 in the Y direction, and extend in the X direction to bridge a gap between the drive-side side plate 33 and the non-drive side side plate 34. The slots 3S serving as attachment portions for attaching the developing cartridges 5Y to 5K are each a space opening upward between adjacent drum units 40 in the Y direction and between the front stay 31 and the rear stay 32.

A guide rail 35 serving as a guided portion is provided at the upper edge of each of the drive-side side plate 33 and the non-drive side side plate 34. The guide rail 35 extends in the Y direction, and has a shape projecting to the outside in the X direction with respect to the main plane of the drive-side side plate 33 or the side non-drive side side plate 34. Further, the guide rail 35 is movably supported by a tray draw-out rail 2*a* of the apparatus body 2.

As illustrated in FIGS. 7 and 8, a guide groove 36 that is a recess shape is defined in each of the surfaces of the drive-side side plate 33 and the nod-drive side side plate 34 on the inside in the X direction toward the outside in the X direction. The guide groove 36 is a guide shape that guides attachment of each of the developing cartridges 5Y to 5K to the slot 3S by guiding the guide member 53 coaxial to the developing roller 6. To be noted, although the guide groove 36 of the non-drive side side plate 34 is illustrated in FIGS. 7 and 8, the guide groove 36 is also provided on the drive-side side plate 33 at a position and in a shape symmetrical to the guide groove 36 on the non-drive side side plate 34 in the X direction.

Four guide grooves 36 are defined at positions corresponding to the developing cartridges 5Y to 5K on the inner side surface in the X direction of each of the drive-side side plate 33 and the non-drive side side plate 34. The guide grooves 36 each extend downward from the upper side in the Z direction and from the upper edge of the drive-side side plate 33 or the non-drive side side plate 34 toward the corresponding one of the photosensitive drums 4Y to 4K. In addition, the lower portion of each of the guide grooves 36 extends in a direction intersecting with the Z direction along a radial direction of the rotation axis of the corresponding one of the photosensitive drums 4Y to 4K. That is, the guide grooves 36 have a portion that guide the developing cartridges 5Y to 5K such that the developing rollers 6 move closer to and away from corresponding ones of the photosensitive drums 4Y to 4K.

As illustrated in FIG. 8, four pairs of a pressing cam 37 and a separation cam 38 are provided on the inner side of the non-drive side side plate 34 in the X direction in correspondence with the developing cartridges 5Y to 5K. To be noted, the pressing cams 37 and the separation cams 38 similar to those described below are also provided on the inner side of the drive-side side plate 33 in the X direction. Therefore, description for the drive-side side plate 33 will be omitted.

The pressing cam 37 serving as a pressing portion includes a support shaft 37*a* extending in the X direction, and is formed in an approximate circular sector shape centered on the support shaft 37*a* as viewed in the X direction. The support shaft 37*a* is rotatably supported by the non-drive side side plate 34, and thus the pressing cam 37 is pivotable about the support shaft 37*a*. In addition, the pressing cam 37 is urged in a counterclockwise direction in FIG. 8 by an urging member such as an unillustrated spring.

The separation cams 38 are each provided adjacent to the corresponding one of the pressing cams 37 on the rear side and on the outer side in the X direction. The separation cams 38 each include a pillar portion 38*a* having a pillar shape extending in the Y direction, a support hole 38*b* positioned below a center portion of the pillar portion 38*a* in the Y direction, and a separation portion 38*c* provided below the support hole 38*b* and projecting toward the inner side in the X direction.

The pillar portion 38*a* is integrally provided with a projection portion 38*d* projecting upward and toward the outer side in the X direction on a rear end portion thereof. In addition, the pillar portion 38*a* is positioned above the guide rail 35.

The separation portion 38*c* has a shape in which a corner of an approximate quadrilateral shape on the upper front side as viewed in the X direction is cut off.

The support hole 38*b* is supported by a corresponding shaft of the non-drive side side plate 34 projecting to the inner side in the X direction. As a result of this, the separation cam 38 is pivotable about the support hole 38*b*. In addition, the separation cam 38 is urged in a clockwise direction in FIG. 8 by an unillustrated urging member.

When the developing cartridges 5Y to 5K are not attached to the cartridge tray 3, the lower end portion of the pressing cam 37 opposes the separation portion 38*c* of the separation cam 38 on the front side with a minute gap therebetween.

Attachment and Detachment of Developing Cartridges to and from Cartridge Tray

Attachment and detachment of the developing cartridges 5Y to 5K to and from the cartridge tray 3 will be described with reference to FIG. 8. As described above, to attach the developing cartridges 5Y to 5K to the apparatus body 2, the developing cartridges 5Y to 5K first need to be attached to the cartridge tray 3.

When attaching the developing cartridges 5Y to 5K to the cartridge tray 3, the operator inserts the developing cartridges 5Y to 5K in the slots 3S of the cartridge tray 3 downward from above. At this time, as illustrated in FIG. 8, the guide members 53 provided at respective end portions of the roller shafts 6*b* of the developing rollers 6 in the X direction enter the guide grooves 36 of the cartridge tray 3.

When the operator further lowers the developing cartridges 5Y to 5K, the guide members 53 move downward in the Z direction in the guide grooves 36. Then, the bosses 51 of the developing cartridges 5Y to 5K come into contact with opposing portions between the pressing cams 37 and the separation portions 38*c* of the separation cams 38 from above. This posture is a detaching posture serving as a first posture or first orientation of the developing cartridges 5Y to 5K. When the developing cartridges 5Y to 5K are in the detaching posture, the bosses 51 do not receive a pressing force from the pressing cams 37, and therefore the developing cartridges 5Y to 5K can be detached from the cartridge tray 3.

Next, the operator pivots the developing cartridges 5Y to 5K in the detaching posture to the front side in the Y direction about the roller shafts 6*b* of the developing rollers 6. In this case, the bosses 51 enter the gap between the pressing cams 37 and the separation cams 38 while pushing through the gap between the pressing cams 37 and the separation portions 38*c* of the separation cams 38 in accordance with the pivot of the developing cartridges 5Y to 5K (see the boss 51 and the separation cam 38 indicated by broken lines in FIG. 8).

Then, the pressing cams 37 press the bosses 51 downward to the rear side by an urging force of an urging member. Then, the guide members 53 of the developing cartridges 5Y to 5K move in an arrow F direction along the guide grooves 36, and come into pressure contact with corresponding ones of the photosensitive drums 4Y to 4K. The arrow F direction is a direction in which the developing rollers 6 move closer to the photosensitive drums 4Y to 4K. The state in which the developing cartridges 5 are in this posture is a state in which the developing cartridges 5Y to 5K are completely attached to the cartridge tray 3, and this will be referred to as an image forming posture serving as a second posture or second orientation of the developing cartridges 5Y to 5K. In other words, the image forming posture is a posture or a position of the developing cartridges 5Y to 5K in which the developing rollers serving as developer bearing members abut the corresponding photosensitive drums serving as photoconductors or image bearing members, and is a posture or a position for the developing cartridges 5Y to 5K to appropriately perform the development. To be noted, although a case where the developing rollers abut the photosensitive drums in the image forming posture has been described in the present embodiment, a configuration in which the developing rollers oppose the photosensitive drums with a predetermined gap appropriate for development therebetween in the image forming posture may be employed. This gap will be also referred to as a developing gap.

To be noted, in the case of detaching the developing cartridges 5Y to 5K from the cartridge tray 3, the developing cartridges 5Y to 5K may be operated in a procedure reversed from the attachment thereof to the cartridge tray 3. That is, the operator pivots the developing cartridges 5Y to 5K in the image forming posture to the rear side in the Y direction about the roller shafts 6*b* of the developing rollers 6 to change the posture to the detaching posture. In this case, the bosses 51 are released from the pressing cams 37 and the developing cartridges 5Y to 5K become detachable from the cartridge tray 3. Therefore, the operator may pull out the developing cartridges 5Y to 5K upward from the slots 3S to detach the developing cartridges 5Y to 5K from the cartridge tray 3.

Figure 9A:
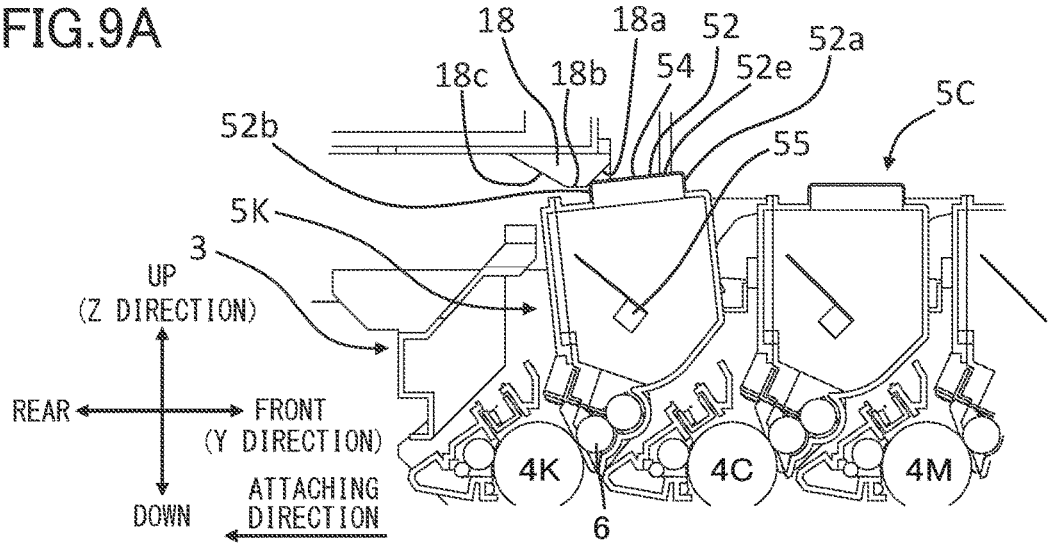
FIGS. 9A to 9C are each a diagram for describing the posture change of the developing cartridge in accordance with the movement of the cartridge tray according to the first embodiment.
Figure 9B:
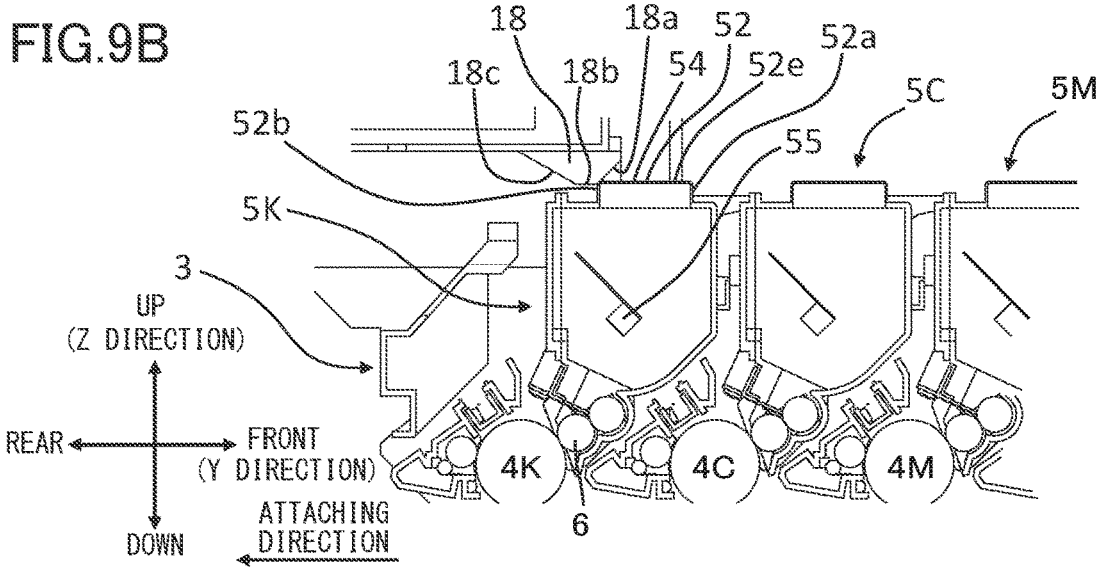
Figure 9C:
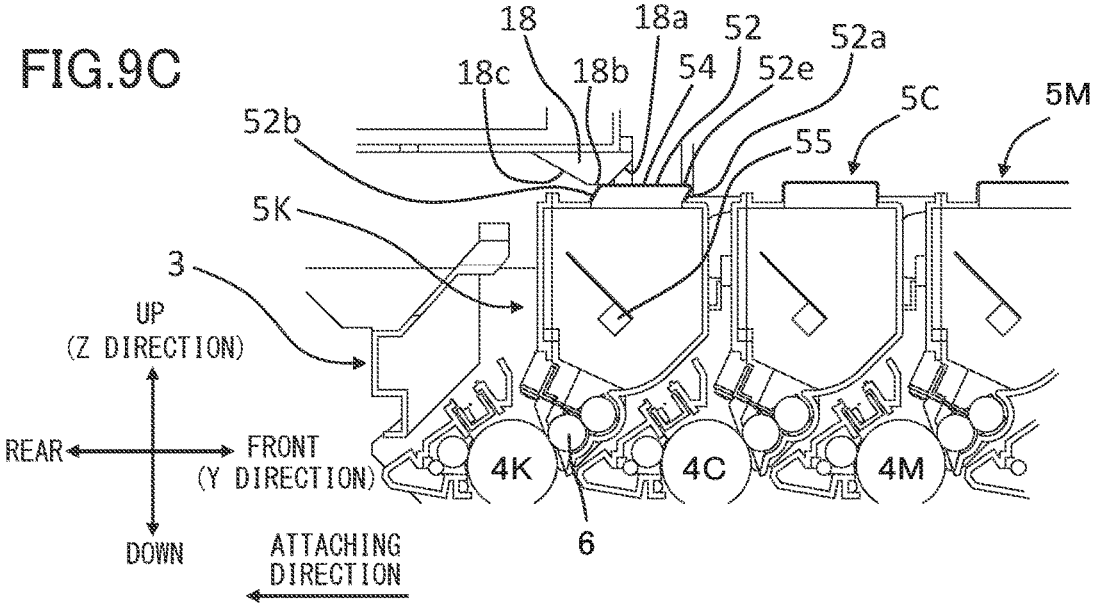

Posture Change of Developing Cartridges in Accordance with Movement of Cartridge Tray How the developing cartridges 5Y to 5K transition from the detaching posture to the image forming posture in accordance with the movement of the cartridge tray 3 will be described with reference to FIGS. 9A to 9C. FIGS. 9A to 9C are each a section view of the image forming apparatus 1 according to the present embodiment illustrating a cross-section taken along a virtual plane perpendicular to the X direction as viewed in the X direction, and illustrates how the cartridge tray 3 moves. The virtual plane is a plane passing through the abutting portion 18 and the projection portions 52 of the developing cartridges 5Y to 5K.

Normally, when attaching the cartridge tray 3 to the apparatus body 2, it is desired that the developing cartridges 5Y to 5K are in the image forming posture and the positions of the developing cartridges 5Y to 5K are stable while movement of the developing cartridges 5Y to 5K to the detaching posture is suppressed by the urging force of the pressing cams 37. However, a case where the cartridge tray 3 is attached to the apparatus body 2 in a state in which the developing cartridges 5Y to 5K are in the detaching posture can be considered.

FIGS. 9A to 9C illustrate a case where attachment of the cartridge tray 3 is performed in a state in which the black developing cartridge 5K is in the detaching posture and the developing cartridges 5Y, 5M, and 5C of the other colors are in the image forming posture.

When the operator grips the front handle 31*a* and moves the cartridge tray 3 in the attaching direction from the first position toward the second position, the projection portion 52 of the black developing cartridge 5K abuts the abutting portion 18 of the apparatus body 2 as illustrated in FIG. 9A. Specifically, a connecting portion, that is, a corner portion between the second portion 52*b* and the fifth portion 52*e* of the projection portion 52 abuts the first abutting portion 18*a*, which is a surface of the abutting portion 18 on the upstream side in the attaching direction. Then, the projection portion 52 is pressed downward toward the front side by the reaction force from the first abutting portion 18*a*. In other words, the direction of the reaction force that the projection portion 52 receives from the abutting portion 18 in accordance with the movement of the cartridge tray 3 in the attaching direction approximately coincides with the operation direction in which the operator moves the developing cartridge 5K from the detaching posture to the image forming posture. Therefore, as a result of this reaction force, the developing cartridge 5K pivots to the front side in the Y direction about the rotation axis of the developing roller 6, and moves or transitions from the detaching posture to the image forming posture. In other words, as a result of the reaction force, the developing cartridge 5K pivots upstream in the attaching direction about the axis of the guide members 53, and the posture of the developing cartridge 5K changes from the detaching posture to the image forming posture.

Here, when the developing cartridge 5K moves from the detaching posture to the image forming posture by the projection portion 52 being pressed by the abutting portion 18, the bosses 51 illustrated in FIG. 8 provided at the respective end portions of the developing cartridges 5K in the X direction enter the gaps between the pressing cams 37 and the separation cams 38 against the urging force of the urging member. At this time, a resistance force in a direction opposite to the movement direction of the developing cartridge 5K, that is, a resistance force toward the rear side in the Y direction is applied to the respective end portions of the developing cartridge 5K in the X direction from the pressing cams 37 on the drive side and the non-drive side in the X direction.

In the present embodiment, since the projection portion 52 including the abutted portion 54 is provided in a portion including the center position X0 of the developing cartridge 5K in the X direction, a rotational moment is less likely to be applied to the developing cartridge 5K when the abutting portion 18 abuts the abutted portion 54. That is, in the present embodiment, the force by which the abutted portion 54 is pressed by the abutting portion 18 to the front side in the Y direction at the center portion in the X direction and the force by which the bosses 51 are pressed by the pressing cams 37 to the rear side in the Y direction at the respective end portions in the X direction will be balanced out on both sides with respect to the center position X0 in the X direction. In contrast, if the abutting portion 18 and the abutted portion 54 are disposed at positions displaced from the center position X0 in the X direction to one side, the force that the developing cartridge 5K receives when the abutting portion 18 abuts the abutted portion 54 might not be balanced out on both sides with respect to the center position X0 in the X direction. As a result of this, there is a risk that the developing cartridge 5K rotates as viewed from above and the movement of the developing cartridge 5K is hindered. In contrast, in the present embodiment, the generation of the rotational moment is suppressed as described above, and therefore the developing cartridge 5K can move from the detaching posture to the image forming posture while maintaining the balance on both sides in the X direction without occurrence of a posture change such as rotation as viewed from above.

As illustrated in FIG. 9B, the projection portion 52 is still in contact with the abutting portion 18 when the movement of the developing cartridge 5K to the image forming posture is completed.

When the cartridge tray 3 is further moved in the attaching direction toward the second position, the projection portion 52 is elastically deformed downward to the front side by the reaction force from the first abutting portion 18*a* as illustrated in FIG. 9C. Although an example in which the entirety of the projection portion 52 is elastically deformed downward to the front side is schematically illustrated in FIG. 9C, actually only part of the projection portion 52 may be elastically deformed, and the deformation direction of the projection portion 52 is not limited to the illustrated example. For example, the deformation of the projection portion 52 is a combination of elastic deformation toward the front side, elastic deformation toward the lower side, local elastic deformation of the abutted part, elastic deformation in which the center portion of the projection portion 52 in the X direction is twisted with respect to the other part, and so forth.

Then the projection portion 52 elastically deformed as illustrated in FIG. 9C goes beneath the abutting portion 18, and passes through the space under the abutting portion 18 while the fifth portion 52*e* is sliding on the horizontal portion 18*b*. That is, the projection portion 52 of the present embodiment is configured to have an appropriate stiffness, that is, a rigidity high enough for the developing cartridge 5K to be moved from the detaching posture to the image forming posture by the abutting portion 18 pressing the projection portion 52, and a softness high enough for the projection portion 52 to easily pass through the space under the abutting portion 18 while being elastically deformed by the reaction force from the abutting portion 18. Therefore, in a configuration in which the projection portion 52 abuts the abutting portion 18 of the apparatus body 2 in accordance with the movement of the cartridge tray 3, breakage of the projection portion 52 can be suppressed. In addition, in a configuration in which the projection portion 52 slides on the abutting portion 18 of the apparatus body 2 in accordance with the movement of the cartridge tray 3, increase in the operational load of the attaching operation of the cartridge tray 3 by the operator caused by the frictional drag between the projection portion 52 and the abutting portion 18 can be suppressed.

When the cartridge tray 3 is further moved toward the second position, the projection portions 52 of the developing cartridges 5C, 5M, and 5Y of the other colors in the image forming posture also sequentially abut the abutting portion 18, and similarly pass through the space under the abutting portion 18 while elastically deforming. Then, by closing the front door 17 after completely inserting the cartridge tray 3 such that the cartridge tray 3 reaches the second position, attachment of the cartridge tray 3 and the developing cartridges 5Y to 5K to the apparatus body 2 is completed.

By configuring such that the projection portion 52 of each of the developing cartridges 5Y to 5K provided with the abutted portion 54 abuts the abutting portion 18 in accordance with the movement of the cartridge tray 3 as described above, the developing cartridges 5Y to 5K can be changed from the detaching posture to the image forming posture. Therefore, attachment of the developing cartridges 5Y to 5K to the apparatus body 2 in the detaching posture can be suppressed. Therefore, the developing cartridges 5Y to 5K can be more reliably positioned in the image forming posture to press the developing rollers 6 against the photosensitive drums 4Y to 4K, and thus an image formation failure caused by the developing cartridges 5Y to 5K being positioned in the detaching posture can be suppressed.

In addition, by forming the projection portion 52 to project upward from the developing frame member 50 and have a space or hollow inside serving as part of the developer accommodating portion 50*c* as described above, the developer accommodating portion 50*c* can be expanded, and thus the capacity for accommodating developer can be increased.

In addition, by providing the abutted portion 54 in the projection portion 52, even in the case where any one of the developing cartridges 5Y to 5K is in the detaching posture, the developing cartridge 5 can be changed to the image forming posture in accordance with the movement of the cartridge tray 3. Further, since abutted portions 54 separate from the projection portions 52 do not need to be additionally provided in the developing cartridges 5Y to 5K, the configuration of the developing cartridges 5Y to 5K can be simplified.

In addition, at least part of the wall constituting the projection portion 52 of each of the developing cartridges 5Y to 5K provided with the abutted portion 54 is formed to be thinner than the wall constituting part of the developer accommodating portion 50*c* different from the projection portion 52. Therefore, when the abutted portion 54 abuts the abutting portion 18, the projection portion 52 can elastically deform and pass through a space under the abutting portion 18.

In addition, after the abutted portion 54 abuts the abutting portion 18, by moving the cartridge tray 3 further, the abutted portions 54 of all the developing cartridges 5 can be caused to abut the abutting portion 18 to move the developing cartridges 5 from the detaching posture to the image forming posture in accordance with the movement of the cartridge tray 3.

In addition, the abutted portions 54 of the developing cartridges 5Y to 5K abutted by the abutting portion 18 are provided in regions including the center positions X0 of the developing cartridges 5Y to 5K in the X direction. Therefore, when moving the developing cartridges 5 from the detaching posture to the image forming posture, the abutting portion 18 can be caused to act on the center portions of the developing cartridges 5 in the X direction. Therefore, the developing cartridges 5Y to 5K can be moved from the detaching posture to the image forming posture by a simple configuration while maintaining the balance of the developing cartridges 5Y to 5K in the X direction.

In addition, in this apparatus body 2, the abutting portion 18 is disposed at such a position as to be exposed in a state in which the front door 17 is open. Therefore, the operator can visually observe how the abutting portion 18 abut the abutted portions 54 of the developing cartridges 5Y to 5K, and thus the operator can recognize the posture change of the developing cartridges 5Y to 5K.

Modification Example

To be noted, the shape of the projection portion 52 is not limited to the rectangular shape or a rectangular parallelepiped shape illustrated in FIGS. 1, 5, and the like, and may be, for example, an elliptical shape or a triangular shape in top view. In addition, although the projection portion 52 of the present embodiment is provided on only part of the upper surface 50*u* of the developing frame member 50 in the X direction, the projection portion 52 having the same shape as that of the present embodiment in section view as viewed in the X direction may be provided over the entirety of the upper surface 50*u* in the X direction. In addition, although the projection portion 52 of the present embodiment is provided on only part of the upper surface 50*u* of the developing frame member 50 in the Y direction, the projection portion 52 having the same shape as that of the present embodiment in section view as viewed in the Y direction may be provided over the entirety of the upper surface 50*u* in the Y direction.

Second Embodiment

A cartridge according to a second embodiment of the present disclosure will be described with reference to FIGS. 10 to 24C. To be noted, the second embodiment is different from the first embodiment described above in the configuration of the projection portion and the abutted portion provided in the developing cartridge. In the description below, description of elements denoted by the same reference signs as in the first embodiment will be omitted assuming that these elements substantially have the same configurations and effects as in the first embodiment, and parts different from the first embodiment will be mainly described.

Configuration of Developing Cartridges

A configuration of the developing cartridge 5 according to the present embodiment will be described in detail with reference to FIGS. 10, 11, and 12. This developing cartridge 5 can be used as any of the developing cartridges 5Y to 5K of the image forming apparatus 1 described in the first embodiment by accommodating appropriate developer.

Figure 10:
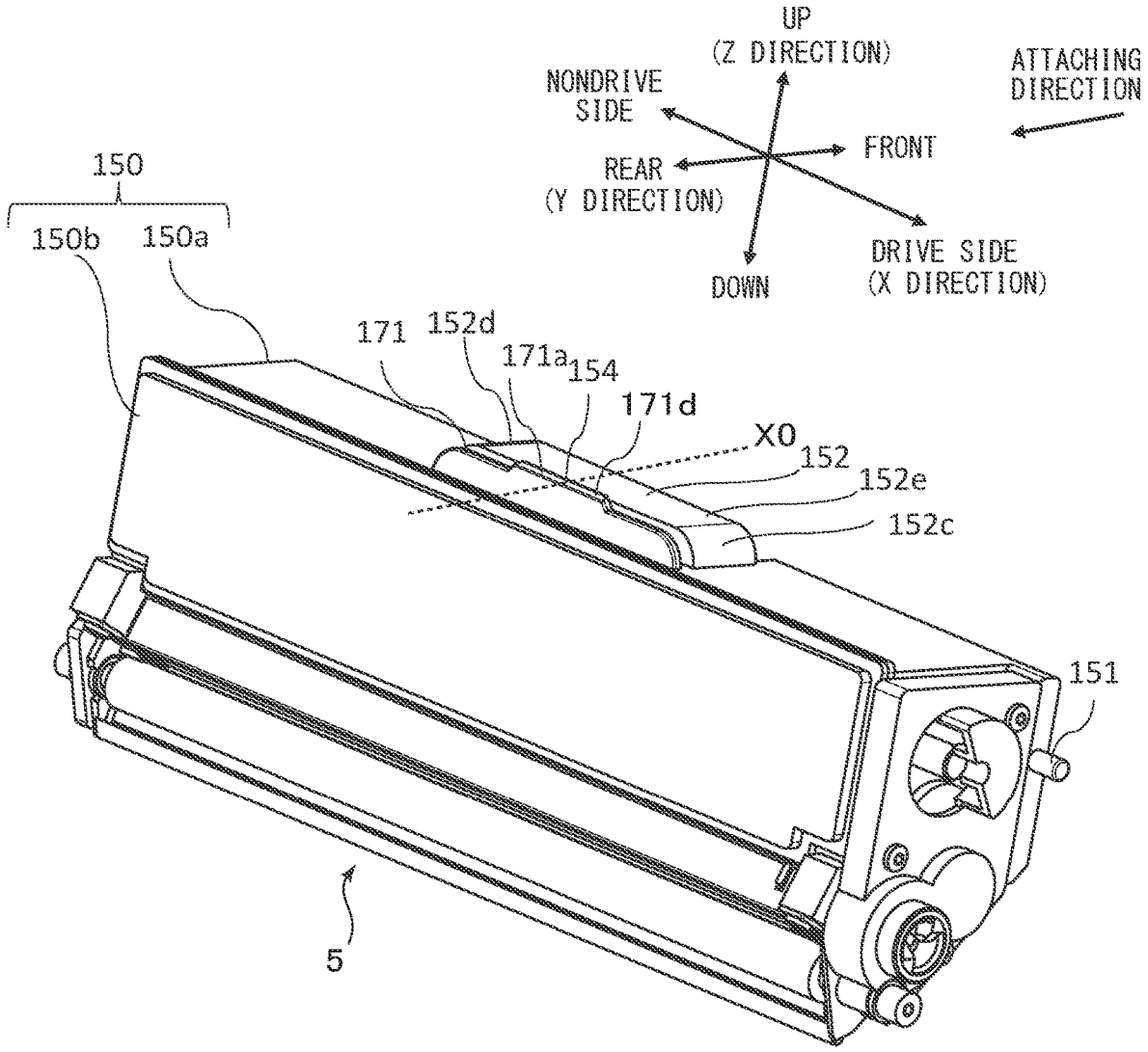
FIG. 10 is a perspective view of a developing cartridge according to a second embodiment.

FIG. 10 is a perspective view of the developing cartridge 5 according to the present embodiment. FIG. 11 is a section view of the developing cartridge 5 according to the present embodiment illustrating a cross-section taken at a center position X0 in the X direction thereof along a virtual plane perpendicular to the X direction. In addition, FIGS. 12A and 12B are each an enlarged section view of the vicinity of a rib 171 of FIG. 11. FIG. 12A illustrates a state before the rib 171 is deformed, and FIG. 12B illustrates a state after the rib 171 is deformed by receiving an external force.

A developing frame member 150 of the developing cartridge 5 is formed by connecting a first frame member 150*a* and a second frame member 150*b* together by a method such as ultrasonic welding or adhesion. The first frame member 150*a* has an opening 150*a*1, and the second frame member 150*b* blocks or covers the opening 150*a*1 of the first frame member 150*a*.

As illustrated in FIG. 10, the developing frame member 150 includes a developer accommodating portion 150*c* that is formed in a box shape elongated in the X direction and accommodates developer therein. In addition, the developing frame member 150 includes, as pressed portions, a pair of bosses 151 projecting to the outside from respective end portions thereof in the X direction and each having a cylindrical shape. To be noted, although only the boss 151 on the drive side in the X direction is illustrated in FIG. 10, the same boss 151 is also disposed on the non-drive side.

Here, in a region (i.e., first region) or part including a center position X0 of the developing frame member 150 in the X direction on an upper surface 170, a projection portion 152 projecting upward in the Z direction as compared with parts or regions (i.e., second regions) between which the region (i.e., first region) including the center position X0 is provided in the X direction is provided. At least part of the projection portion 152 is positioned upstream in the attaching direction of a center position Y0 of the upper surface 170 in the Y direction as illustrated in FIG. 11. The projection portion 152 of the present embodiment has an approximate rectangular shape or an approximate rectangular parallelepiped shape including a first portion 152*a* on the front side in the Y direction, a second portion 152*b* on the rear side in the Y direction, a third portion 152*c* on the drive side in the X direction, a fourth portion 152*d* on the non-drive side in the X direction, and a fifth portion 152*e* on the upper side in the Z direction. The inside of the projection portion 152 is a hollow space or cavity serving as part of the developer accommodating portion 150*c*. Therefore, the developer accommodating portion 150*c* can be expanded upward as compared with a case where the upper surface 170 of the developing frame member 150 is formed as a flat surface, and thus the capacity for accommodating the developer can be increased.

In addition, a rib 171 projecting upward in the Z direction from the upper surface 170 is provided in a portion or a region including the center position X0 in the X direction on the upper surface 170 of the developing frame member 150. The rib 171 functions as an abutted portion abutted by the abutting portion 18 of the apparatus body 2. The rib 171 is positioned downstream of the projection portion 152 in the attaching direction of the cartridge tray 3, that is, on the rear side in the Y direction. The rib 171 has a plate shape including a rib distal end 171*a* extending higher upward than the upper surface of the projection portion 152, that is, the fifth portion 152*e*, and extends in the X direction within a range that is part of the developing frame member 150 in the X direction. Further, the rib distal end 171*a* includes a rib inclined surface 171*d* whose downstream side in the attaching direction of the cartridge tray 3 is lower in the Z direction.

Here, the rib 171 is a member that can be elastically deformed with respect to the developing frame member 150 by bending toward the upstream side in the attaching direction, that is, toward the front side in the Y direction, when an external force is applied thereto. Particularly, the rib 171 can elastically deform to a height equal to or lower than the upper surface of the projection portion 152, that is, the fifth portion 152*e* in the Z direction by receiving the external force as illustrated in FIG. 12B. The rib 171 is formed such that the thickness thereof in the Y direction is smaller than the length thereof in the Z direction. In other words, the rib 171 has a plate shape whose thickness in the attaching direction of the cartridge tray 3, that is, the Y direction, is larger than the width thereof in the vertical direction, that is, the Z direction. Further, a root portion 171*b* of the rib 171 that is a connection portion to the upper surface 170 of the developing frame member 150 is preferably provided with a cutout portion 171*c*. The cutout portion 171*c* is a shape such as a groove portion or a notch in which a recess shape recessed downward in the Z direction extend in at least part of, preferably a half or more of and more preferably over the entirety of, the rib 171 in the X direction. According to such a configuration, the rib 171 is more likely to elastically deform with respect to the developing frame member 150 by bending upstream in the attaching direction, that is, toward the front side in the Y direction, when an external force is applied thereto.

In the present embodiment, whereas the thickness of the wall of the developing frame member 150 is from 1.2 mm to 2.0 mm, the thickness of the rib 171 is set to 0.8 mm to 1.2 mm, and the depth of the cutout of the cutout portion 171*c* is set to 0.2 mm to 1.2 mm. For example, by setting the thickness of the wall of the developing frame member 150 as 100%, the thickness of the rib 171 is preferably set to 40% to 100%, and the depth of the cutout of the cutout portion 171*c* is preferably set to 10% to 60%.

Figure 11:
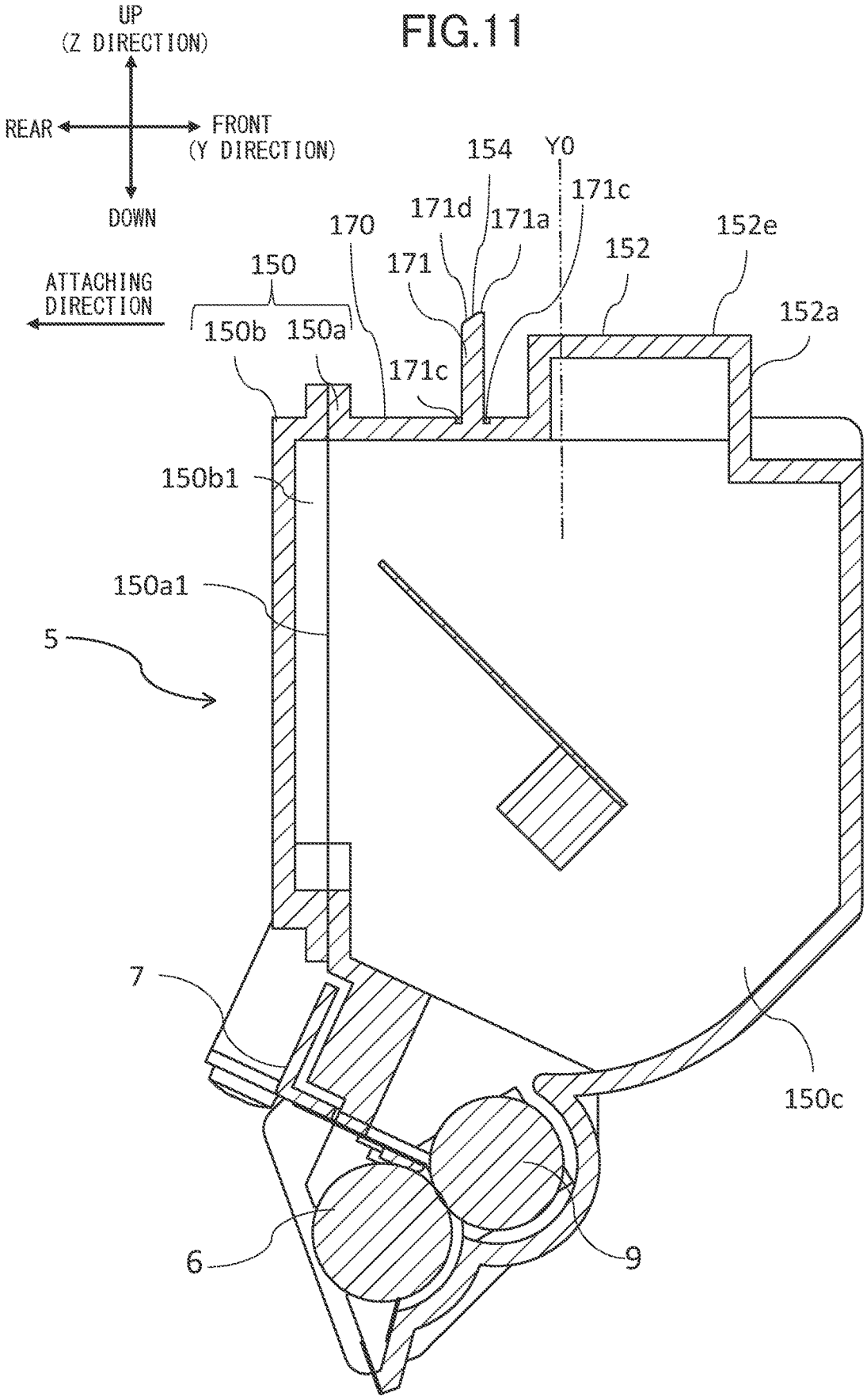
FIG. 11 is a section view of the developing cartridge according to the second embodiment.
Figure 12A:
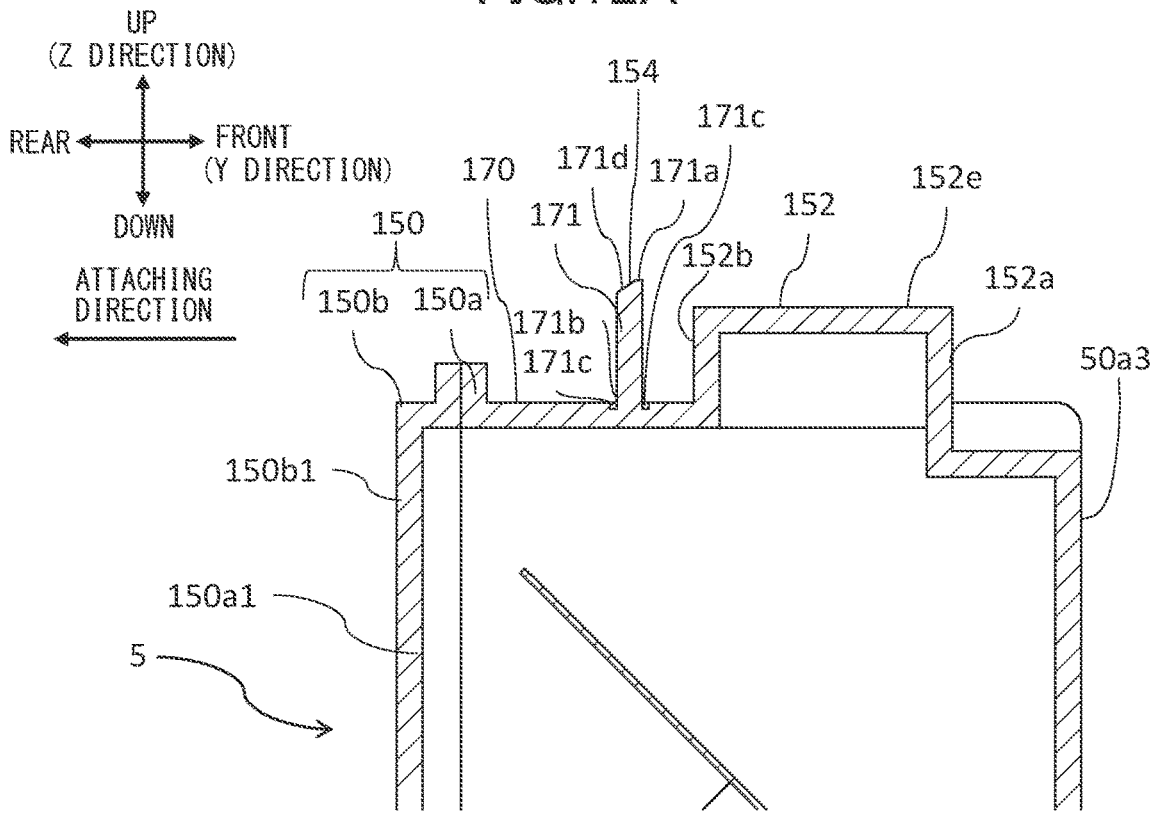
FIGS. 12A and 12B are each an enlarged section view of the vicinity of a rib of the developing cartridge according to the second embodiment.
Figure 12B:
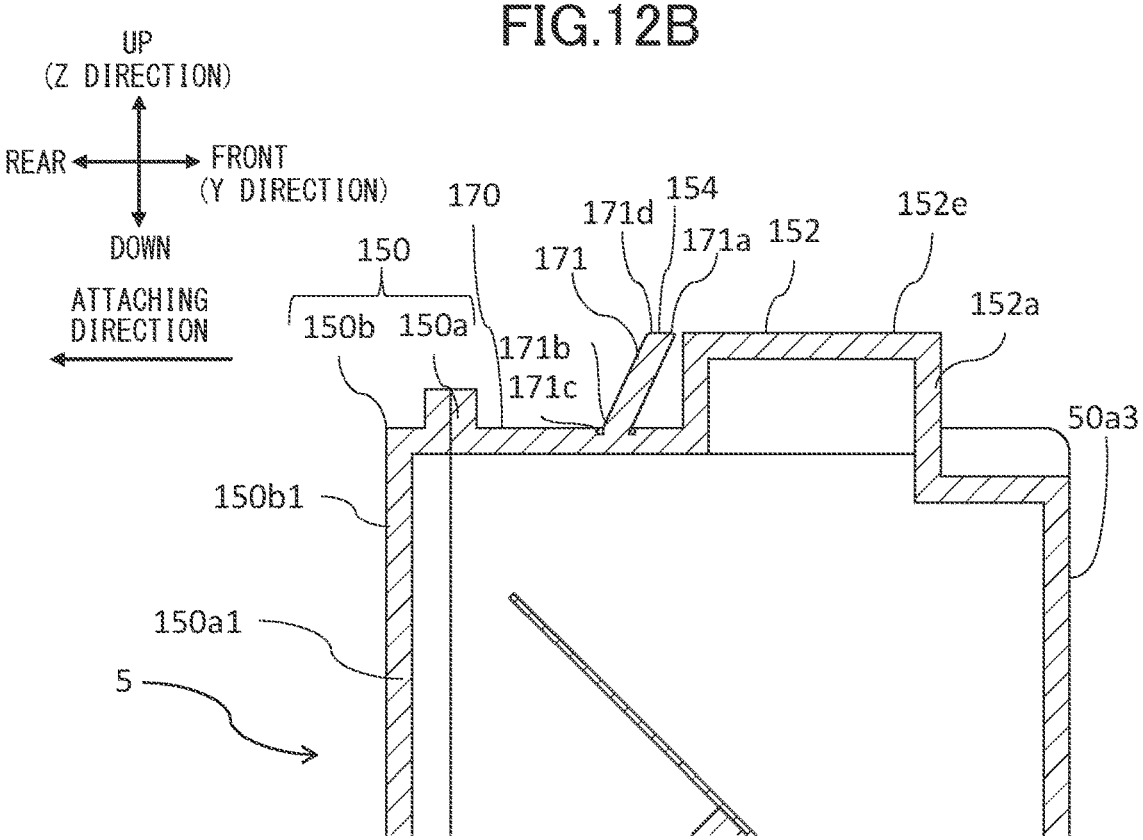

Here, the arrangement and shape of the rib 171 is not limited to those illustrated in FIGS. 10, 11, and 12 as long as the rib 171 has a shape that is elastically deformable to a height equal to or lower than the upper surface of the projection portion 152, that is, the fifth portion 152*e*, in the Z direction. Modification examples of the rib 171 and details of the configuration of the developing cartridge 5 will be described with reference to FIGS. 13, 14, 15, and 16.

Figure 13:
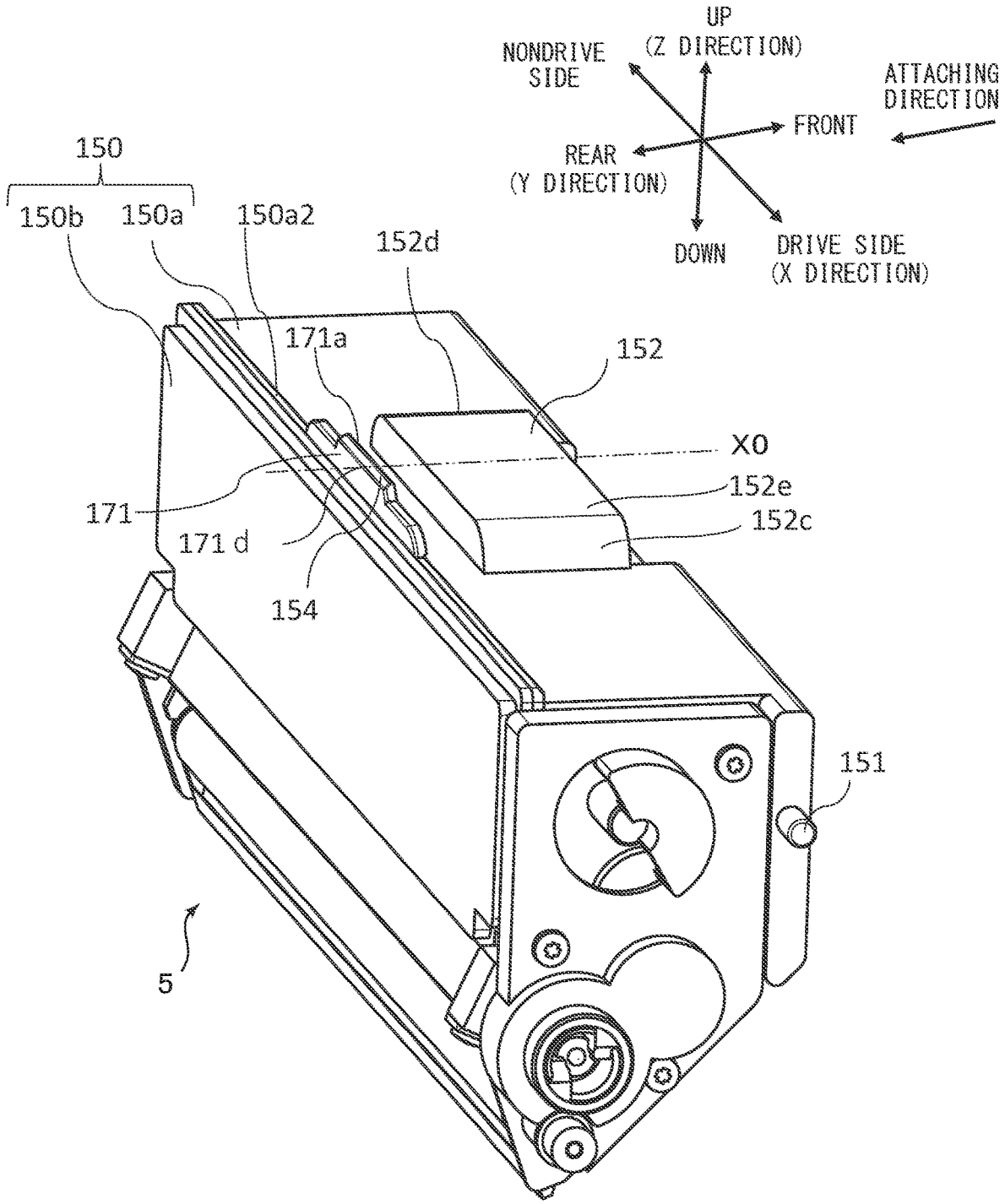
FIG. 13 is a perspective view of a developing cartridge according to a first modification example of the second embodiment.
Figure 14A:
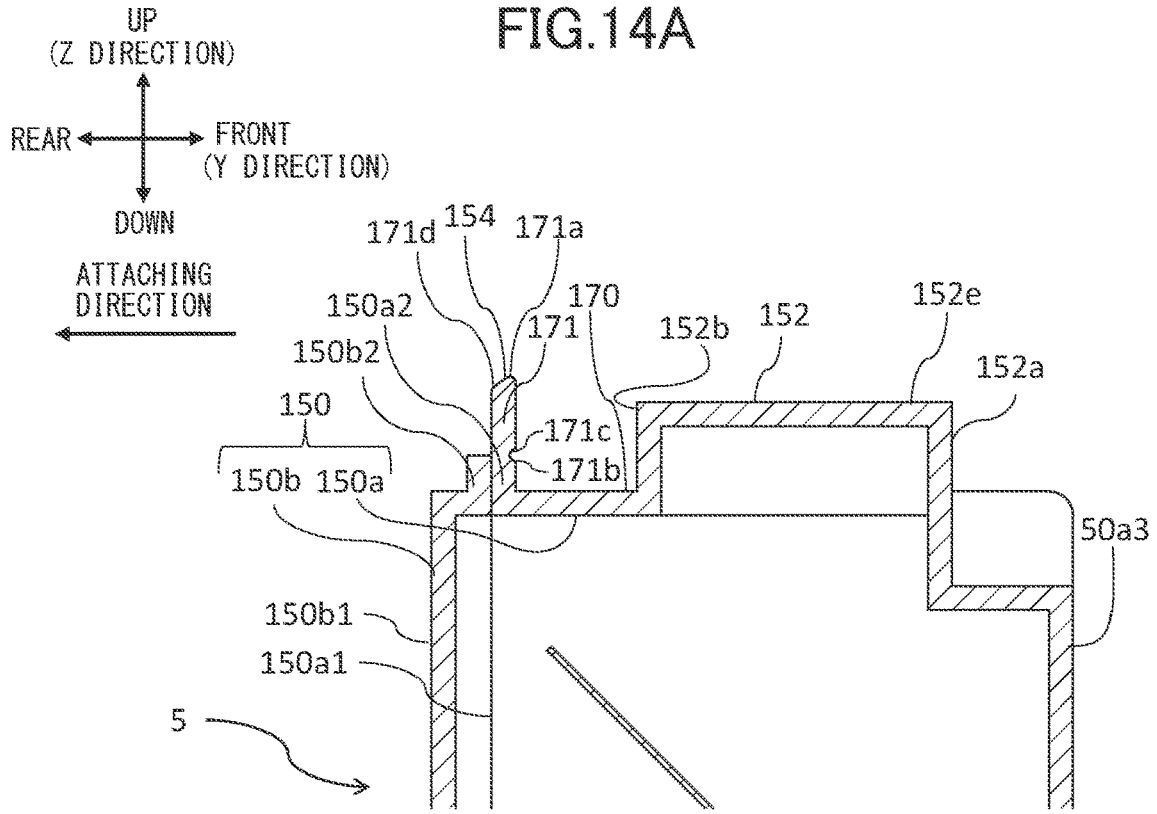
FIGS. 14A and 14B are each an enlarged section view of the vicinity of a rib of the developing cartridge according to the first modification example of the second embodiment.
Figure 14B:
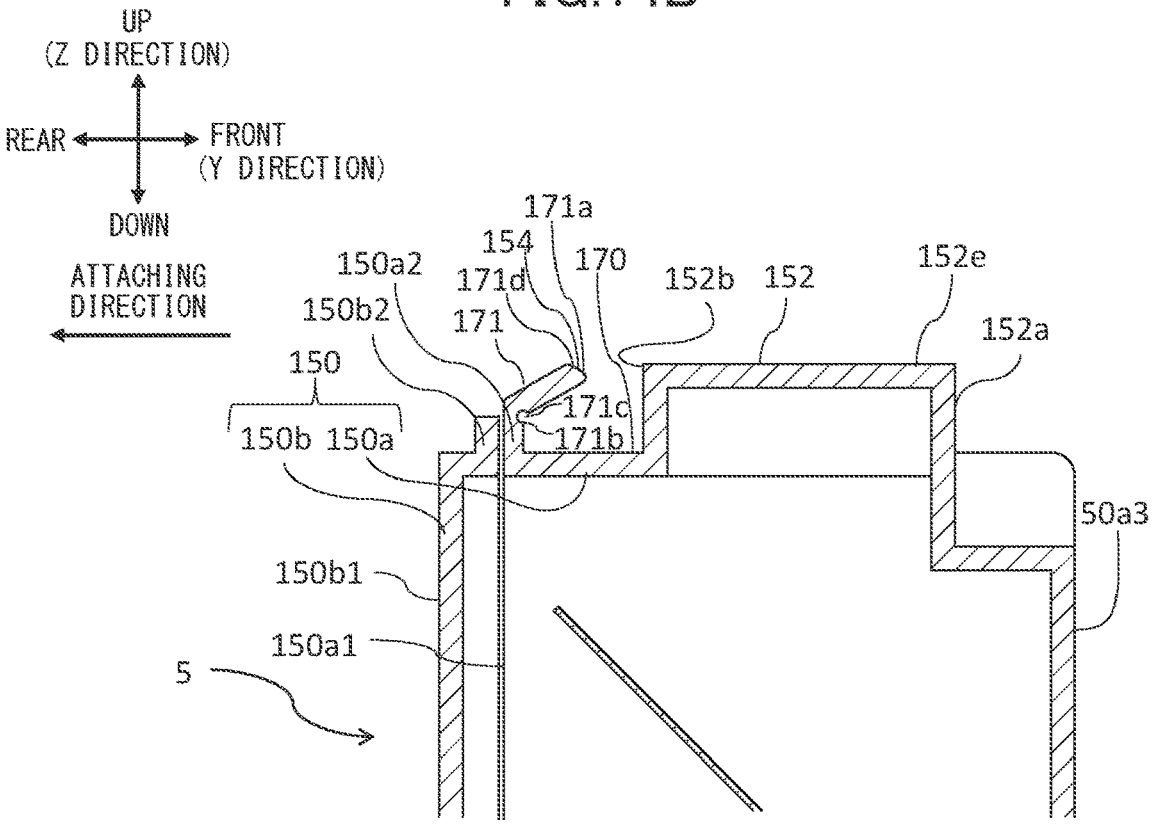
Figure 15:
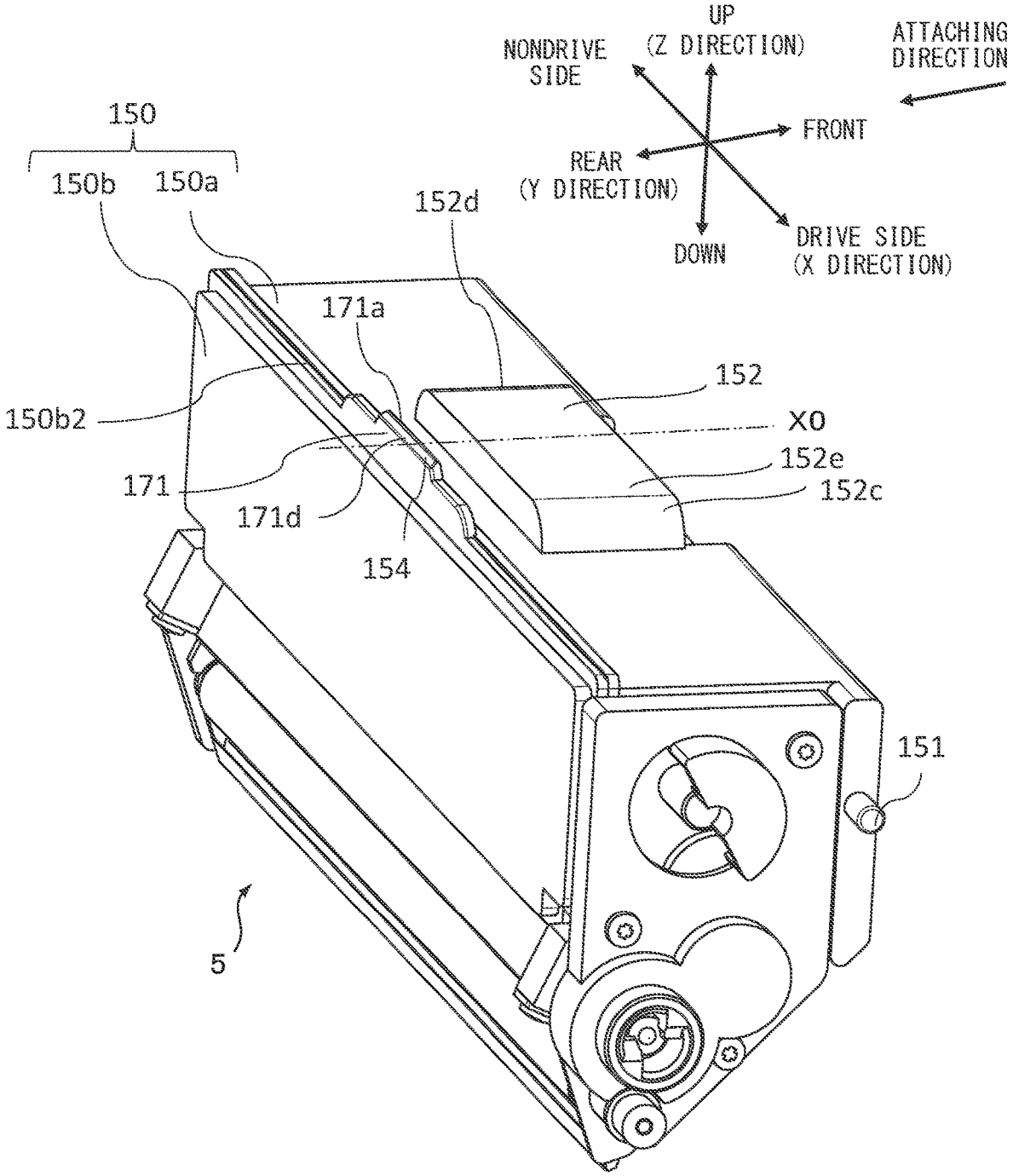
FIG. 15 is a perspective view of a developing cartridge according to a second modification example of the second embodiment.
Figure 16A:
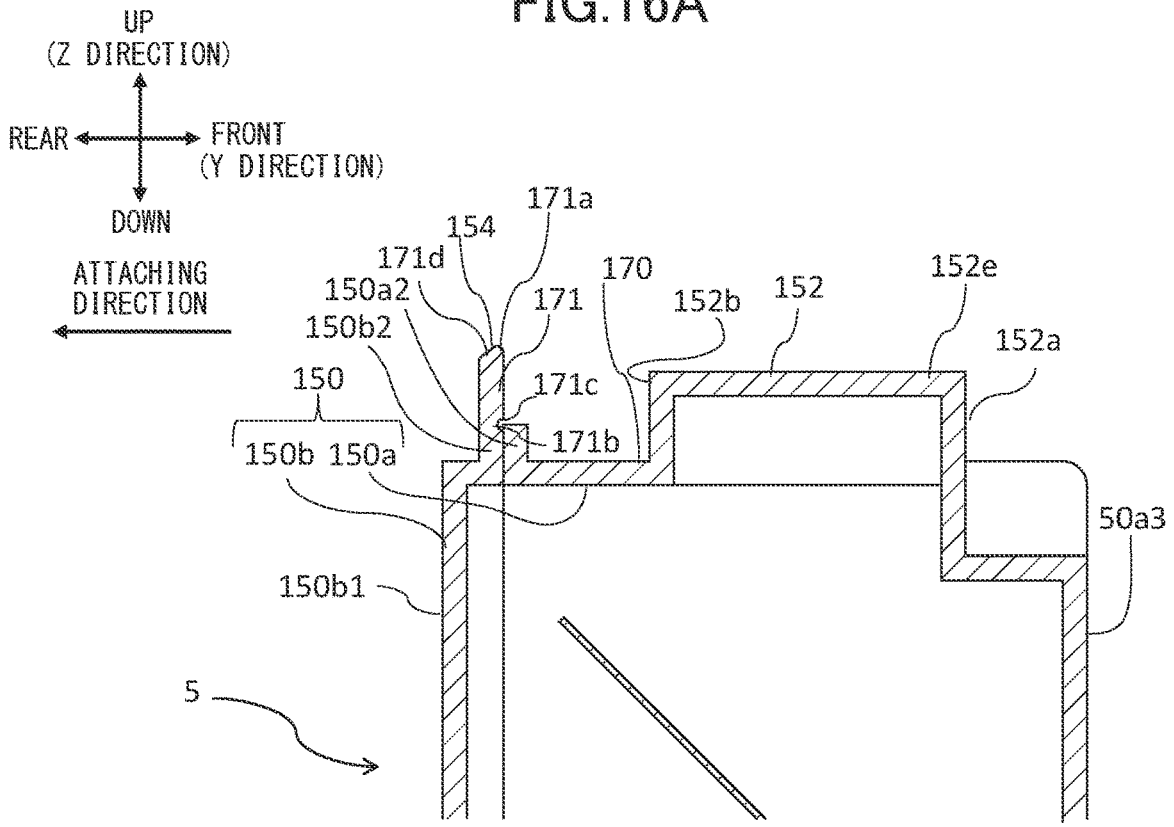
FIGS. 16A and 16B are each an enlarged section view of the vicinity of a rib of the developing cartridge according to the second modification example of the second embodiment.
Figure 16B:
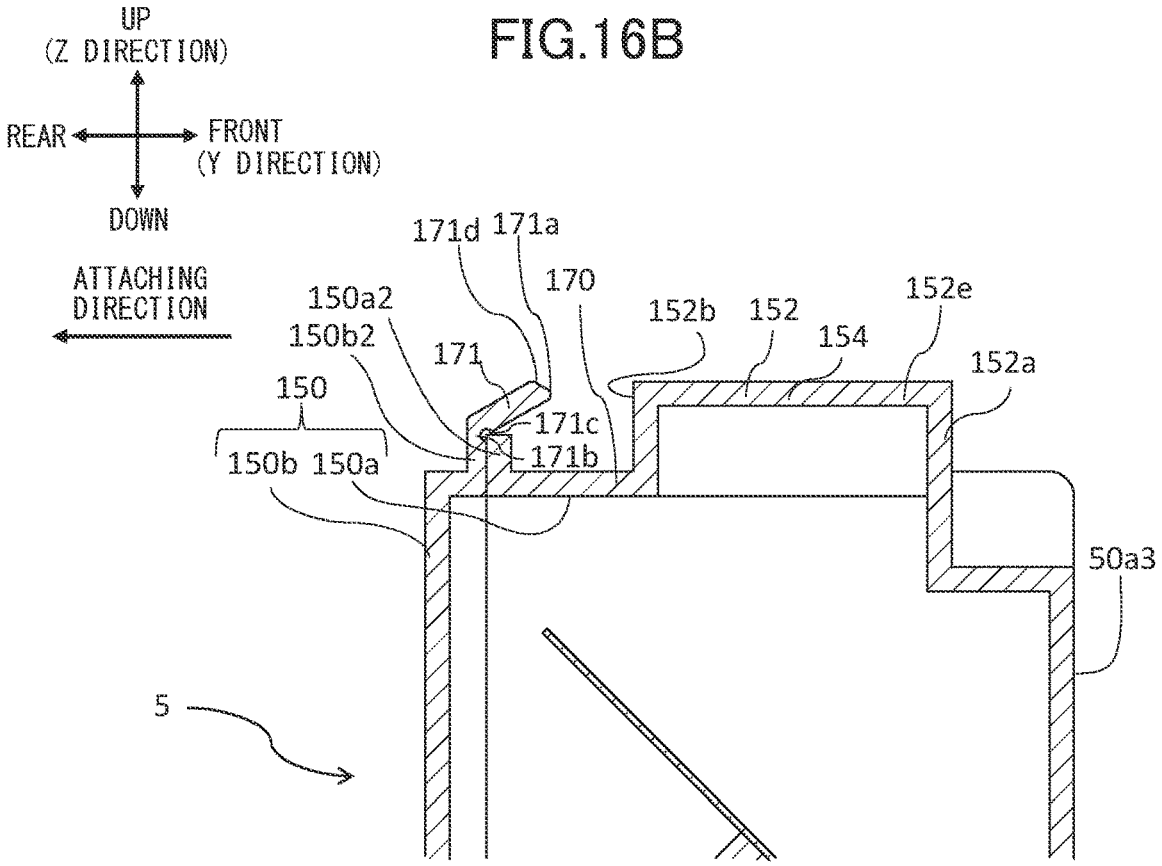

FIG. 13 is a perspective view of the developing cartridge 5 according to a first modification example of the present embodiment. FIGS. 14A and 14B are each a section view of the vicinity of the rib 171 according to the first modification example of the present embodiment. In addition, FIG. 15 is a perspective view of the developing cartridge 5 according to a second modification example of the present embodiment. FIGS. 16A and 16B are each a section view of the vicinity of the rib 171 according to the second modification example of the present embodiment. FIGS. 14A, 14B, 16A, and 16B illustrate a cross-section of part of the developing cartridge 5 taken along a virtual plane perpendicular to the X direction. FIGS. 14A and 16A each illustrate a state before the rib 171 is deformed, and FIGS. 14B and 16B each illustrate a state after the rib 171 is elastically deformed.

First and Second Modification Examples

As illustrated in FIGS. 13, 14A, and 14B, the rib 171 according to the first modification example is formed by extending part of an upper portion of a flange 150*a*2 of the first frame member 150*a* in a partial region in the X direction upward in the Z direction. The flange 150*a*2 is a part that surrounds an opening 150*a*1 of the first frame member 150*a* as viewed in the Y direction, and comes into firm contact with a flange 150*b*2 of the second frame member 150*b* when connecting the first frame member 150*a* and the second frame member 150*b* together.

As illustrated in FIGS. 15, 16A, and 16B, the rib 171 according to the second modification example is formed by extending part of an upper portion of the flange 150*b*2 of the second frame member 150*b* in a partial region in the X direction upward in the Z direction. As described above, the rib 171 may be provided as part of the second frame member 150*b*.

The rib 171 has a plate shape including a rib distal end 171*a* extending higher upward than the upper surface of the projection portion 152, that is, the fifth portion 152*e* in the Z direction. Further, the rib distal end 171*a* includes a rib inclined surface 171*d* whose downstream side in the attaching direction, that is, the rear side in the Y direction is lower in the Z direction.

The rib 171 of the first and second modification example is a member that can be elastically deformed with respect to the developing frame member 150 by bending toward the upstream side in the attaching direction, that is, toward the front side in the Y direction, when an external force is applied thereto. Particularly, the rib 171 can elastically deform to a height equal to or lower than the upper surface of the projection portion 152, that is, the fifth portion 152*e* in the Z direction. The cutout portion 171*c* such as a groove portion or a notch in which a recess shape recessed downstream in the Y direction extends in the X direction is preferably provided upstream of the root portion 171*b* of the rib 171 in the attaching direction, that is, on the front side in the Y direction. The cutout portion 171*c* is preferably provided below the center position between the upper end of the flanges 150*a*2 and 150*b*2 and the upper end of the rib 171 in the Z direction. By providing the cutout portion 171*c*, the rib 171 is more likely to elastically deform when an external force is applied thereto. In the present embodiment, whereas the thickness of the wall of the developing frame member 150 is from 1.2 mm to 2.0 mm, the thickness of the rib 171 is set to 0.8 mm to 1.2 mm, and the depth of the cutout of the cutout portion 171*c* is set to 0.2 mm to 1.2 mm. For example, by setting the thickness of the wall of the developing frame member 150 as 100%, the thickness of the rib 171 is preferably set to 40% to 100%, and the depth of the cutout of the cutout portion 171*c* is preferably set to 10% to 60%.

Third to Fifth Modification Examples

Figure 17:
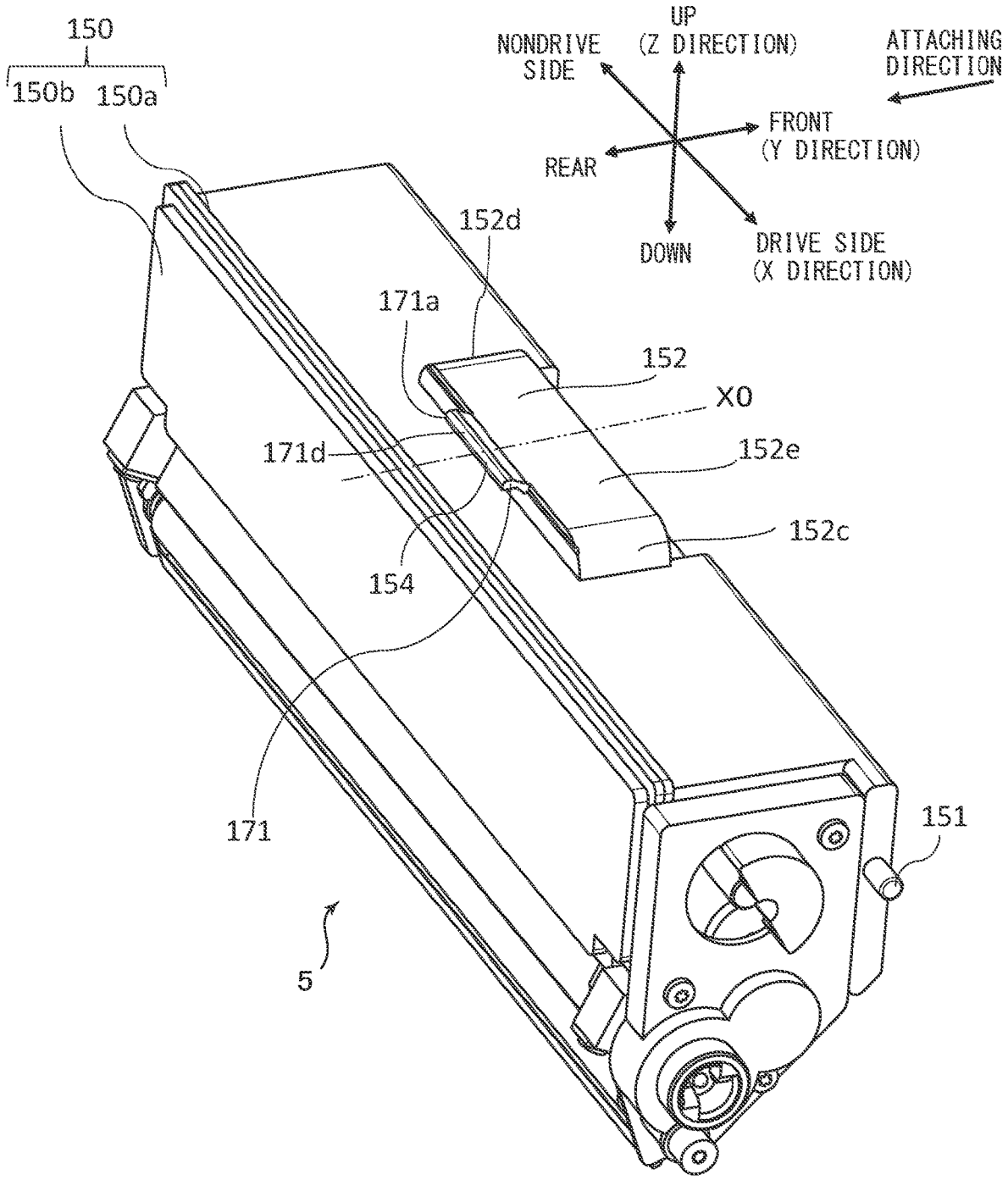
FIG. 17 is a perspective view of a developing cartridge according to a third modification example of the second embodiment.
Figure 18A:
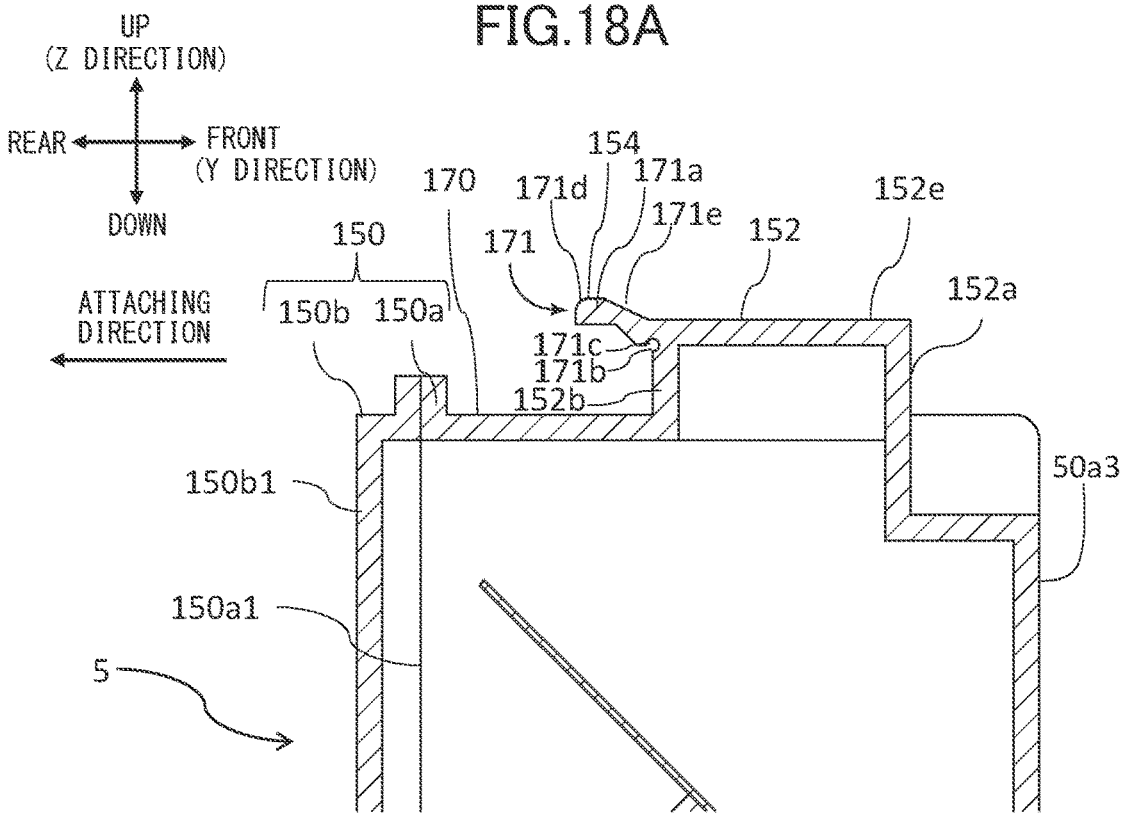
FIGS. 18A and 18B are each an enlarged section view of the vicinity of a rib of the developing cartridge according to the third modification example of the second embodiment.
Figure 18B:
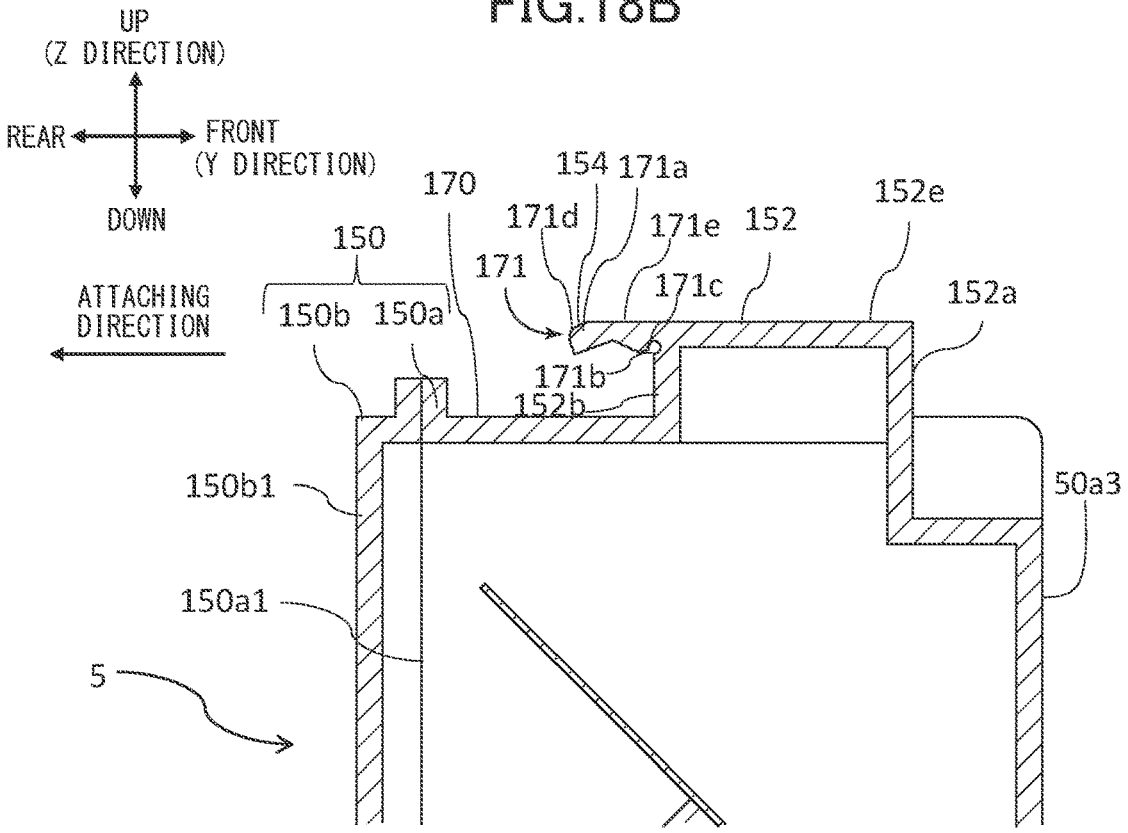
Figure 19:
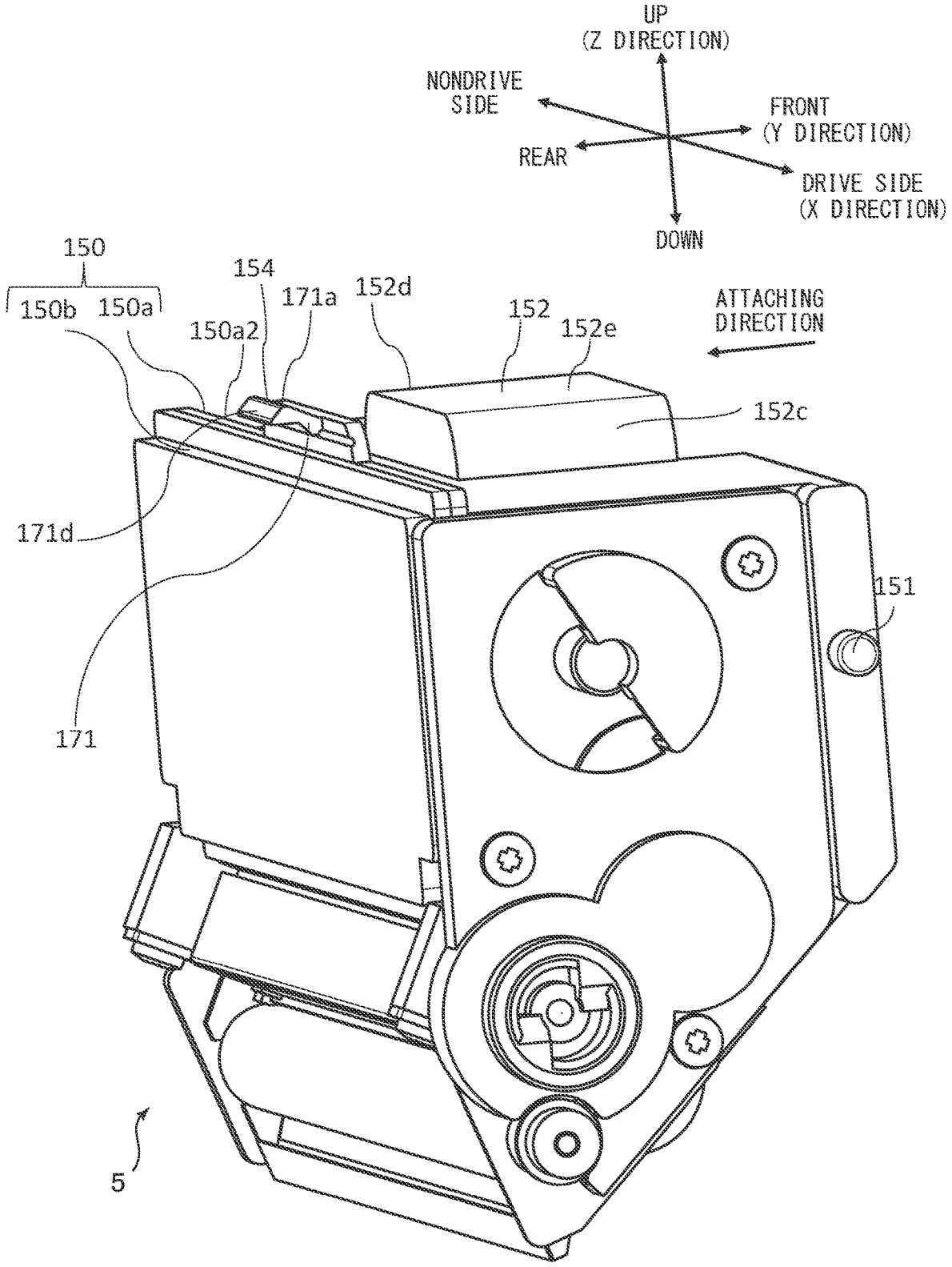
FIG. 19 is a perspective view of a developing cartridge according to a fourth modification example of the second embodiment.
Figure 20A:
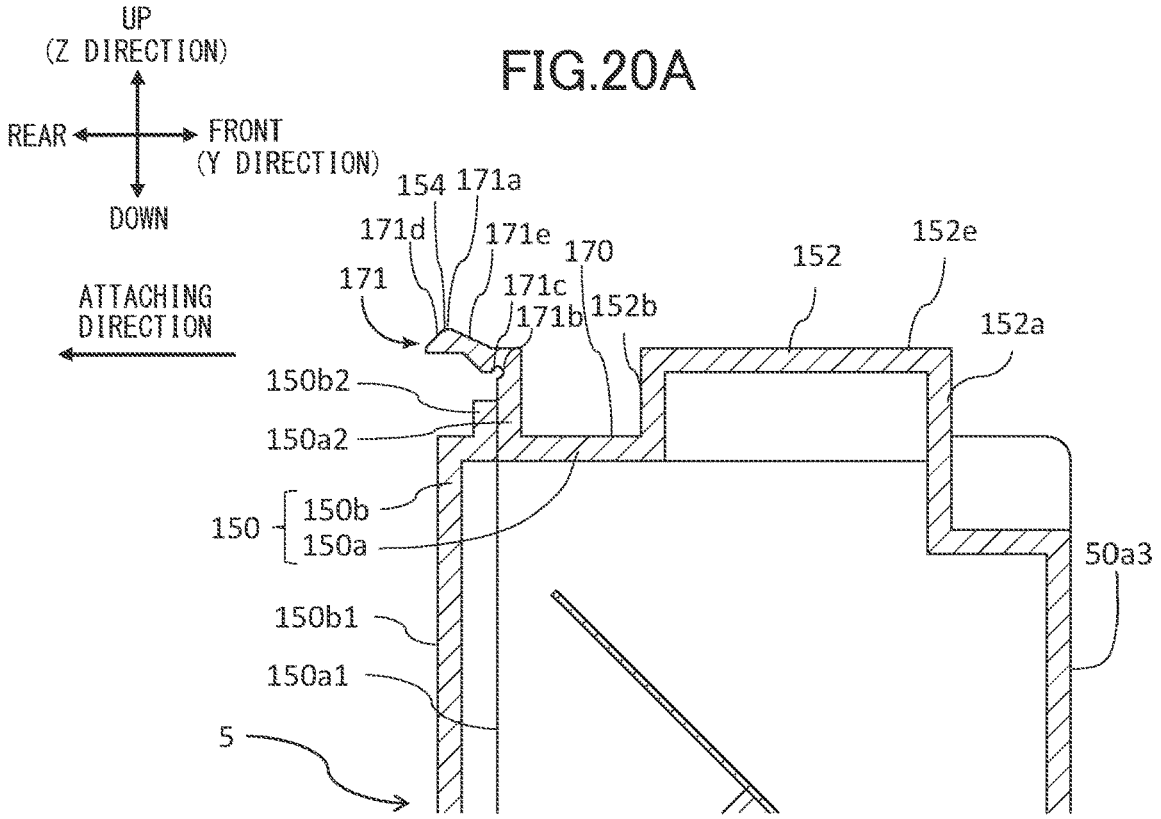
FIGS. 20A and 20B are each an enlarged section view of the vicinity of a rib of the developing cartridge according to the fourth modification example of the second embodiment.
Figure 20B:
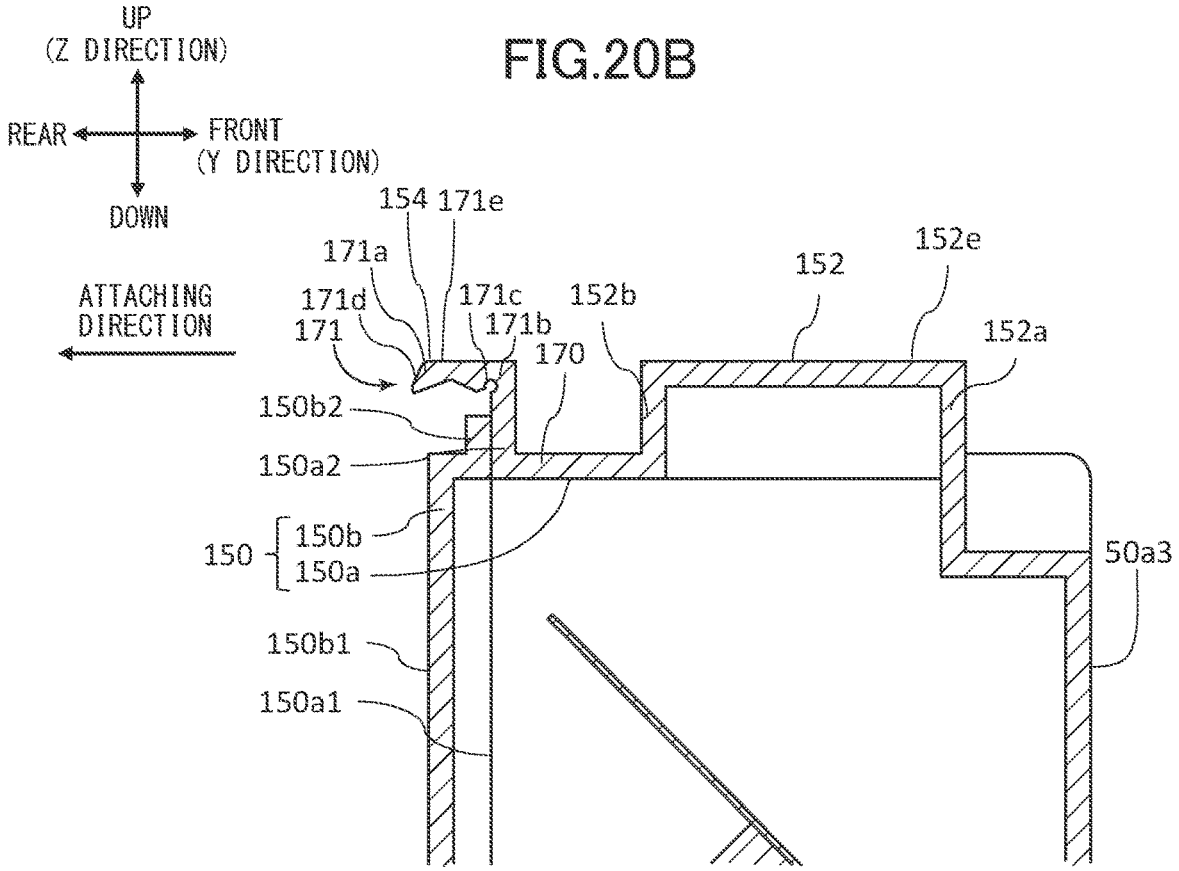
Figure 21:
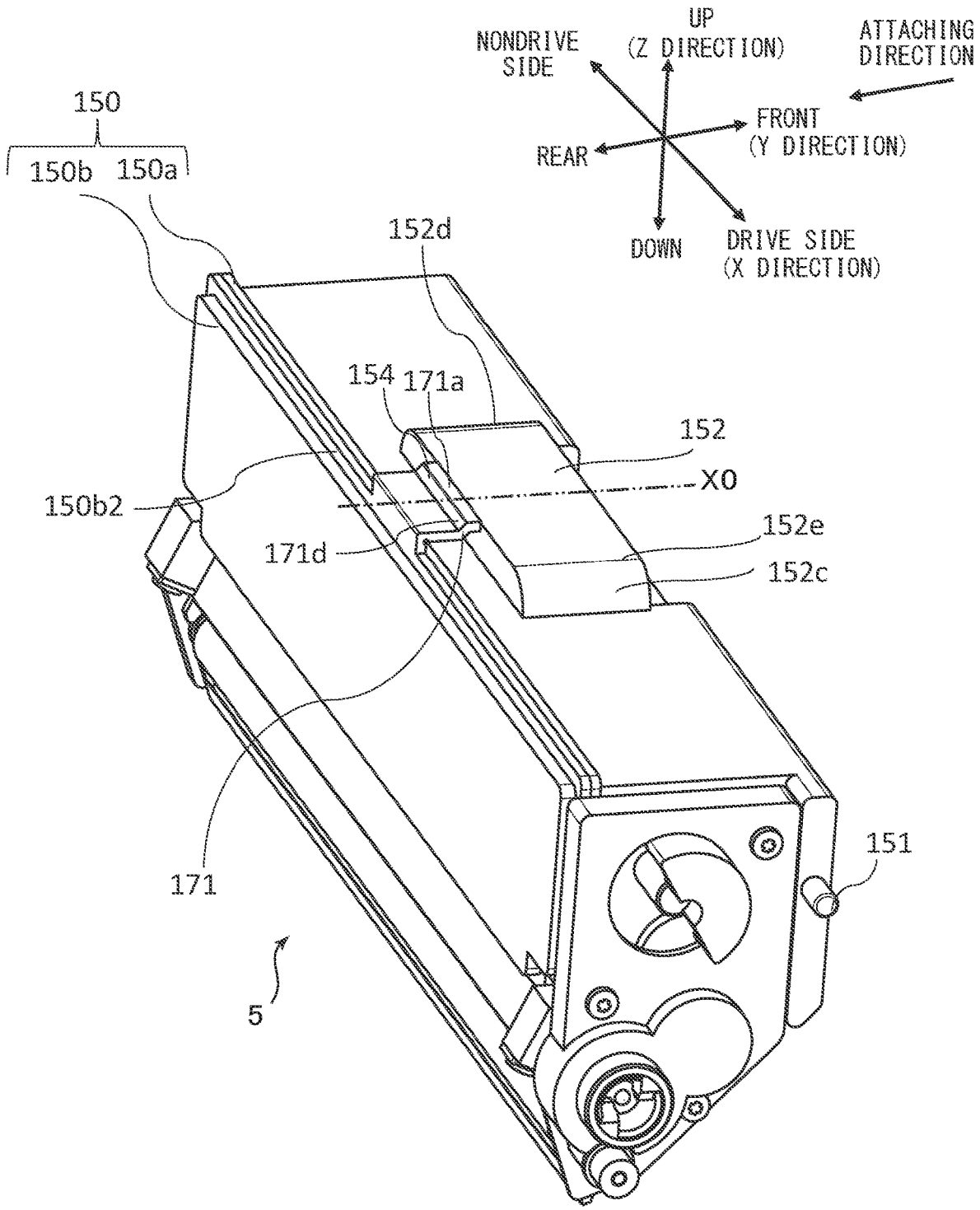
FIG. 21 is a perspective view of a developing cartridge according to a fifth modification example of the second embodiment.
Figure 22A:
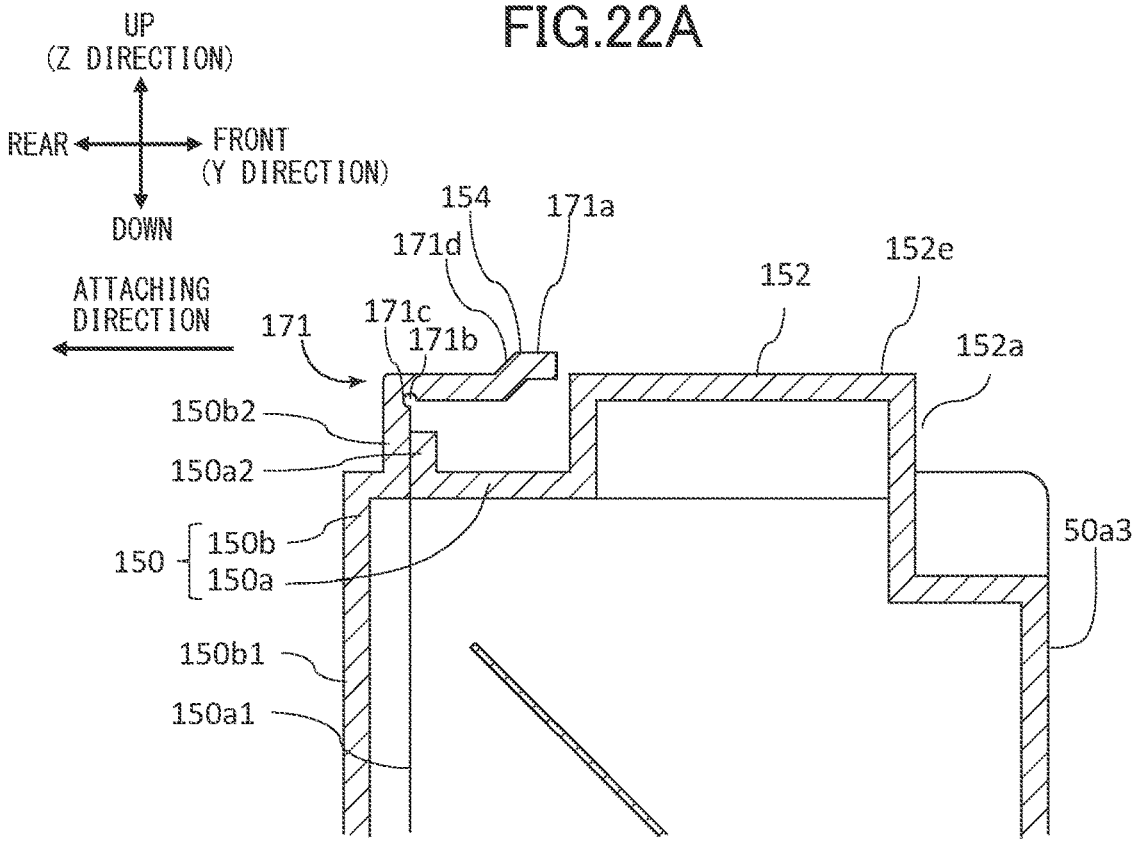
FIGS. 22A and 22B are each an enlarged section view of the vicinity of a rib of the developing cartridge according to the fifth modification example of the second embodiment.
Figure 22B:
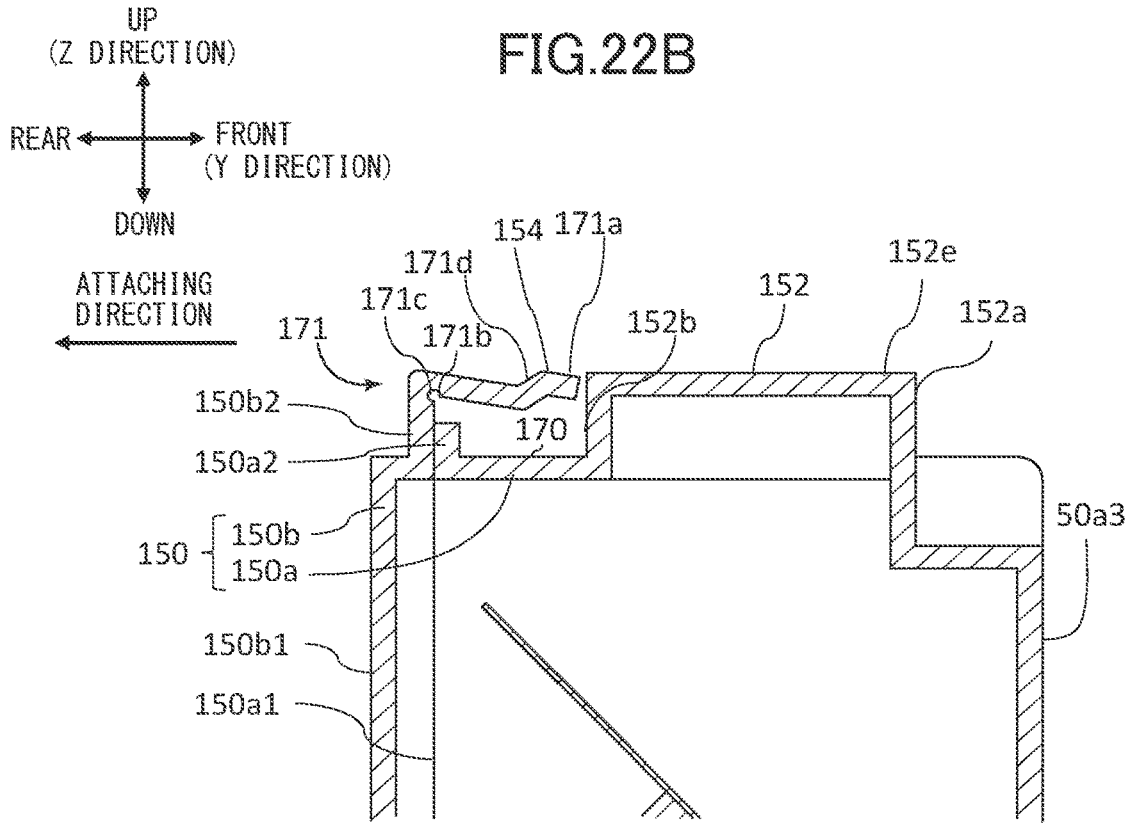

Further modification examples of the rib 171 will be described with reference to FIGS. 17 to 22B. FIG. 17 is a perspective view of the developing cartridge 5 according to a third modification example of the present embodiment. FIGS. 18A and 18B are each a section view of the vicinity of the rib 171 according to the third modification example of the present embodiment. In addition, FIG. 19 is a perspective view of the developing cartridge 5 according to a fourth modification example of the present embodiment. FIGS. 20A and 20B are each an enlarged section view of the vicinity of the rib 171 according to the fourth modification example of the present embodiment. FIG. 21 is a perspective view of the developing cartridge 5 according to a fifth modification example of the present embodiment. FIGS. 22A and 22B are each an enlarged section view of the vicinity of the rib 171 according to the fifth modification example of the present embodiment. FIGS. 18A, 18B, 20A, 20B, 22A, and 22B illustrate a cross-section of part of the developing cartridge 5 taken along a virtual plane perpendicular to the X direction. FIGS. 18A, 20A, and 2A each illustrate a state before the rib 171 is deformed, and FIGS. 18B, 20B, and 22B each illustrate a state after the rib 171 is elastically deformed.

The rib 171 according to the third modification example is disposed on the second portion 152*b* that is the rear side surface of the projection portion 152 of the developing frame member 150 in the Y direction as illustrated in FIGS. 17, 18A, and 18B. The rib 171 is provided in a portion or region including the center position X0 in the X direction. In addition, the rib 171 extends from the upper end of the second portion 152*b*, that is, the downstream end of the fifth portion 152*e* in the attaching direction, toward the downstream side in the attaching direction, that is, the rear side in the Y direction, and spread in the X direction. The rib distal end 171*a* is positioned higher than the upper surface of the projection portion 152, that is, the fifth portion 152*e*, in the Z direction. That is, at least part of the rib 171 is formed as an inclined surface 171*e* that is inclined such that the downstream side thereof in the attaching direction, that is, the rear side thereof in the Y direction is higher in the Z direction.

The rib distal end 171*a* includes a rib inclined surface 171*d* extending downward in the Z direction toward the downstream side in the attaching direction, that is, the rear side in the Y direction. In addition, the rib 171 is formed in a thin plate shape whose thickness in the Z direction is smaller than the length thereof in the Y direction. Further, the cutout portion 171*c* such as a groove portion or a notch in which a recess shape recessed downstream in the Y direction extends in the X direction is provided under the root portion 171*b* of the rib 171 that is a connection portion to the second portion 152*b* on the rear side in the Y direction of the projection portion 152 in the Z direction.

The rib 171 according to the fourth modification example extends upward in the Z direction from the flange 150*a*2 of the first frame member 150*a* as illustrated in FIGS. 19, 20A, and 20B. As viewed in the X direction, the rib 171 extends upward from the upper end of the flange 150*a*2 and then bends to extend downstream in the attaching direction, that is, toward the rear side in the Y direction, and spreads in the X direction. The other elements are substantially the same as in the third modification example. That is, the rib 171 is provided in a portion or region including the center position X0 in the X direction. The rib distal end 171*a* is positioned higher than the upper surface of the projection portion 152, that is, the fifth portion 152*e*, in the Z direction. That is, at least part of the rib 171 is formed as an inclined surface 171*e* that is inclined such that the downstream side thereof in the attaching direction, that is, the rear side thereof in the Y direction is higher in the Z direction.

The rib distal end 171*a* includes a rib inclined surface 171*d* extending downward in the Z direction toward the downstream side in the attaching direction, that is, the rear side in the Y direction. In addition, the rib 171 is formed in a thin plate shape whose thickness in the Z direction is smaller than the length thereof in the Y direction. Further, the cutout portion 171*c* is provided on the inner side of a bending portion between the part extending upward from the upper end of the flange 150*a*2 and the part extending downstream in the attaching direction, that is, toward the rear side in the Y direction. The cutout portion 171*c* is a shape such as a groove portion or a notch in which a recess shape recessed downstream in the Y direction and upward in the Z direction, that is, toward the outer side of the bending, extends in the X direction.

The rib 171 according to the fifth modification example extends upward in the Z direction from the flange 150*b*2 of the second frame member 150*b* as illustrated in FIGS. 21, 22A, and 22B. As viewed in the X direction, the rib 171 extends upward from the upper end of the flange 150*b*2 and then bends to extend upstream in the attaching direction, that is, toward the front side in the Y direction, and spreads in the X direction. The rib 171 is provided in a portion or region including the center position X0 in the X direction. The rib distal end 171*a* is positioned higher than the upper surface of the projection portion 152, that is, the fifth portion 152*e*, in the Z direction. At least part of the rib 171 may be formed as an inclined surface that is inclined such that the upstream side thereof in the attaching direction, that is, the front side thereof in the Y direction is higher in the Z direction.

The rib distal end 171*a* includes a rib inclined surface 171*d* extending downward in the Z direction toward the downstream side in the attaching direction, that is, the rear side in the Y direction. In addition, the rib 171 is formed in a thin plate shape whose thickness in the Z direction is smaller than the length thereof in the Y direction. Further, the cutout portion 171*c* is provided on the inner side of a bending portion between the part extending upward from the upper end of the flange 150*b*2 and the part extending upstream in the attaching direction, that is, toward the front side in the Y direction. The cutout portion 171*c* is a shape such as a groove portion or a notch in which a recess shape recessed toward the rear side in the Y direction and upper side in the Z direction, that is, toward the outer side of the bending, extends in the X direction.

The shape and position of the rib 171 is not limited to those described in the second embodiment and the first to fifth modification examples described above. Any configuration may be employed for the rib 171 as long as the rib distal end 171*a* is positioned higher than the upper surface of the projection portion 152, that is, the fifth portion 152*e* in the Z direction, and the rib distal end 171*a* can elastically deform to pass through the space under the abutting portion 18 of the apparatus body 2 by receiving an external force. For example, the rib 171 can preferably elastically deform such that the rib distal end 171*a* is at a height equal to or lower than the upper surface of the projection portion 152, that is, the fifth portion 152*e*.

The rib 171 functions as an abutted portion 154 of the developing cartridge 5 abutted by the abutting portion 18 of the apparatus body 2 illustrated in FIGS. 2A and 2B in accordance with the movement of the cartridge tray 3 in the attaching direction.

In addition, the rib 171 also functions as a handle for gripping the developing cartridge 5. For example, the developing cartridge 5 may be gripped by gripping the first portion 152*a* of the projection portion 152 and the rib 171. Alternatively, the developing cartridge 5 may be gripped by gripping the rib 171 and the surface 150*b*1 on the rear side of the second frame member 150*b*. As described above, the rib 171 projects upward from the upper surface 170 of the developing frame member 150, and thus has a shape that is easy to grip when gripping the developing cartridge 5. Therefore, the operator may grip the developing cartridge 5 in any other way the operator is comfortable with in addition to the examples described above. To be noted, a handle separate from the rib 171 may be additionally provided on the developing frame member 150.

Figure 23A:
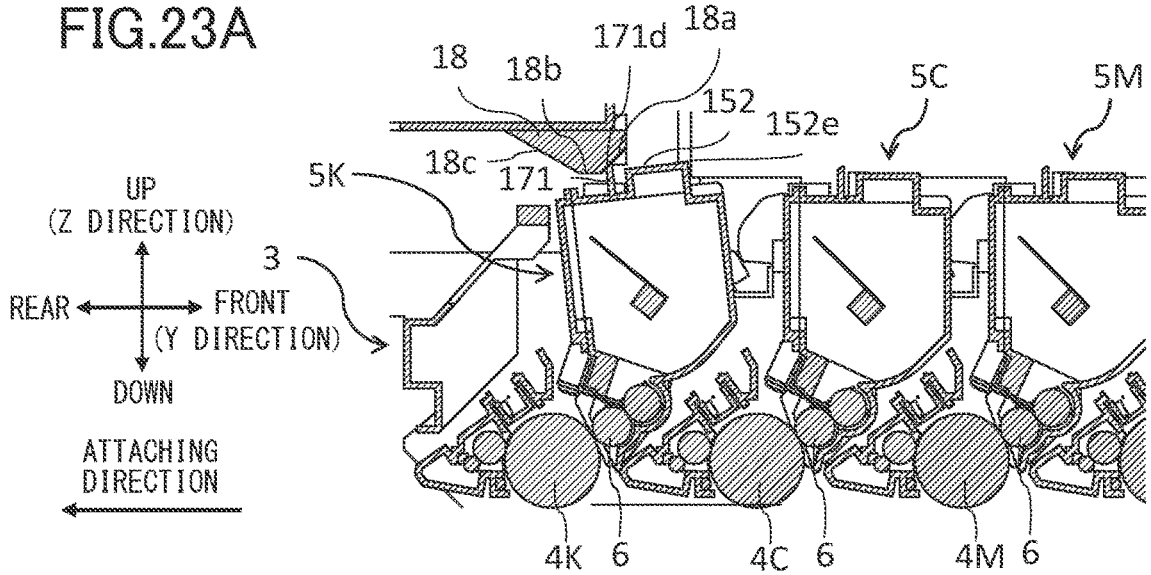
FIGS. 23A to 23C are each a diagram for describing the posture change of the developing cartridge in accordance with the movement of a cartridge tray according to the second embodiment.
Figure 23B:
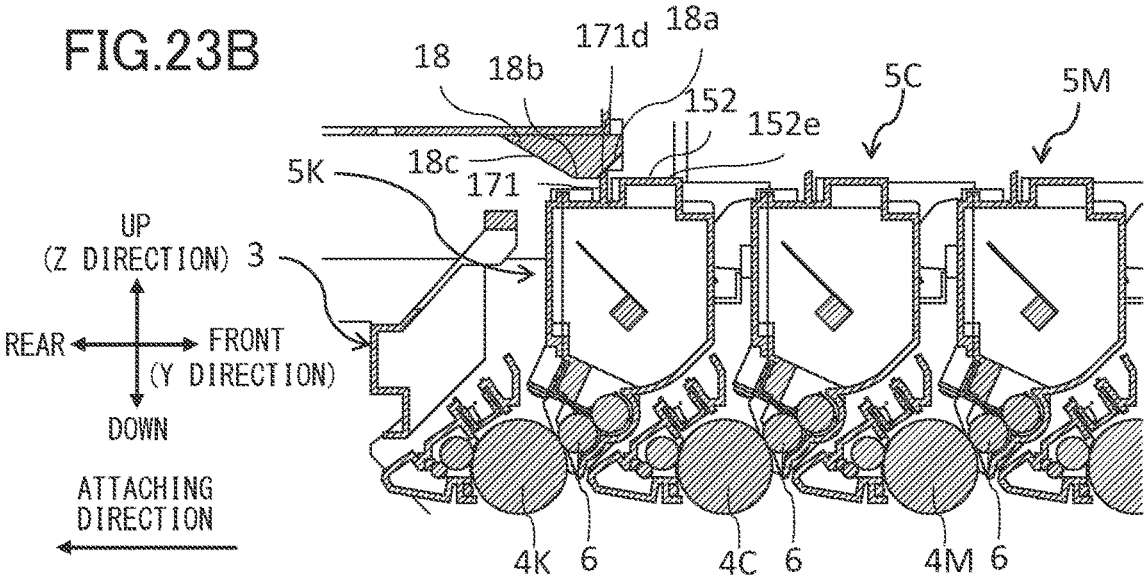
Figure 23C:
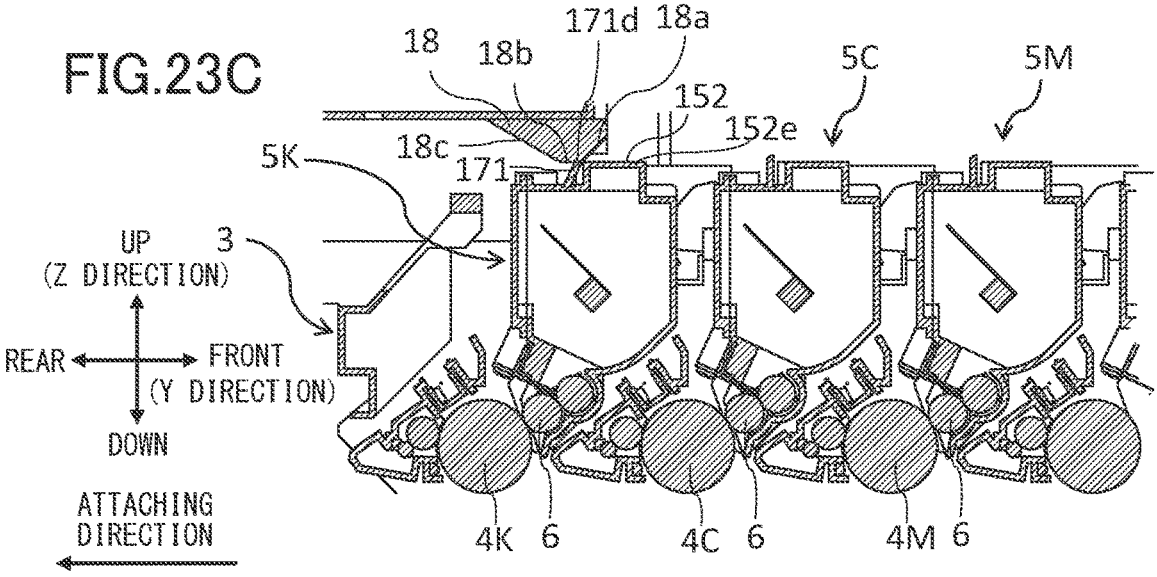
Figure 24A:
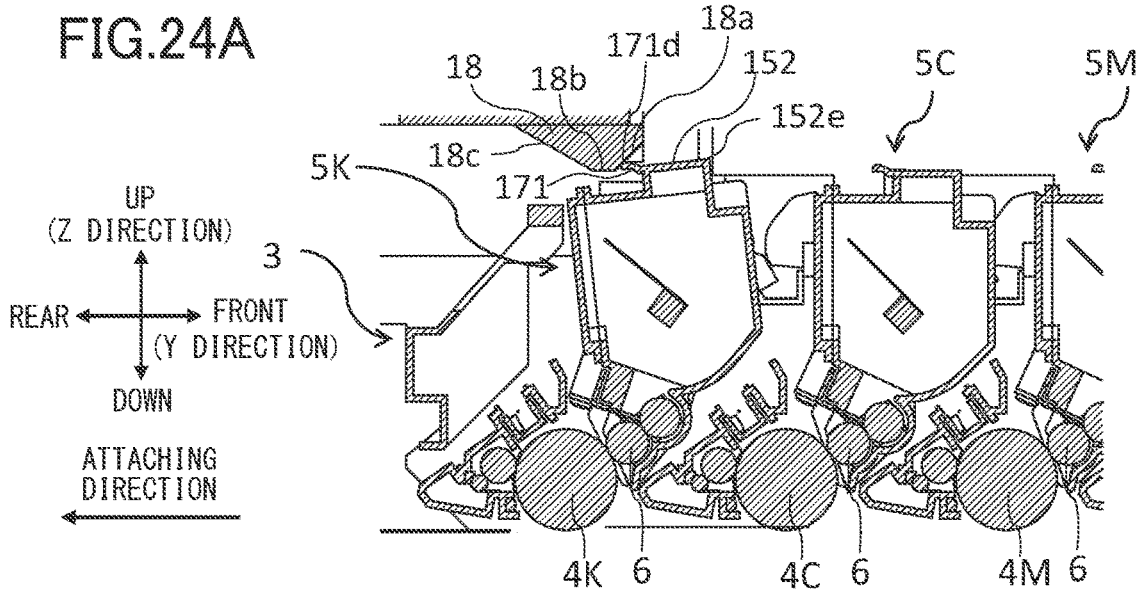
FIGS. 24A to 24C are each a diagram for describing the posture change of the developing cartridge in accordance with the movement of the cartridge tray according to the third modification example of the second embodiment.
Figure 24B:
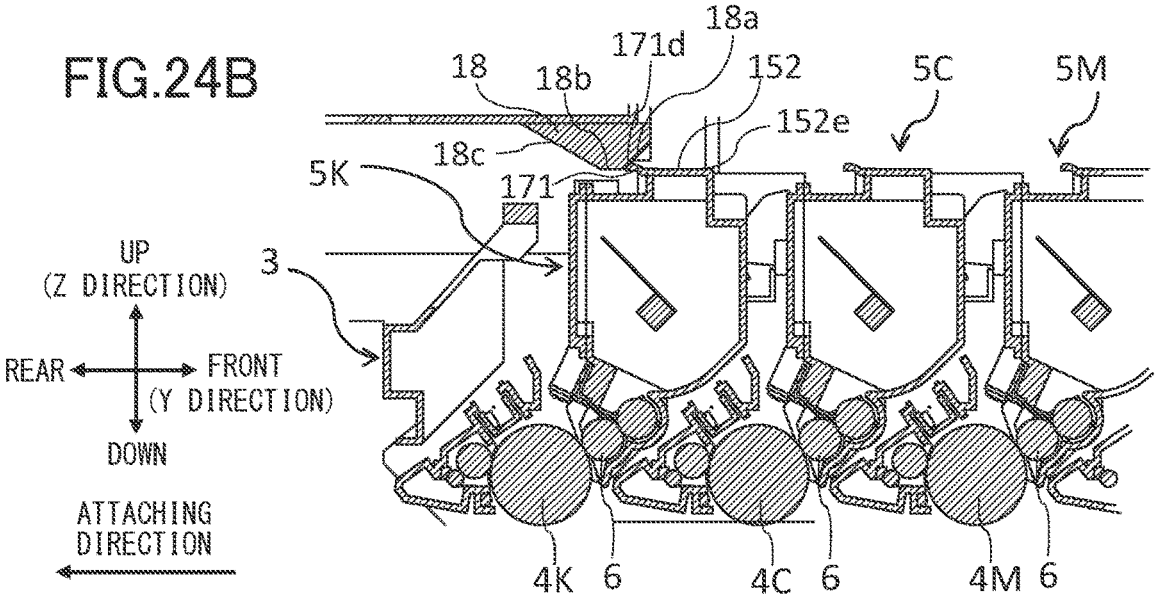
Figure 24C:
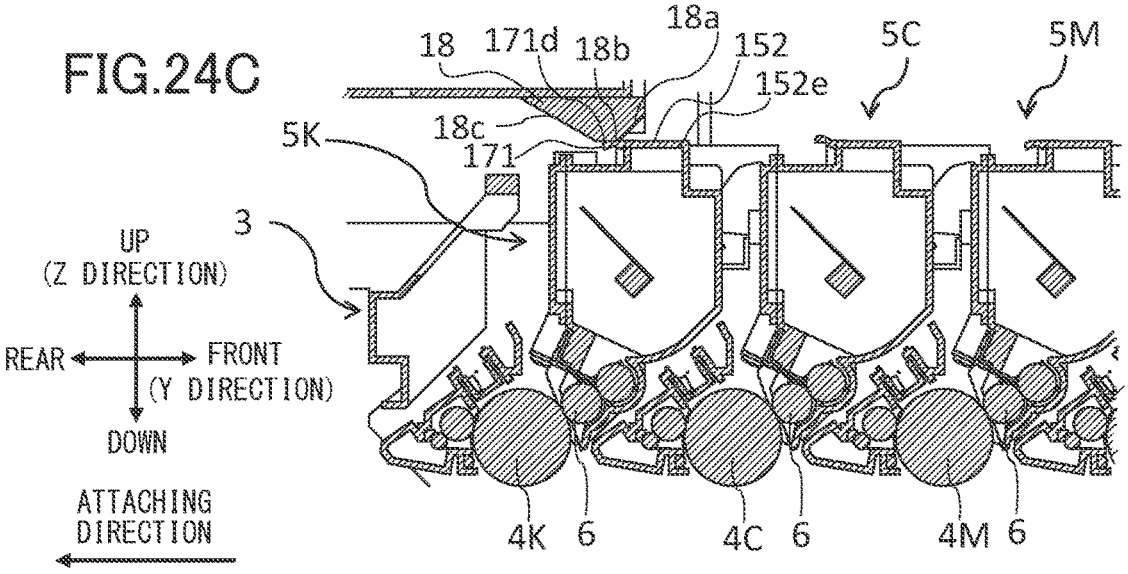

Posture Change of Developing Cartridges in Accordance with Movement of Cartridge Tray How the developing cartridges 5Y to 5K change from the detaching posture to the image forming posture in accordance with the movement of the cartridge tray 3 in the second embodiment and modification examples thereof will be described with reference to FIGS. 23A to 24C. In FIGS. 23A to 24C, the developing cartridge 5 of one of the second embodiment and the modification examples thereof is used as each of the developing cartridges 5Y to 5K accommodating developer of respective colors. To be noted, the behavior of the rib 171 is substantially the same in the second embodiment illustrated in FIGS. 10 to 12, the first modification example illustrated in FIGS. 13 to 14B, and the second modification example illustrated in FIGS. 15 to 16B. Therefore, the configuration of the second embodiment is illustrated in FIGS. 23A to 23C as a representative. In addition, the behavior of the rib 171 is also mostly the same in the third modification example illustrated in FIGS. 17 to 18B, the fourth modification example illustrated in FIGS. 19 to 20B, and the fifth modification example illustrated in FIGS. 21 to 22B. Therefore, the configuration of the third modification example is illustrated in FIGS. 24A to 24C as a representative.

FIGS. 23A to 24C are each a section view of the image forming apparatus 1 illustrating a cross-section taken along a virtual plane perpendicular to the X direction as viewed in the X direction, and illustrates how the cartridge tray 3 is moved in the attaching direction from the first position toward the second position. FIGS. 23A to 24C illustrate a case where attachment of the cartridge tray 3 is performed in a state in which the black developing cartridge 5K is in the detaching posture and the developing cartridges 5Y, 5M, and 5C of the other colors are in the image forming posture.

The operator grips the front handle 31*a* illustrated in FIG. 7 and moves the cartridge tray 3 in the attaching direction from the first position toward the second position. Then, the rib inclined surface 171*d* of the rib 171 of the black developing cartridge 5K abuts the first abutting portion 18*a* of the abutting portion 18 of the apparatus body 2 as illustrated in FIGS. 23A and 24A. Then, the rib inclined surface 171*d* receives the reaction force from the first abutting portion 18*a*, and thus the rib 171 is pressed downward in the Z direction toward the front side in the Y direction, that is, toward the upstream side in the attaching direction. As a result of this reaction force, the developing cartridge 5K pivots to the front side in the Y direction, that is, upstream in the attaching direction, about the rotation axis of the developing roller 6, that is, the axis of the guide members 53, and moves from the detaching posture to the image forming posture, that is, the posture changes.

Here, in the present embodiment, a configuration in which the abutting portion 18 abuts the rib inclined surface 171*d* inclined so as to extend downward in the Z direction toward the rear side in the Y direction, that is, downstream in the attaching direction is employed. Therefore, the direction of the reaction force that the rib inclined surface 171*d* receives from the abutting portion 18 is close to the movement direction of the rib 171 at the time when the developing cartridge 5K moves from the detaching posture to the image forming posture. Therefore, the developing cartridge 5K easily moves from the detaching posture to the image forming posture by the reaction force received on the rib inclined surface 171*d* from the abutting portion 18. Further, also when the movement of the developing cartridge 5K to the image forming posture is complete, the rib inclined surface 171*d* is still abutting the abutting portion 18 as illustrated in FIGS. 23B and 24B.

When the cartridge tray 3 is further moved toward the second position, the rib 171 is elastically deformed downward in the Z direction by the reaction force received on the rib inclined surface 171*d* from the first abutting portion 18*a* as illustrated in FIGS. 23C and 24C. At this time, in the second embodiment illustrated in FIG. 23C, the rib 171 is elastically deformed by bending at the cutout portion 171*c* such that the rib distal end 171*a* moves upstream in the attaching direction, that is, toward the front side in the Y direction. Such elastic deformation also occurs in the first modification example and the second modification example. In contrast, in the third modification example illustrated in FIG. 24C, the rib 171 elastically deforms by bending at the cutout portion 171*c* such that the rib distal end 171*a* moves downward in the Z direction. Such elastic deformation also occurs in the fourth modification example and the fifth modification example.

Then the rib 171 elastically deformed as illustrated in FIGS. 23C and 24C go beneath the abutting portion 18, and passes through the space under the abutting portion 18 while the rib distal end 171*a* is sliding on the horizontal portion 18*b*. At this time, the height of the projection portion 152 in the Z direction is set such that the fifth portion 152*e* that is an upper surface of the projection portion 152 in the Z direction passes through the space under the abutting portion 18.

When the cartridge tray 3 is further moved toward the second position, the rib distal ends 171*a* of the developing cartridges 5C, 5M, and 5Y of the other colors in the image forming posture also sequentially abut the abutting portion 18, and similarly pass through the space under the abutting portion 18 while elastically deforming. To be noted, a portion at which the rib 171 abuts the abutting portion 18 first and a portion at which the rib 171 slides on the horizontal portion 18*b* when going beneath the abutting portion 18 can vary depending on the shape of the rib and how the rib warps. Therefore, these portions are not limited to the rib distal end 171*a*, and may be the rib inclined surface 171*d* and the inclined surface 171*e* illustrated in FIGS. 18A and 18B.

Then, by closing a front door 117 after completely inserting the cartridge tray 3 such that the cartridge tray 3 reaches the second position, attachment of the cartridge tray 3 and the developing cartridges 5Y to 5K to the apparatus body 2 is completed.

As a result of the rib inclined surface 171*d* of the rib 171 of each of the developing cartridges 5Y to 5K abutting the abutting portion 18 in accordance with the movement of the cartridge tray 3 as described above, the developing cartridges 5 can be moved from the detaching posture to the image forming posture. Therefore, attachment of the developing cartridges 5 to the apparatus body 2 in the detaching posture can be suppressed.

In addition, in the present embodiment, the projection portion 152 projecting upward from the developing frame member 150 is provided so as to increase the capacity of the developer accommodating portion 150*c* to increase the amount of developer that can be accommodated. In addition, the rib 171 that includes the abutted portion 154 and is elastically deformable is provided at a position downstream of the projection portion 152 in the attaching direction.

As a result of this, even in the case where the developing cartridges 5Y to 5K are in the detaching posture, the abutted portion 154 of the rib 171 is abutted by the abutting portion 18 of the apparatus body 2 in accordance with the movement of the cartridge tray 3 in the attaching direction. Further, the developing cartridges 5Y to 5K in the detaching posture can be moved to the image forming posture. Therefore, the developing rollers 6 can be more reliably pressed against the photosensitive drums 4Y to 4K, and thus an image formation failure caused by the developing cartridges 5Y to 5K being in the detaching posture can be suppressed.

Further, by providing the rib 171 at a position different from the projection portion 152, the shape of the abutted portion 154 can be changed without affecting the capacity of the developer accommodating portion, and thus the flexibility of the design can be increased. For example, the sliding of the abutted portion 154 on the abutting portion 18 can increase the operational load for the operator in an operation to insert the cartridge tray 3 from the first position to the second position. Therefore, by configuring the rib 171 such that the rib 171 can be elastically deformed by a smaller force, the operational load can be reduced. For example, setting the length of the rib 171 in the X direction to be smaller than the length of the projection portion 152 in the X direction can be considered. In addition, as a result of the rib 171 being an elastically deformable member, breakage of the rib 171 caused by abutting the abutting portion 18 can be avoided.

In addition, after the abutting portion 18 abuts the rib 171, by moving the cartridge tray 3 further, the ribs 171 of all the developing cartridges 5Y to 5K can be caused to abut the abutting portion 18 to move the developing cartridges 5Y to 5K from the detaching posture to the image forming posture.

In addition, the ribs 171 constituting the abutted portions 154 abutted by the abutting portion 18 are provided in portions including the center positions X0 of the developing cartridges 5Y to 5K in the X direction. Therefore, when moving the developing cartridges 5Y to 5K from the detaching posture to the image forming posture, a force from the abutting portion 18 acts on the center portions of the developing cartridges 5Y to 5K in the X direction. Therefore, the developing cartridges 5Y to 5K can be moved from the detaching posture to the image forming posture by a simple configuration while maintaining the balance of the developing cartridges 5Y to 5K in the X direction.

Third Embodiment

A cartridge according to a third embodiment of the present disclosure will be described with reference to FIGS. 25A to 28B. In the description below, description of elements denoted by the same reference signs as in the first embodiment will be omitted assuming that these elements substantially have the same configurations and effects as in the first embodiment, and parts different from the first embodiment will be mainly described.

Figure 25A:
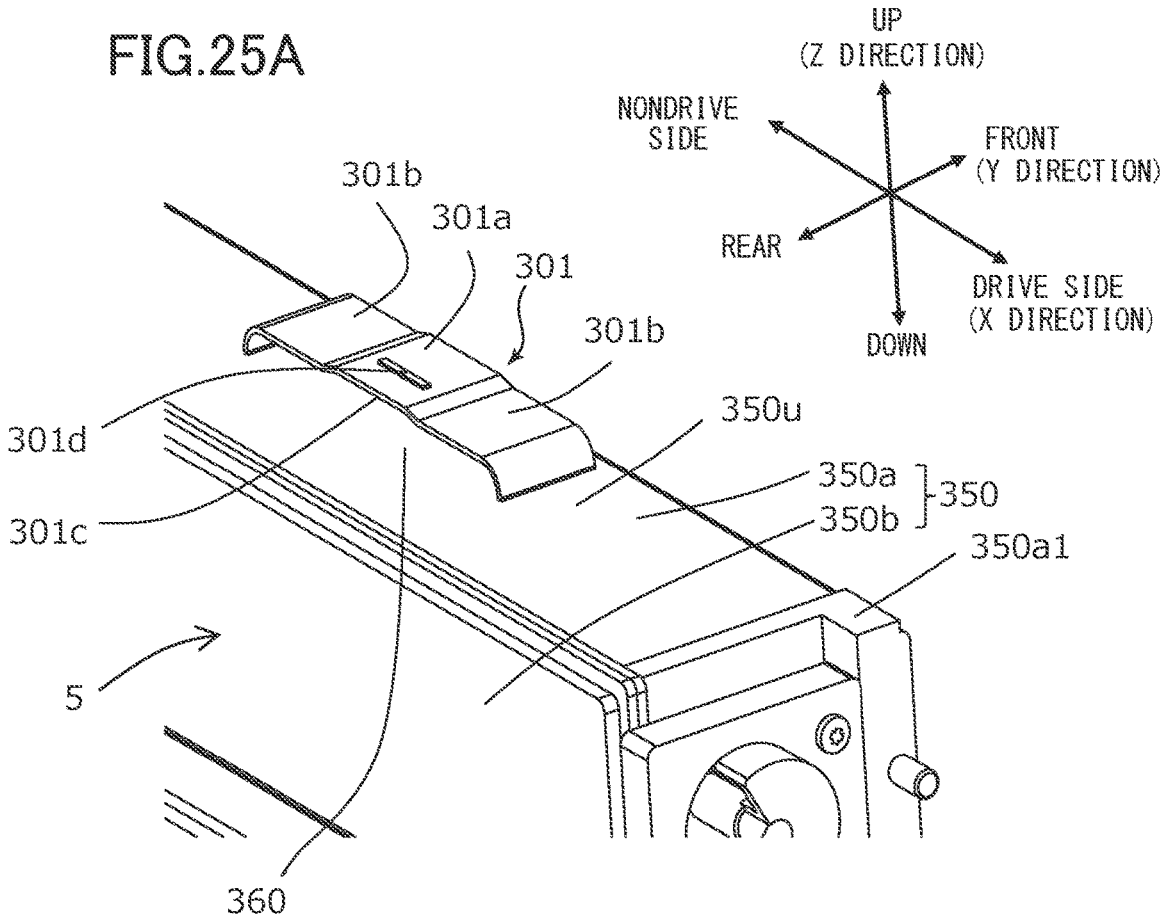
FIGS. 25A and 25B are each a perspective view of a developing cartridge according to a third embodiment.
Figure 25B:
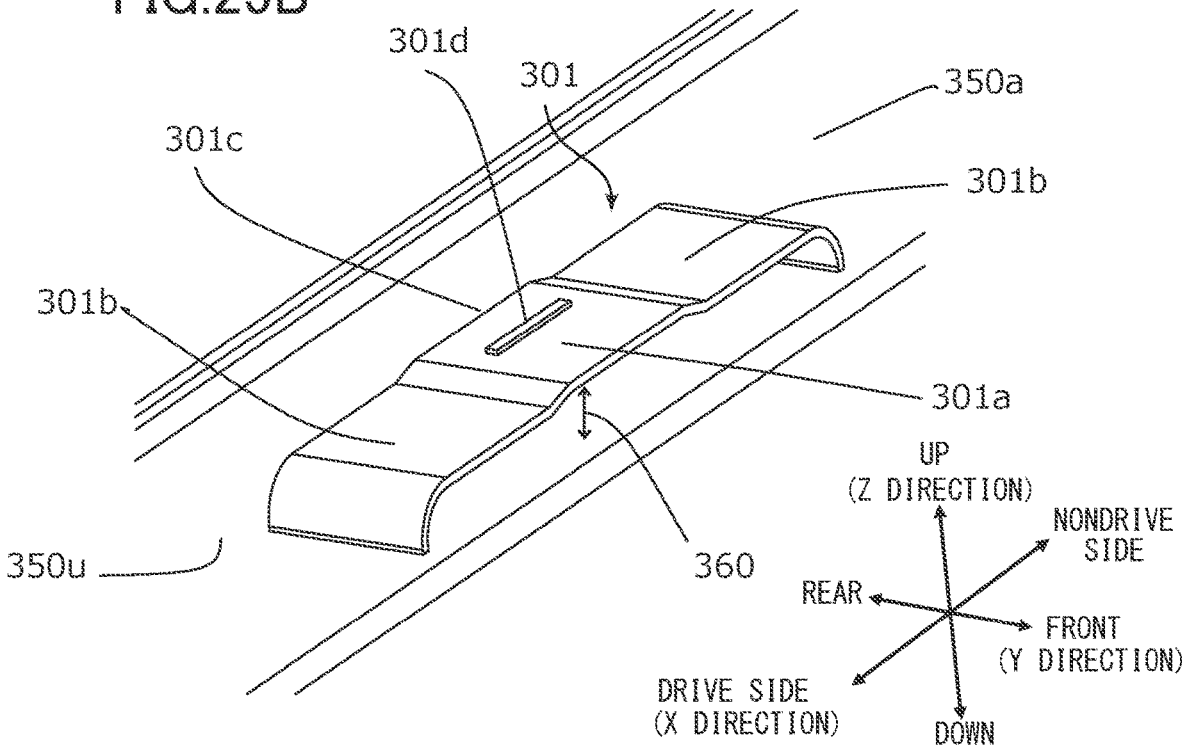

FIG. 25A is a perspective view of the developing cartridge 5 according to the present embodiment, and FIG. 25B is a perspective view of the developing cartridge 5 according to the present embodiment as viewed in a different direction from FIG. 25A. As illustrated in FIGS. 25A and 25B, a developing frame member 350 serving as a frame of the developing cartridge 5 is constituted by a first frame member 350*a* and a second frame member 350*b*. A rib 301 serving as an abutted portion of the present embodiment is provided in a portion or a region including the center position X0 in the X direction on an upper surface 350*u* of the first frame member 350*a*. The rib 301 also serves as a handle member or a gripping portion. The rib 301 is a member having a thin plate shape or a sheet shape whose thickness in the Z direction is smaller than the length thereof in the Y direction.

In other words, the rib 301 has a plate shape whose thickness in the vertical direction, that is, the Z direction is smaller than the width thereof in the attaching direction of the cartridge tray 3, that is, the attaching direction.

The rib 301 is formed in an arch or bridge shape which has end portions in the X direction connected to the upper surface 350*u* of the first frame member 350*a*, and thus interconnects two positions on the upper surface 350*u* apart from each other in the X direction. A space 360 is provided between the lower surface of the rib 301 and the upper surface 350*u* of the first frame member 350*a* as illustrated in FIG. 27C. As illustrated in FIGS. 25A and 25B, the rib 301 has a rib center portion 301*a* including the center position X0 of the developing frame member 350 in the X direction and extending in the X direction, and rib end portions 301*b* between which the rib center portion 301*a* is interposed in the X direction. The rib end portions 301*b* on both sides are connected to the upper surface 350*u* of the first frame member 350*a*. The rib end portion 301*b* on the first side of the center position X0 of the developing cartridge 5 in the X direction serves as a first end portion of the rib 301 according to the present embodiment, and the rib end portion 301*b* on the second side of the center position X0 serves as a second end portion of the rib 301 according to the present embodiment.

The rib center portion 301*a* is positioned above the rib end portions 301*b* in the Z direction. Further, a pressing protrusion 301*d* projects from the upper surface of the rib center portion 301*a* upward in the Z direction. As a result of providing the pressing protrusion 301*d* having a rib shape extending in a direction intersecting with the attaching direction, preferably in the X direction perpendicular to the attaching direction, the rib 301 can more reliably receive the reaction force from the apparatus body 2.

In addition, a rear end portion of the rib center portion 301*a* in the Y direction functions as an abutted portion 301*c*. The rib center portion 301*a* of the rib 301 including the abutted portion 301*c* extends in a direction intersecting with the Z direction, preferably in a direction perpendicular to the Z direction, and is configured so as to be capable of elastically deforming downward in the Z direction when the abutted portion 301*c* is abutted by the abutting portion 18 that will be described later. This rib 301 functions as a handle for the operator to grip when handling the developing cartridge 5. At this time, the operator can support the lower surface of the rib 301 by putting their fingers in the space 360 under the rib 301. To be noted, although a projection portion 350*a*1 projecting upward in the Z direction as compared with other part of the upper surface 350*u* of the first frame member 350*a* is provided at an end portion of the upper surface 350*u* in the X direction, the rib 301 projects more upward than the projection portion 350*a*1 in the Z direction.

Figure 26A:
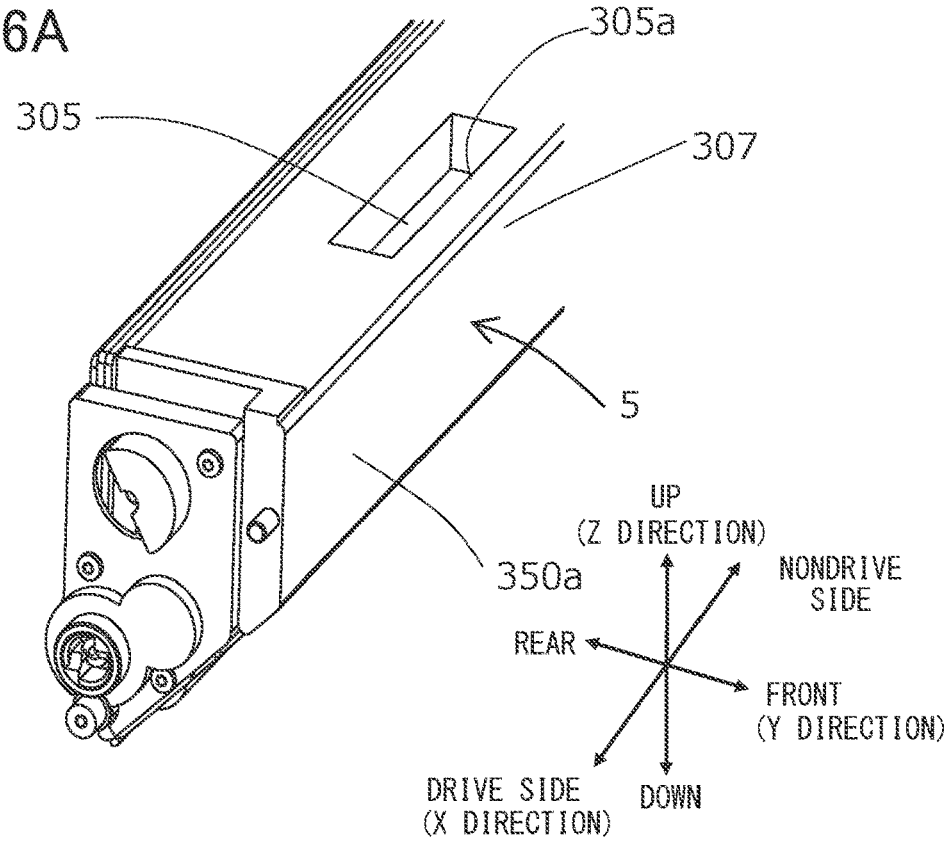
FIGS. 26A and 26B are respectively a perspective view and a section view of a developing cartridge according to a reference example.
Figure 26B:
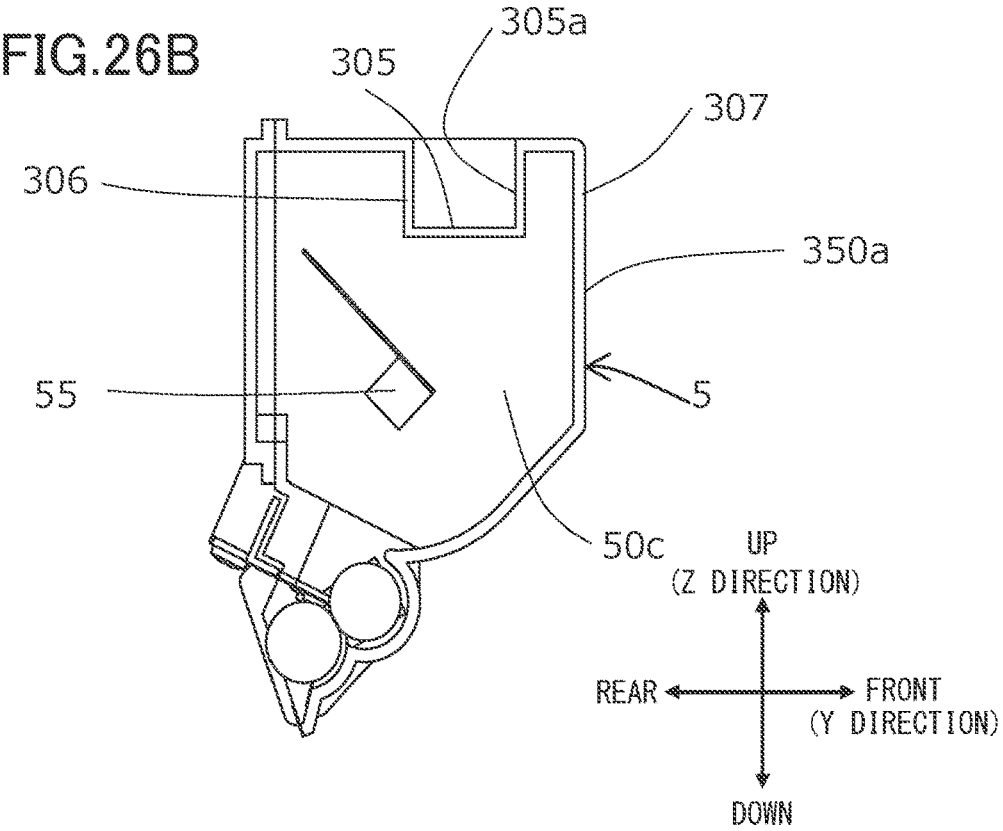

Here, a handle configuration of a reference example will be described with reference to FIGS. 26A and 26B. FIG. 26A is a perspective view of the developing cartridge 5 according to the reference example, and FIG. 26B is a section view of the developing cartridge 5 according to the reference example. In the reference example, a recess portion 305 is provided in the upper surface 350*u* of the first frame member 350*a* as illustrated. Further, the recess portion 305 is made to function as a handle that the operator grips by gripping, by fingers, a first contact surface 305*a* that is an inner surface of the recess portion 305 and faces the rear side in the Y direction, and a second contact surface 307 that is an outer surface of the developing frame member 350 and faces the front side in the Y direction, that is, by pinching the first contact surface 305*a* and the second contact surface 307. In this configuration, an inward projection portion 306 projecting downward in the Z direction from the upper surface 350*u* of the first frame member 350*a* toward the inside of the developer accommodating portion 50*c* is generated on the back side of the recess portion 305, and therefore the capacity of the developer accommodating portion 50*c* is reduced as illustrated in FIG. 26B.

In contrast, in the handle configuration of the present embodiment, a portion (i.e., first region) of the upper surface 350*u* of the first frame member 350*a* right under the rib 301 in the Z direction, that is, a portion of the upper surface 350*u* overlapping with the rib 301 as viewed in the Z direction is arranged at least not recessed downward as compared with (specifically, at the same height as) the other portions (i.e., second regions) of the upper surface 350*u* therearound in the Z direction. In addition, the back side, that is, the lower side in the Z direction of the portion of the upper surface 350*u* right under the rib 301 in the Z direction serves as the developer accommodating portion 50*c* with the wall of the upper surface 350*u* therebetween. That is, the inward projection portion 306 projecting toward the inside of the developer accommodating portion 50*c* is not formed. Therefore, the rib 301 serving as a handle can be provided without reducing the capacity of the developer accommodating portion 50*c*.

Here, how the developing cartridges 5Y to 5K transition from the detaching posture to the image forming posture in accordance with the movement of the cartridge tray 3 in the case of using the developing cartridge 5 according to the present embodiment as each of the developing cartridges 5Y to 5K of the image forming apparatus 1 will be described.

Figure 27A:
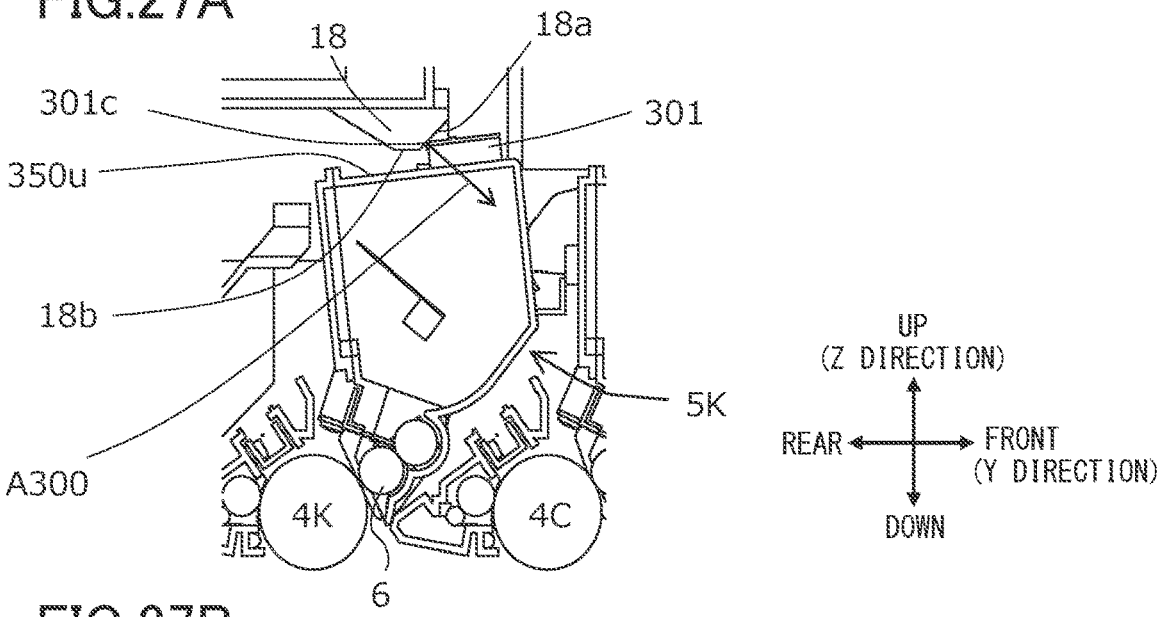
FIGS. 27A to 27C are each a diagram for describing the posture change of the developing cartridge in accordance with the movement of a cartridge tray according to the third embodiment.
Figure 27B:
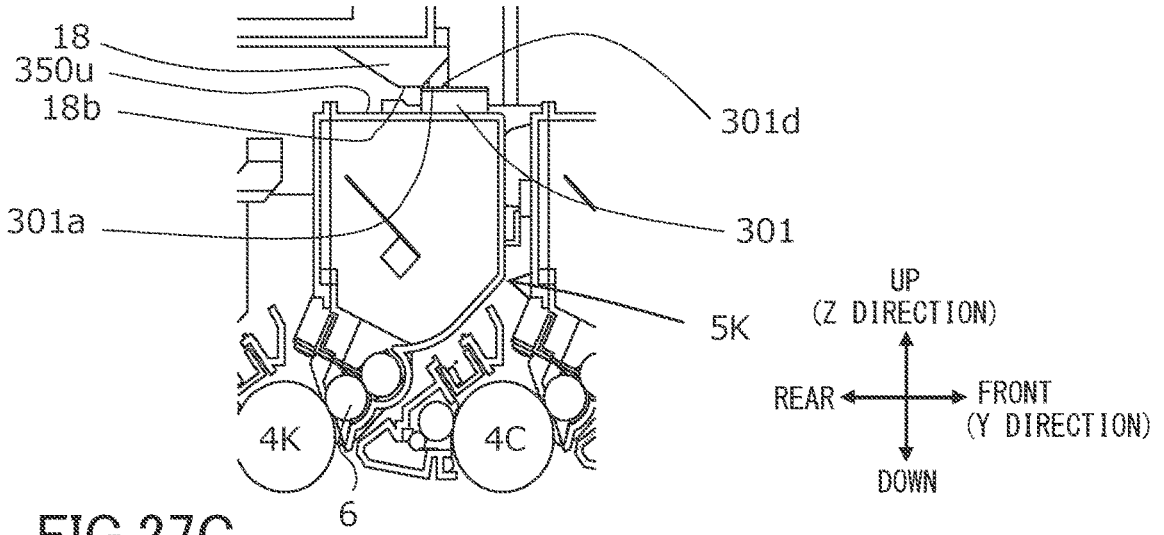
Figure 27C:
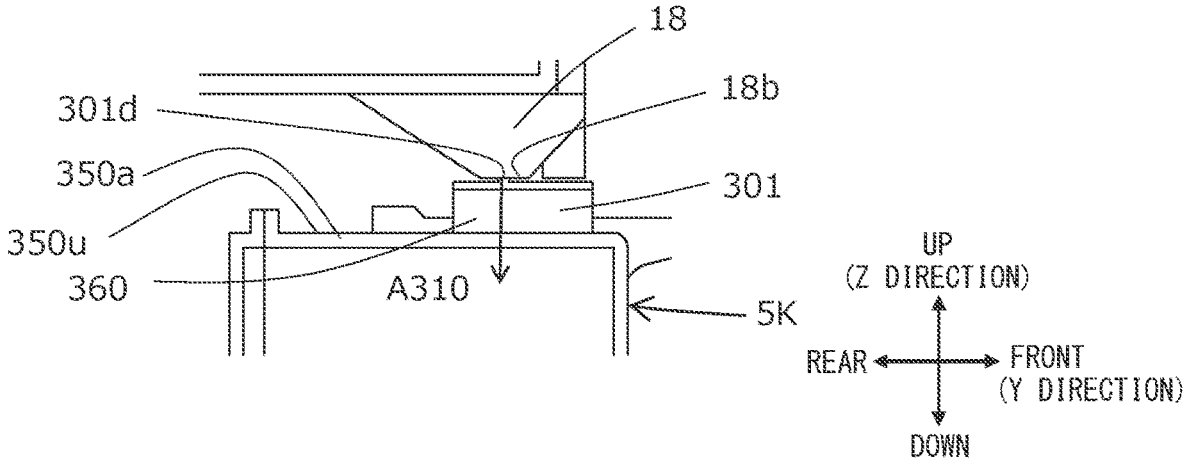

FIGS. 27A to 27C are each a section view of the image forming apparatus 1 illustrating a cross-section taken along a virtual plane perpendicular to the X direction as viewed in the X direction, and illustrates how the cartridge tray 3 is moved from the first position toward the second position. FIGS. 27A to 27C illustrate a case where attachment of the cartridge tray 3 is performed in a state in which the black developing cartridge 5K is in the detaching posture and the developing cartridges 5Y, 5M, and 5C of the other colors are in the image forming posture.

When the operator moves the cartridge tray 3 in the attaching direction from the first position toward the second position, the abutted portion 301*c* of the rib 301 of the black developing cartridge 5K abuts the first abutting portion 18*a* of the abutting portion 18 of the apparatus body 2 as illustrated in FIG. 27A. Then, the abutted portion 301*c* is pressed by the first abutting portion 18*a* in a direction indicated by an arrow A300 in FIG. 27A toward the front side in the Y direction, that is, upstream in the attaching direction, and downward in the Z direction. As a result of this pressing force or reaction force, the developing cartridge 5K pivots toward the front side in the Y direction about the rotation axis of the developing roller 6, and moves from the detaching posture serving as a first posture to the image forming posture serving as a second posture.

Then, as illustrated in FIG. 27B, the developing cartridge 5K passes through the space under the abutting portion 18 of the apparatus body 2 in the attaching direction with a clearance between the horizontal portion 18*b* of the abutting portion 18 and the rib center portion 301*a* in the state of image forming posture.

When the operator further moves the cartridge tray 3 toward the second position, the pressing protrusion 301*d* of the rib 301 abuts the horizontal portion 18*b* of the abutting portion 18 as illustrated in FIG. 27C. The rib 301 is elastically deformed by the reaction force that is directed downward in the Z direction, received from the horizontal portion 18*b*, and indicated by an arrow A310 in FIG. 27C, such that the rib center portion 301*a* is displaced, that is, warped downward in the Z direction. The developing cartridge 5K is pressurized downward in the Z direction by this reaction force, and the state of being attached to the cartridge tray 3 in the image forming posture is more reliably maintained.

When the cartridge tray 3 continues moving toward the second position, the pressing protrusions 301*d* of the developing cartridges 5C, 5M, and 5Y of the other colors in the image forming posture sequentially abut the horizontal portion 18*b* of the abutting portion 18. As a result of this, the developing cartridges 5C, 5M, and 5Y are more reliably maintained in the state of being attached to the cartridge tray 3 in the image forming posture. Then, the cartridge tray 3 is completely inserted to the second position and the front door 17 is closed, and thus the attachment of the developing cartridges 5Y to 5K and the cartridge tray 3 to the apparatus body 2 is completed.

As described above, as a result of configuring the abutted portions 301*c* of the ribs 301 of the developing cartridges 5Y to 5K in the detaching posture to be abutted by the abutting portion 18, the developing cartridges 5Y to 5K can be changed from the detaching posture to the image forming posture in accordance with the movement of the cartridge tray 3. Therefore, attachment of the developing cartridges 5Y to 5K to the apparatus body 2 in the detaching posture can be suppressed.

In addition, since the rib 301 having a thin plate shape can be elastically deformed relatively easily by being pressurized downward in the Z direction by the abutting portion 18 of the apparatus body 2, the rib 301 is not easily broken when abutting the abutting portion 18, and increase in the operational load of attaching the cartridge tray 3 can be suppressed.

In addition, the ribs 301 including the abutted portions 301*c* are provided in portions including the center positions X0 of the developing cartridges 5Y to 5K in the X direction. Therefore, when moving the developing cartridges 5 from the detaching posture to the image forming posture, a force from the abutting portion 18 acts on the center portions of the developing cartridges 5Y to 5K in the X direction. Therefore, the developing cartridges 5Y to 5K can be moved from the detaching posture to the image forming posture by a simple configuration while maintaining the balance of the developing cartridges 5Y to 5K in the X direction.

Fourth Embodiment

A cartridge according to a fourth embodiment of the present disclosure and modification examples thereof will be described with reference to FIGS. 28A to 34B. In the description below, description of elements denoted by the same reference signs as in the first embodiment will be omitted assuming that these elements substantially have the same configurations and effects as in the first embodiment, and parts different from the first embodiment will be mainly described.

Figure 28A:
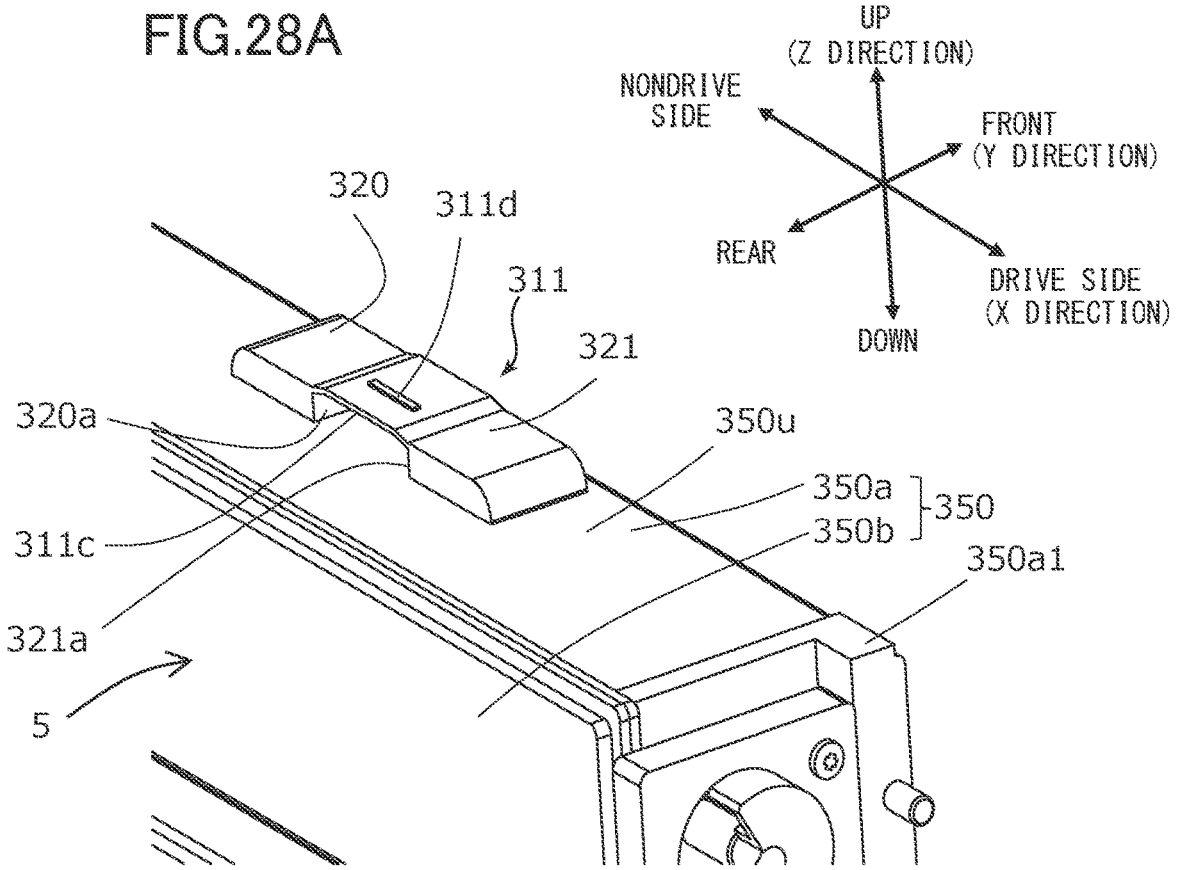
FIGS. 28A and 28B are each a perspective view of part of a developing cartridge according to a fourth embodiment.
Figure 28B:
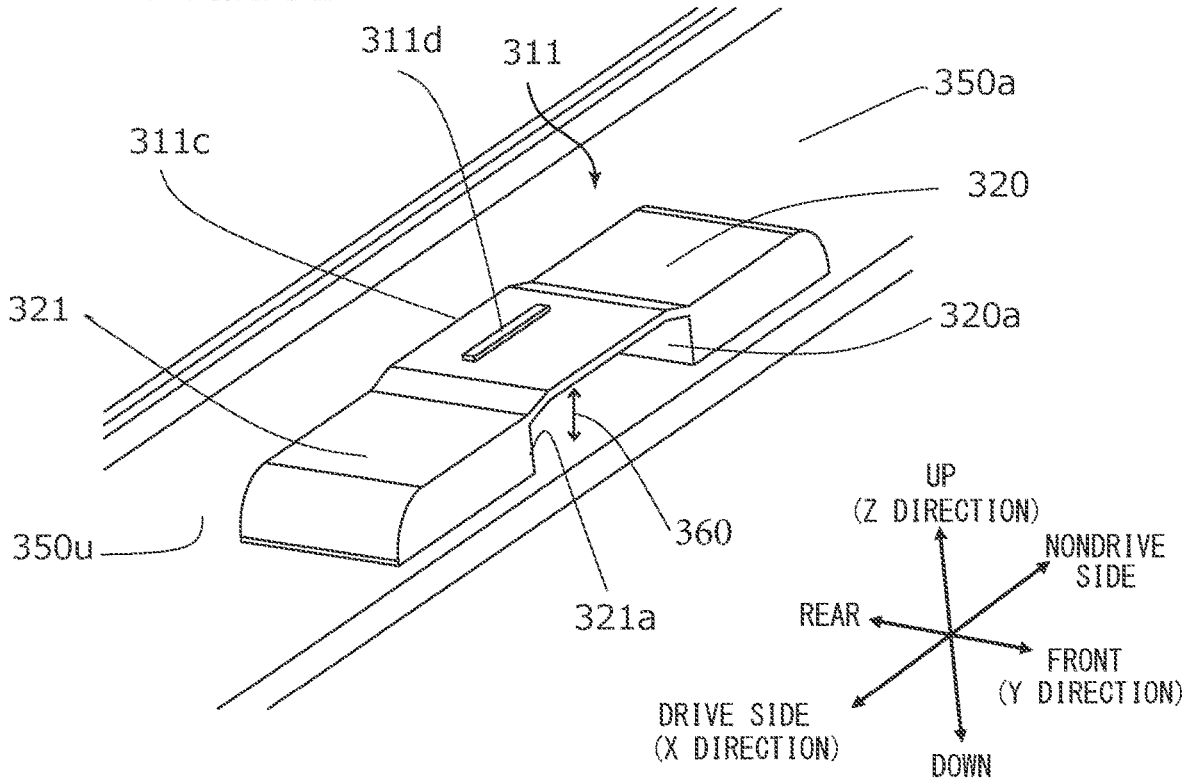

FIG. 28A is a perspective view of the developing cartridge 5 according to the fourth embodiment, and FIG. 28B is a perspective view of the developing cartridge 5 according to the embodiment as viewed in a different direction from FIG. 28A. As illustrated in FIGS. 28A and 28B, a developing frame member 350 serving as a frame of the developing cartridge 5 is constituted by a first frame member 350*a* and a second frame member 350*b*. A first projection portion 320 and a second projection portion 321 are provided at positions on the upper surface 350*u* of the first frame member 350*a* between which the center position X0 in the X direction is interposed. The first projection portion 320 and the second projection portion 321 project upward in the vertical direction, that is, the Z direction, as compared with parts between and outside the first projection portion 320 and the second projection portion 321 in the X direction on the upper surface 350*u* of the first frame member 350*a*. At least part of each of the first projection portion 320 and the second projection portion 321 is positioned upstream of the center position Y0 of the upper surface 350*u* of the developing frame member 350 in the attaching direction of the cartridge tray 3.

The first projection portion 320 and the second projection portion 321 each have a hollow space or cavity therein that serves as part of the developer accommodating portion 50*c*. A rib 311 having a plate shape is provided between a surface 320*a* on the inner side of the first projection portion 320 in the X direction and a surface 321*a* on the inner side of the second projection portion 321 in the X direction. The rib 311 is a member having a thin plate shape or a sheet shape whose thickness in the Z direction is smaller than the length or width thereof in the Y direction. A space 360 is provided between the lower surface of the rib 311 and the upper surface 350*u* of the first frame member 350*a*. The first projection portion 320 and the second projection portion 321 respectively serve as a first end portion and a second end portion of the rib 311 of the present embodiment.

A pressing protrusion 301*d* projects upward in the Z direction from the upper surface of the rib 311. In addition, a rear end portion of the rib 311 in the Y direction functions as an abutted portion 311*c*. The rib 311 extends in a direction intersecting with the Z direction, preferably in a direction perpendicular to the Z direction, and is configured so as to be capable of elastically deforming downward in the Z direction when the abutted portion 311*c* is abutted by the abutting portion 18 that will be described later. To be noted, although a projection portion 350*a*1 projecting upward in the Z direction as compared with other part of the upper surface 350*u* of the first frame member 350*a* is provided at an end portion of the upper surface 350*u* in the X direction, the rib 311 projects more upward than the projection portion 350*a*1 in the Z direction. In addition, at least part of the rib 311 projects more upward in the Z direction than the upper surfaces of the first projection portion 320 and the second projection portion 321 in the Z direction.

The first projection portion 320, the second projection portion 321, and the rib 311 function as a handle for the operator to grip when handling the cartridge 5. At this time, the operator can support the lower surface of the rib 311 by putting their fingers in the space 360 under the rib 311. According to this configuration, since the first projection portion 320 and the second projection portion 321 each have a hollow space or cavity therein serving as part of the developer accommodating portion 50*c*, the capacity of the developer accommodating portion 50*c* illustrated in FIG. 5 can be increased.

Here, how the developing cartridges 5Y to 5K transition from the detaching posture to the image forming posture in accordance with the movement of the cartridge tray 3 in the case of using the developing cartridge 5 according to the present embodiment as each of the developing cartridges 5Y to 5K of the image forming apparatus 1 will be described.

Figure 29A:
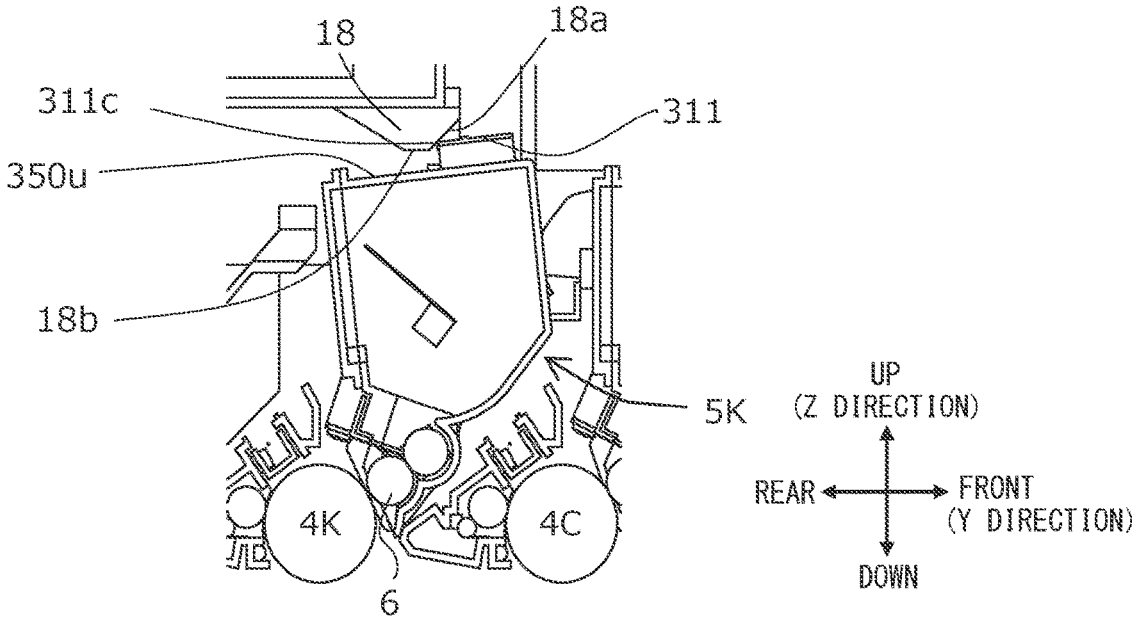
FIGS. 29A to 29C are each a diagram for describing the posture change of the developing cartridge in accordance with the movement of the cartridge tray according to the fourth embodiment.
Figure 29B:
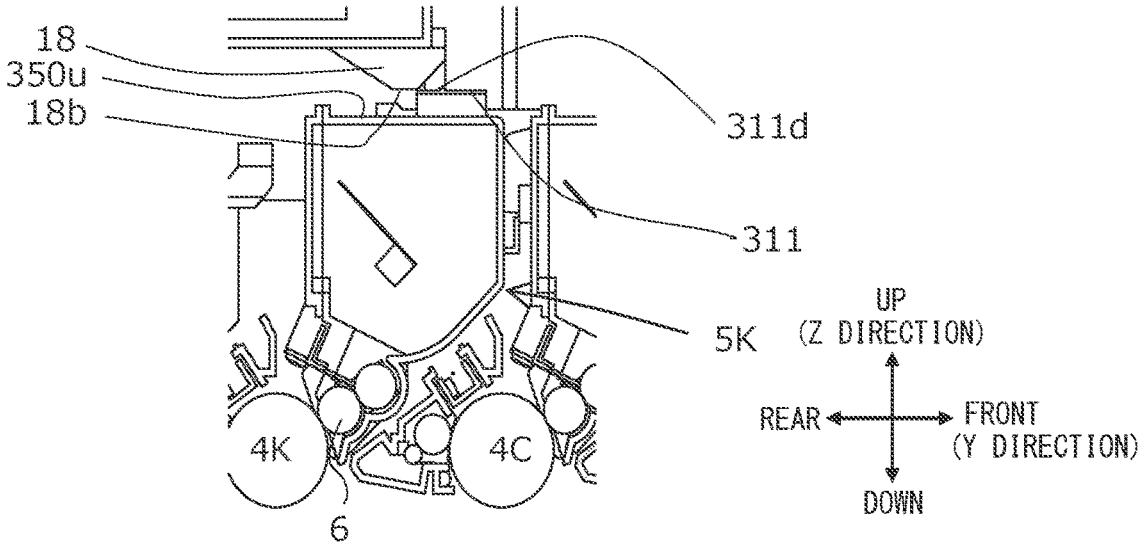
Figure 29C:
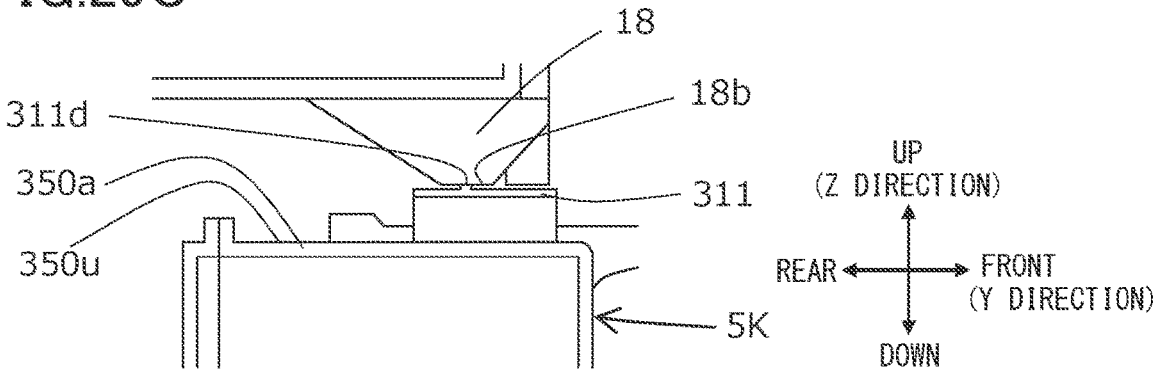

FIGS. 29A to 29C are each a section view of the image forming apparatus 1 according to the present embodiment illustrating a cross-section taken along a virtual plane perpendicular to the X direction as viewed in the X direction, and illustrates how the cartridge tray 3 is moved from the first position toward the second position. FIGS. 29A to 29C illustrate a case where attachment of the cartridge tray 3 is performed in a state in which the black developing cartridge 5K is in the detaching posture and the developing cartridges 5Y, 5M, and 5C of the other colors are in the image forming posture.

When the operator moves the cartridge tray 3 in the attaching direction from the first position toward the second position, the abutted portion 311*c* of the rib 311 of the black developing cartridge 5K abuts the first abutting portion 18*a* of the abutting portion 18 of the apparatus body 2 as illustrated in FIG. 29A. Then, the abutted portion 311*c* is pressed by the first abutting portion 18*a* toward the front side in the Y direction, that is, upstream in the attaching direction, and downward in the Z direction. As a result of this pressing force or reaction force, the developing cartridge 5K pivots toward the front side in the Y direction about the rotation axis of the developing roller 6, and moves from the detaching posture serving as a first posture to the image forming posture serving as a second posture.

Then, as illustrated in FIG. 29B, the developing cartridge 5K passes through the space under the abutting portion 18 of the apparatus body 2 in the attaching direction with a clearance between the horizontal portion 18*b* of the abutting portion 18 and the rib 311 in the state of the image forming posture.

When the operator further moves the cartridge tray 3 toward the second position, the pressing protrusion 311*d* of the rib 311 abuts the horizontal portion 18*b* of the abutting portion 18 as illustrated in FIG. 29C. The rib 311 is elastically deformed by the reaction force that is directed downward in the Z direction and received from the horizontal portion 18*b* such that the rib 311 is displaced, that is, warped downward in the Z direction. The developing cartridge 5K is pressurized downward in the Z direction by this reaction force, and the state of being attached to the cartridge tray 3 in the image forming posture is more reliably maintained.

When the cartridge tray 3 continues moving toward the second position, the pressing protrusions 311*d* of the developing cartridges 5C, 5M, and 5Y of the other colors in the image forming posture sequentially abut the horizontal portion 18*b* of the abutting portion 18. As a result of this, the developing cartridges 5C, 5M, and 5Y are more reliably maintained in the state of being attached to the cartridge tray 3 in the image forming posture. Then, the cartridge tray 3 is completely inserted to the second position and the front door 17 is closed, and thus the attachment of the developing cartridges 5Y to 5K and the cartridge tray 3 to the apparatus body 2 is completed.

As described above, as a result of configuring the abutted portions 311*c* of the ribs 311 of the developing cartridges 5Y to 5K in the detaching posture to be abutted by the abutting portion 18, the developing cartridges 5Y to 5K can be changed from the detaching posture to the image forming posture in accordance with the movement of the cartridge tray 3. Therefore, attachment of the developing cartridges 5Y to 5K to the apparatus body 2 in the detaching posture can be suppressed.

In addition, since the rib 311 having a thin plate shape can be elastically deformed relatively easily by being pressurized downward in the Z direction by the abutting portion 18 of the apparatus body 2, the rib 311 is not easily broken when abutting the abutting portion 18, and increase in the operational load for attaching the cartridge tray 3 can be suppressed.

In addition, the ribs 311 including the abutted portions 311*c* are provided in portions including the center positions X0 of the developing cartridges 5Y to 5K in the X direction. Therefore, when moving the developing cartridges 5 from the detaching posture to the image forming posture, a force from the abutting portion 18 acts on the center portions of the developing cartridges 5Y to 5K in the X direction. Therefore, the developing cartridges 5Y to 5K can be moved from the detaching posture to the image forming posture by a simple configuration while maintaining the balance of the developing cartridges 5Y to 5K in the X direction.

First Modification Example

Figure 30A:
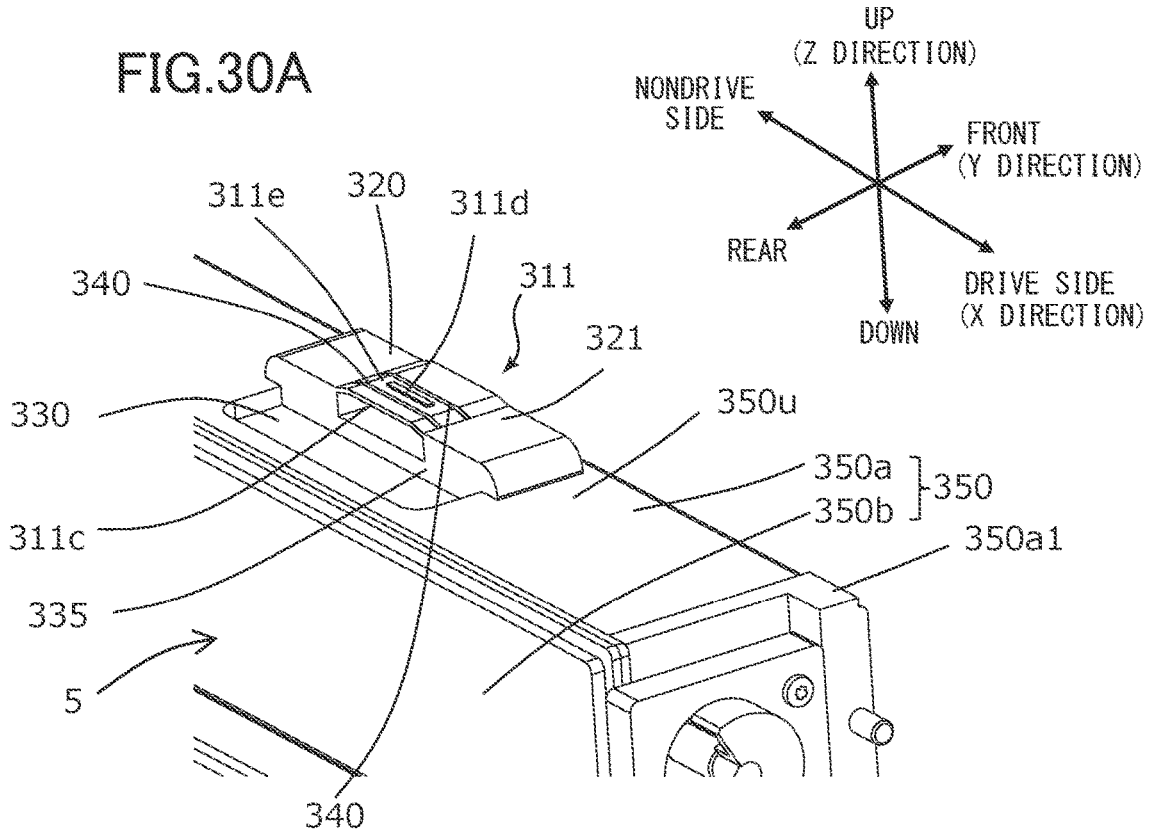
FIGS. 30A and 30B are each a perspective view of part of a developing cartridge according to a first modification example of the fourth embodiment.

Modification examples of the developing cartridge 5 according to the fourth embodiment will be described below with reference to FIGS. 30A to 34B. FIG. 30A is a perspective view of the developing cartridge 5 according to a first modification example of the fourth embodiment, and FIG. 30B is a perspective view of the developing cartridge 5 according to the first modification example as viewed in a different direction from FIG. 30A.

Figure 30B:
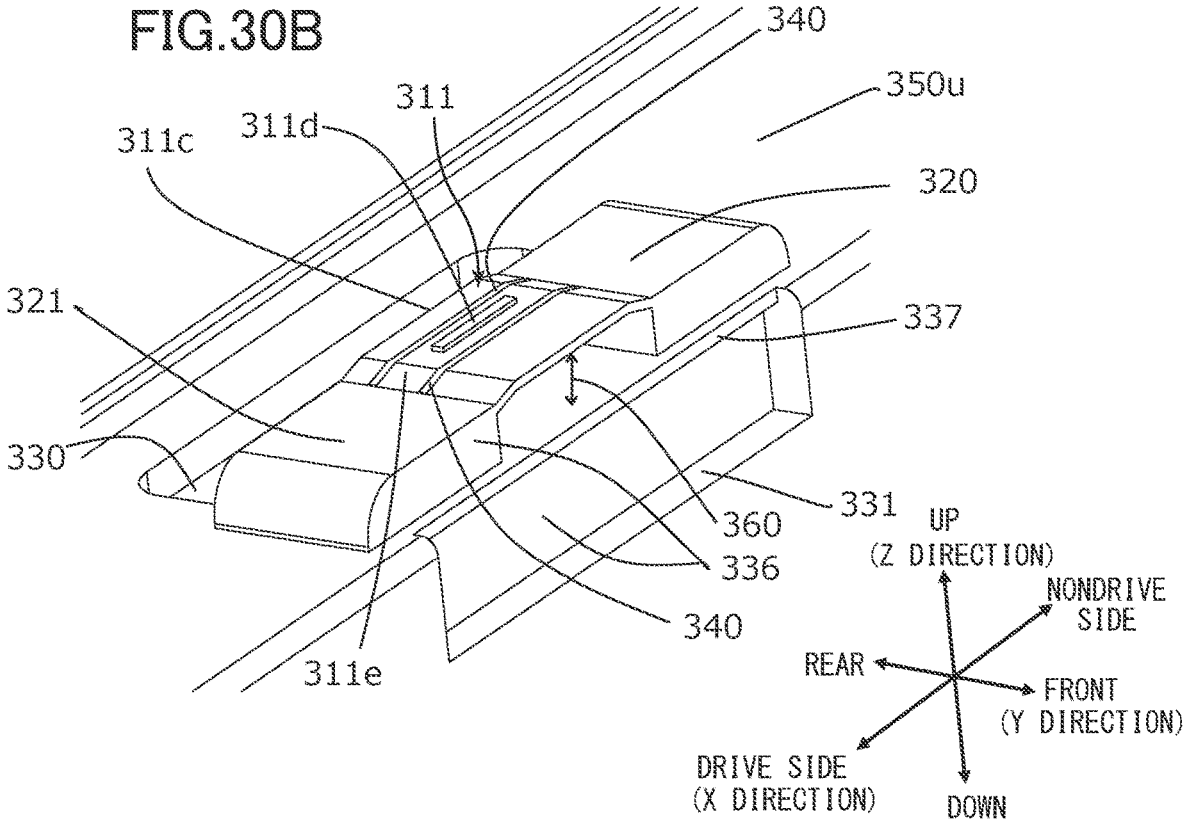

As illustrated in FIGS. 30A and 30B, in the present modification example, a first recess portion 330 is provided on the rear side in the Y direction and a second recess portion 331 is provided on the front side in the Y direction with respect to the first projection portion 320, the second projection portion 321, and the rib 311. The first recess portion 330 and the second recess portion 331 are each a shape in which part of the upper surface 350*u* of the first frame member 350*a* overlapping with the first projection portion 320, the second projection portion 321, and the rib 311 is recessed downward in the Z direction. As a result of providing the first recess portion 330, a first contact surface 335 that is a surface on the rear side of the first projection portion 320, the second projection portion 321, and the rib 311 in the Y direction is expanded toward the lower side in the Z direction. In addition, as a result of providing the second recess portion 331, a second contact surface 336 that is a surface on the front side of the first projection portion 320, the second projection portion 321, and the rib 311 in the Y direction is expanded toward the lower side in the Z direction.

The operator can grip the developing cartridge 5 by using the rib 311 as a handle. At this time, the operator can grip the developing cartridge 5 by putting their fingers on the first contact surface 335 and the second contact surface 336. In addition, the operator may put their fingertips in the space right under the rib 311 in a space 360 between the lower surface of the rib 311 and the upper surface 350*u* of the first frame member 350*a*.

As illustrated in FIG. 30B, a holding rib 337 is preferably provided on the second contact surface 336. The holding rib 337 is formed as a projection projecting from the second contact surface 336 toward the front side in the Y direction and extending in the X direction. When gripping the developing cartridge 5, the operator can hook the finger in contact with the second contact surface 336 on this holding rib 337, and thus the operator can more stably grip the developing cartridge 5. To be noted, a holding rib may be also provided on the first contact surface 335.

To be noted, also in a configuration in which only one of the first recess portion 330 and the second recess portion 331 is provided, the first contact surface 335 or the second contact surface 336 can be provided in a wide area, and thus the developing cartridge 5 can be stably gripped.

In addition, as illustrated in FIGS. 30A and 30B, a slit 340 is provided in the rib 311 to reduce the width in the Y direction of a base portion 311*e* that is a part of the rib 311 where the pressing protrusion 311*d* is provided. According to this configuration, the elasticity of the base portion 311*e* becomes weaker, that is, the base portion 311*e* becomes softer and the stiffness thereof becomes lower, and thus the reaction force that the pressing protrusion 311*d* receives from the horizontal portion 18*b* in attachment of the cartridge tray 3 as illustrated in FIG. 29C is reduced. According to this configuration, the frictional force generated between the horizontal portion 18*b* and the pressing protrusion 311*d* in attachment of the cartridge tray 3 becomes smaller, and thus the cartridge tray 3 can be attached by a smaller operational load. That is, the usability is improved.

Second Modification Example

Figure 31:
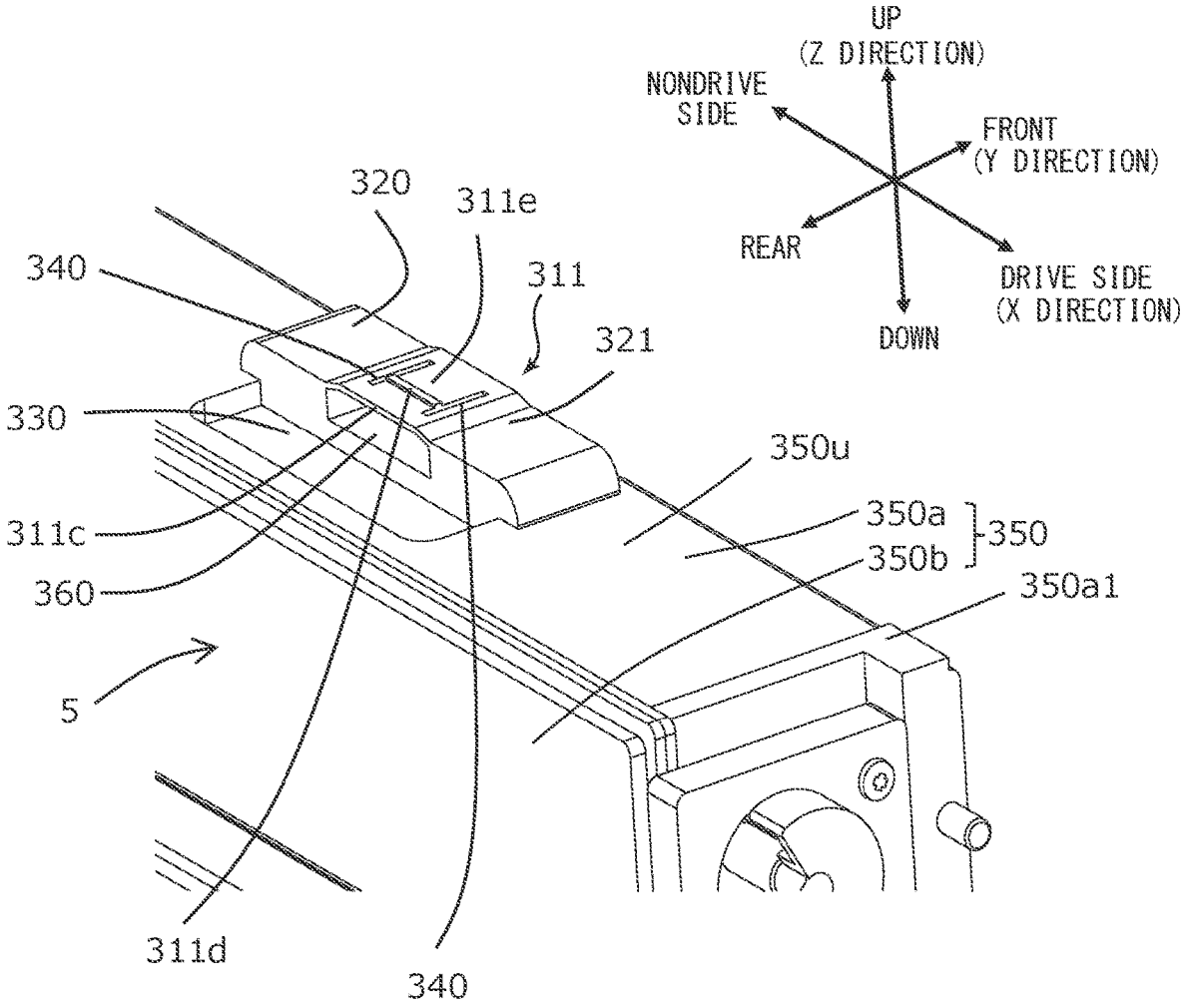
FIG. 31 is a perspective view of part of a developing cartridge according to a second modification example of the fourth embodiment.

FIG. 31 is an enlarged perspective view of part of the developing cartridge 5 according to a second modification example of the fourth embodiment. The present modification example is different from the first modification example illustrated in FIGS. 30A and 30B in the shape of the slit 340 provided in the rib 311. That is, the slit 340 of the rib 311 is defined to extend in the Y direction on both sides of the pressing protrusion 311*d* in the X direction. Therefore, the width in the X direction of the base portion 311*e* that is a part of the rib 311 where the pressing protrusion 311*d* is provided is reduced. According to this configuration, the frictional force generated between the horizontal portion 18*b* and the pressing protrusion 311*d* in attachment of the cartridge tray 3 becomes smaller, and thus the cartridge tray 3 can be attached by a smaller operational load. That is, the usability is improved.

Third Modification Example

Figure 32A:
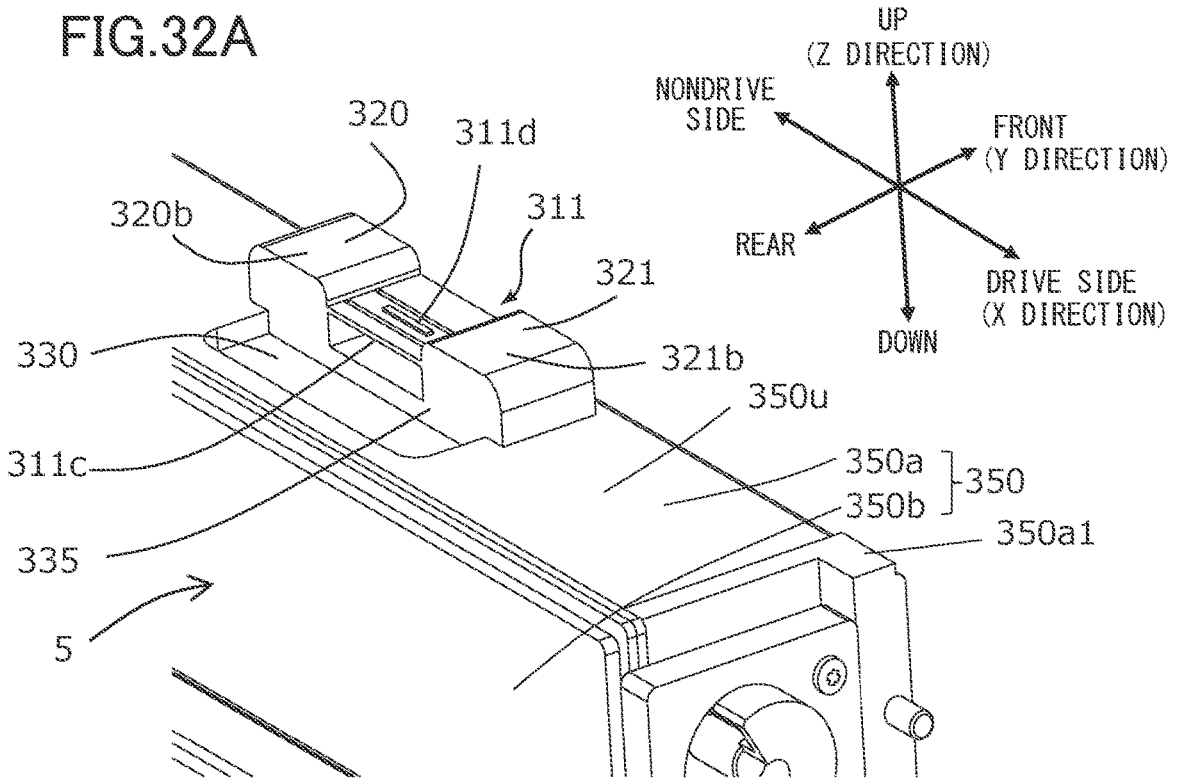
FIGS. 32A and 32B are each a perspective view of part of a developing cartridge according to a third modification example of the fourth embodiment.
Figure 32B:
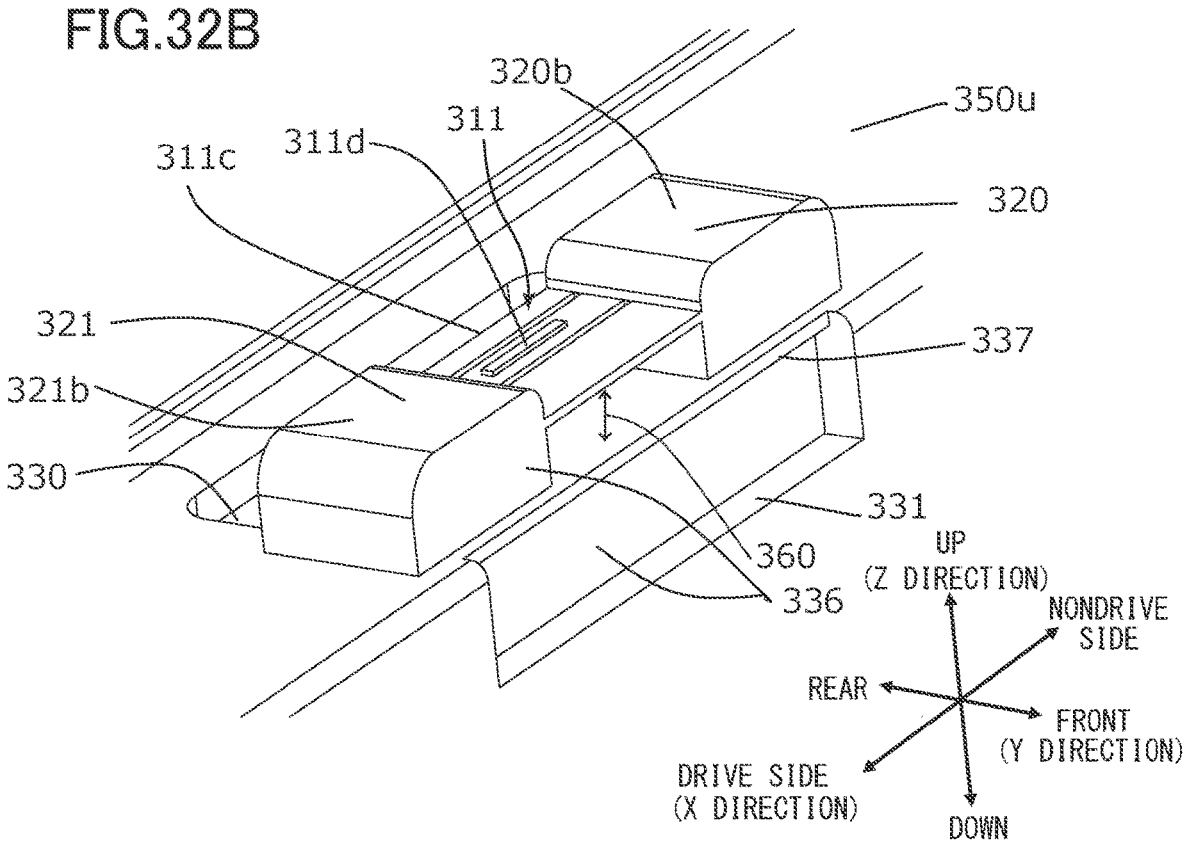

A third modification example in which the configuration of the handle portion is further different will be described with reference to FIGS. 32A, 32B, and 33. FIG. 32A is a perspective view of the developing cartridge 5 according to the present modification example, and FIG. 32B is a perspective view of the developing cartridge 5 according to the present modification example as viewed in a different direction from FIG. 32A. The present modification example has a configuration in which the position of the rib 311 in the Z direction is not changed from the fourth embodiment, and the upper surface 320*b* of the first projection portion 320 and the upper surface 321*b* of the second projection portion 321 are positioned above the upper surface of the rib 311 in the Z direction. In other words, the projection height in the Z direction of at least one, preferably both of the first projection portion 320 and the second projection portion 321 with respect to the upper surface 350*u* of the first frame member 350*a* is larger than the projection height of the rib 311 with respect to the upper surface 350*u*.

Figure 33:
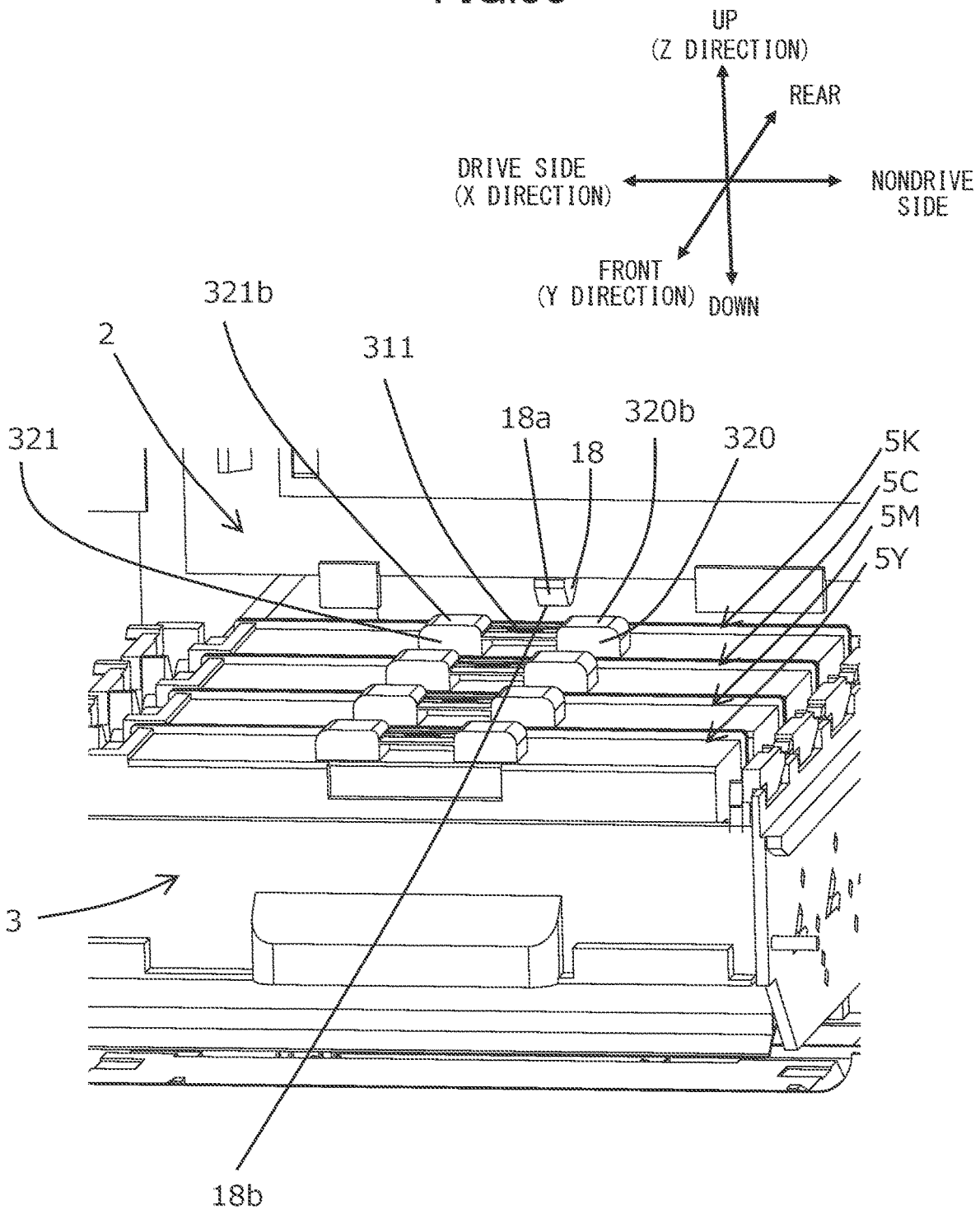
FIG. 33 is a diagram for describing the positional relationship between a projection portion of the developing cartridge according to the third modification example of the fourth embodiment and an abutting portion of an apparatus body.

FIG. 33 is a perspective view of the cartridge tray 3 illustrating how the cartridge tray 3 to which the developing cartridges 5 of the present modification example are attached as each of the developing cartridges 5Y to 5K is attached to the apparatus body 2. As illustrated in FIG. 33, the upper surfaces 320*b* of the first projection portions 320 and the upper surfaces 321*b* of the second projection portions 321 of the developing cartridges 5Y to 5K are positioned above the horizontal portion 18*b* of the abutting portion 18 of the apparatus body 2 in the Z direction. However, since the positions of the first projection portion 320 and the second projection portion 321 in the X direction do not overlap with the position of the abutting portion 18 in the X direction, the first projection portion 320 and the second projection portion 321 do not interfere with the abutting portion 18 when attaching the cartridge tray 3.

According to this configuration, the first contact surface 335 and the second contact surface 336 that the fingers touch when gripping the developing cartridge 5 can be expanded, and thus the operator can more stably grip the developing cartridge 5. In addition, by making the first projection portion 320 and the second projection portion 321 larger, the capacity of the developer accommodating portion 50*c* illustrated in FIG. 5 can be increased.

Fourth Modification Example

Figure 34A:
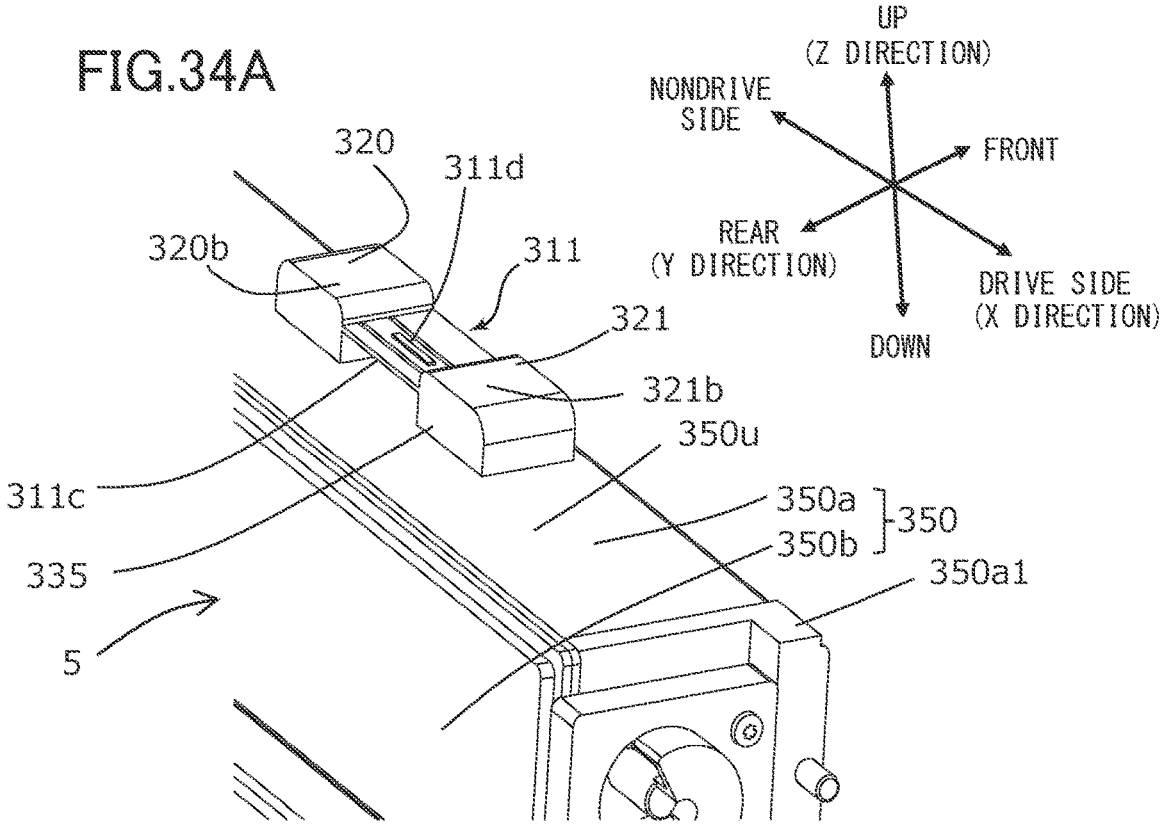
FIGS. 34A and 34B are each a perspective view of part of a developing cartridge according to a fourth modification example of the fourth embodiment.
Figure 34B:
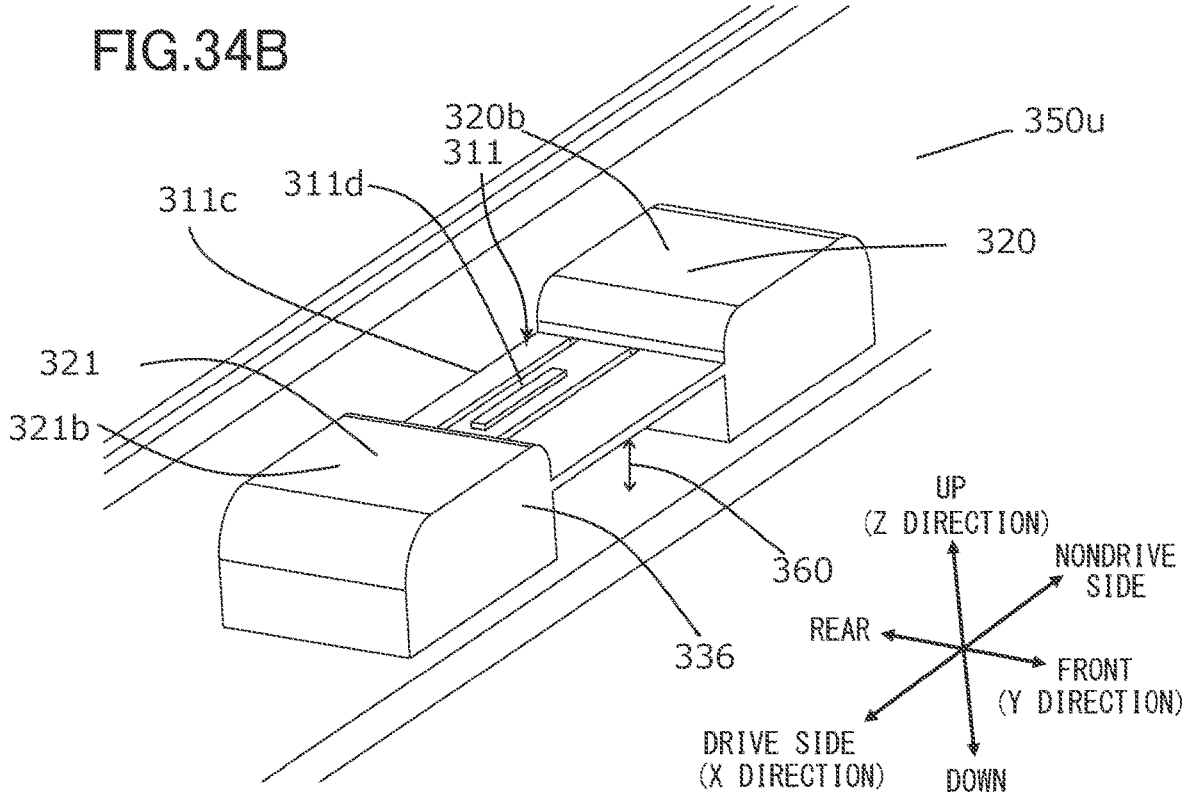

A fourth modification example in which the configuration of the handle portion is further different will be described with reference to FIGS. 34A and 34B. FIG. 34A is a perspective view of the developing cartridge 5 according to the present modification example, and FIG. 34B is a perspective view of the developing cartridge 5 according to the present modification example as viewed in a different direction from FIG. 34A.

In the present embodiment, the first projection portion 320 and the second projection portion 321 project to positions above the rib 311 in the Z direction similarly to the third modification example 3 described with reference to FIGS. 33A and 33B. Meanwhile, the first recess portion 330 and the second recess portion 331 of the third modification example are not provided in the upper surface 350*u* of the first frame member 350*a*, and the upper surface 350*u* is flat around the first projection portion 320, the second projection portion 321, and the rib 311. However, by increasing the projection amount of the first projection portion 320 and the second projection portion 321, the first contact surface 335 and the second contact surface 336 can be expanded, and the operator can more stably grip the developing cartridge 5. In addition, since the first recess portion 330 and the second recess portion 331 are not provided, the capacity of the developer accommodating portion 50*c* illustrated in FIG. 5 can be further increased as compared with the third modification example.

Fifth Embodiment

A cartridge according to a fifth embodiment of the present disclosure will be described with reference to FIGS. 35 to 37C. The present embodiment is different from the first embodiment described above in the shape of the projection portion. In the description below, description of elements denoted by the same reference signs as in the first embodiment will be omitted assuming that these elements substantially have the same configurations and effects as in the first embodiment, and parts different from the first embodiment will be mainly described.

Configuration of Developing Cartridge

Figure 35:
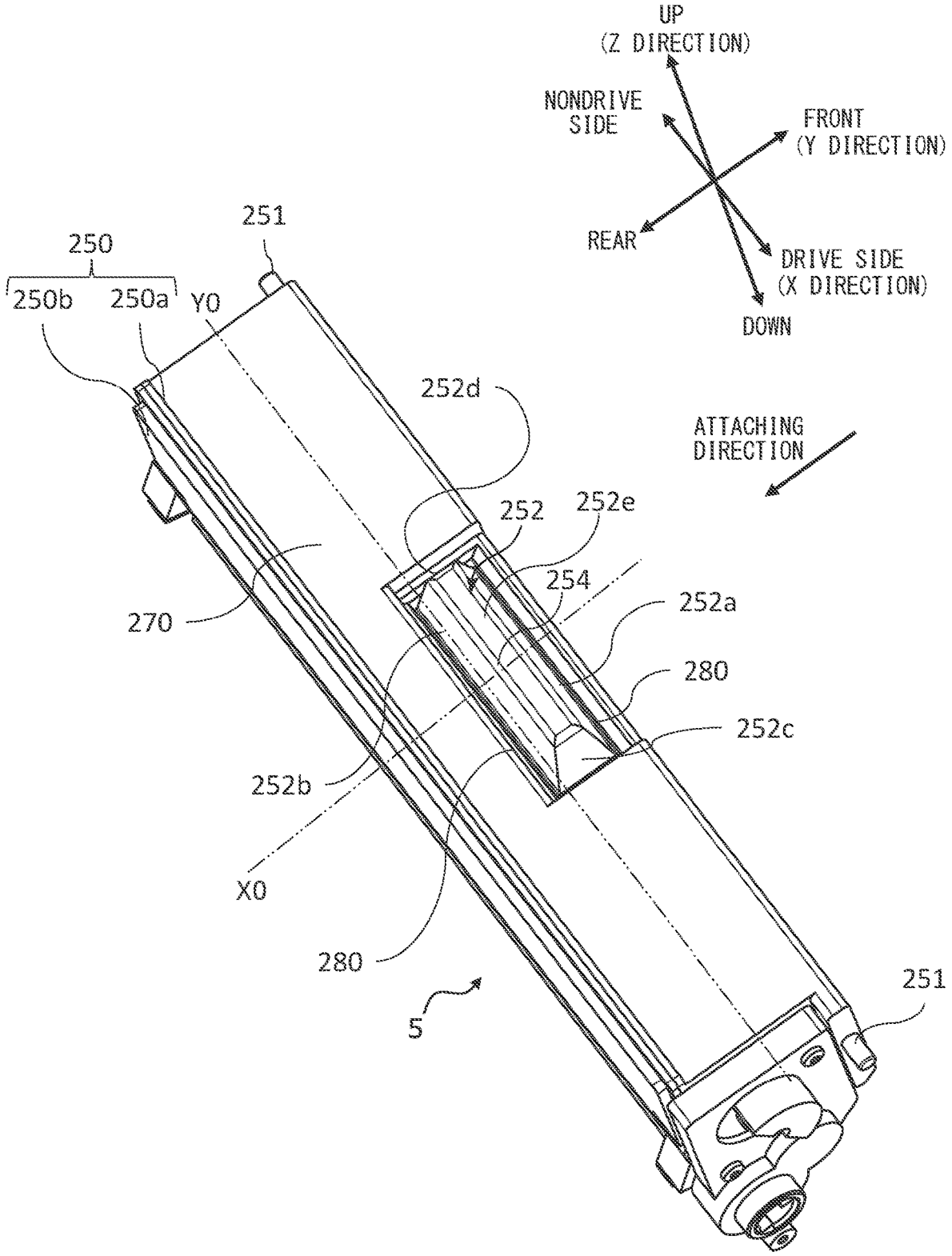
FIG. 35 is a perspective view of a developing cartridge according to a fifth embodiment.
Figure 36A:
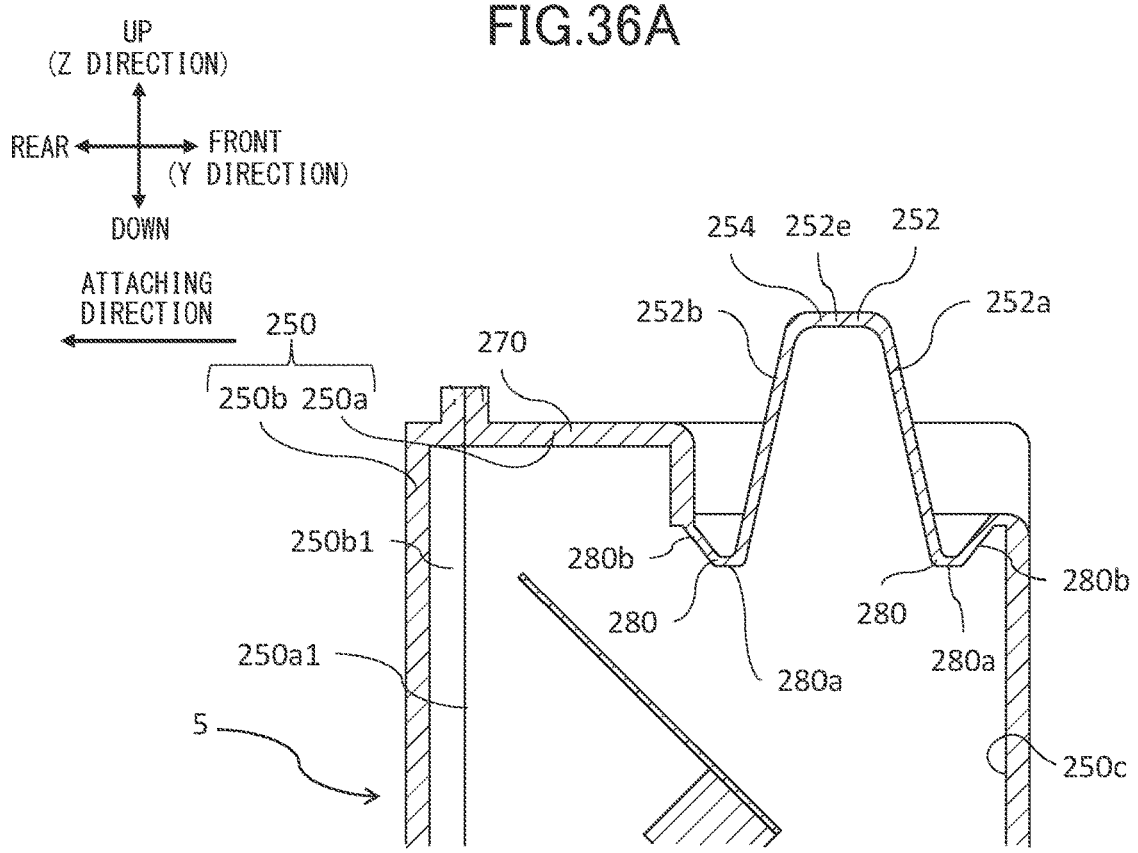
FIGS. 36A and 36B are each an enlarged section view of the vicinity of a projection portion of the developing cartridge according to the fifth embodiment.
Figure 36B:
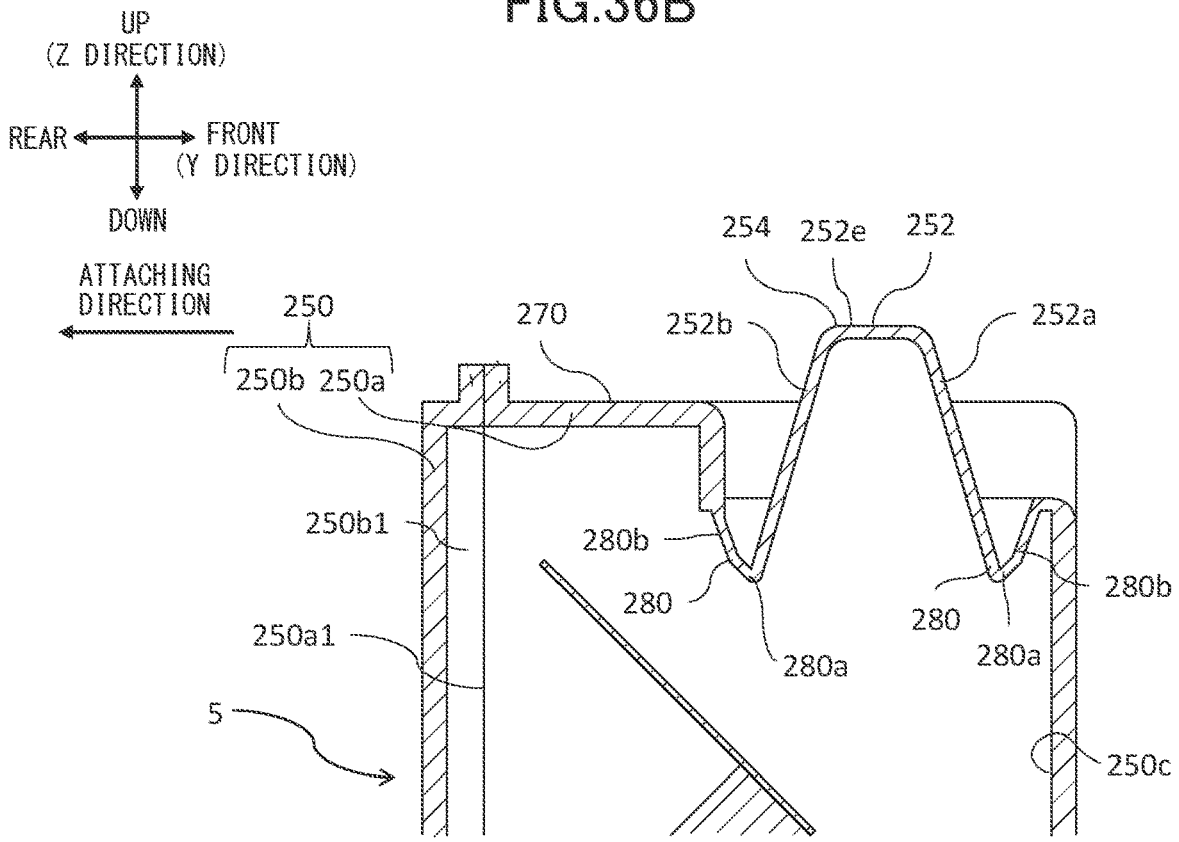

FIG. 35 is a perspective view of the developing cartridge 5 according to the present embodiment. FIGS. 36A and 36B are each an enlarged section view of the vicinity of a projection portion 252 in a cross-section of the developing cartridge 5 according to the present embodiment taken at the center position X0 in the X direction along a virtual plane perpendicular to the X direction. FIG. 36A illustrates a state before the projection portion 252 is deformed, and FIG. 36B illustrates a state after the projection portion 252 is deformed by receiving an external force.

As illustrated in FIG. 35, a developing frame member 250 is formed by connecting a first frame member 250*a* and a second frame member 250*b* together by a method such as ultrasonic welding or adhesion. The first frame member 250*a* has an opening 250*a*1, and the second frame member 250*b* blocks or covers the opening 250*a*1 of the first frame member 250*a*. The developing frame member 250 is formed in a box shape elongated in the X direction, and includes a developer accommodating portion 250*c* that accommodates developer therein. In addition, the developing frame member 250 includes a pair of bosses 251 projecting to the outside from respective ends thereof in the X direction and each having a cylindrical shape.

In a region or part including a center position X0 of the upper surface 270 of the developing frame member 250 in the X direction, a projection portion 252 projecting upward in the Z direction as compared with parts between which the part including the center position X0 is provided in the X direction is provided. At least part of the projection portion 252 is positioned upstream in the attaching direction of, that is, on the front side in the Y direction of a center position Y0 of the upper surface 270 in the attaching direction of the cartridge tray 3. In addition, the center position of the projection portion 252 in the attaching direction, that is, the Y direction is positioned upstream of the center position Y0 of the upper surface 270 of the developing frame member 250 in the attaching direction. The projection portion 252 includes a first portion 252*a* on the front side in the Y direction, a second portion 252*b* on the rear side in the Y direction, a third portion 252*c* on the drive side in the X direction, a fourth portion 252*d* on the non-drive side in the X direction, and a fifth portion 252*e* on the upper side in the Z direction. The inside of the projection portion 252 is a hollow space or cavity serving as part of the developer accommodating portion 250*c*. Therefore, the developer accommodating portion 250*c* can be expanded upward, and thus the capacity for accommodating the developer can be increased.

Here, a connection portion between the projection portion 252 and the upper surface 270 of the developing frame member 250 will be described in detail below. First, the first portion 252*a* of the projection portion 252 is inclined downward and backward, such that part of the first portion 252*a* more on the rear side in the Y direction is lower in the Z direction and farther from the fifth portion 252*e*. The second portion 252*b* of the projection portion 252 is inclined downward and forward, such that part of the second portion 252*b* more on the front side in the Y direction is lower in the Z direction and farther from the fifth portion 252*e*. That is, the first portion 252*a* and the second portion 252*b* of the projection portion 252 opposing each other in the Y direction are formed such that the distance therebetween is larger at a position lower in the Z direction.

Further, the first portion 252*a* and the second portion 252*b* are connected to the upper surface 270 via a turned-up portion 280 having at least one mountain shape or valley shape in the Z direction. The turned-up portion 280 includes an apex 280*a* that is an apex of the mountain shape or the valley shape, and an inclined surface 280*b* connected to the upper surface 270, and is provided around the entire periphery of the connection portion between the projection portion 252 and the upper surface 270. The thicknesses of the first portion 252*a*, the second portion 252*b*, and the turned-up portion 280 are set to be smaller than that of the other part of the developer accommodating portion 250*c*.

In other words, the developing frame member 250 includes the projection portion 252 projecting more upward than the upper surface 270 in the Z direction, and at least one turned-up portion 280 between the upper surface 270 of the developing frame member 250 and the fifth portion 252*e* serving as an upper surface of the projection portion 252. The turned-up portion 280 interconnects the upper surface 270 of the developing frame member 250 and the fifth portion 252*e* of the projection portion 252, and has a shape bent in a cross-section of the developing frame member 250 taken at the center position X0 in the X direction along a virtual plane perpendicular to the X direction. More specifically, the turned-up portion 280 is a portion projecting more downward in the Z direction than the upper surface 270 of the developing frame member 250 and the fifth portion 252*e* of the projection portion 252. The turned-up portion 280 includes the apex 280*a* that is a part projecting the most downward in the Z direction in the turned-up portion 280, and the inclined surface 280*b* serving as a connecting region interconnecting the apex 280*a* and the upper surface 270 of the developing frame member 250. The turned-up portion 280 on the downstream side in the attaching direction is a turned-up shape in which the second portion 252*b* extending from the fifth portion 252*e* of the projection portion 252 and inclined downward in the Z direction toward the downstream side in the attaching direction, and the inclined surface 280*b* extending from the upper surface 270 of the developing frame member 250 and inclined downward in the Z direction toward the upstream side in the attaching direction are connected to each other at the apex 280*a*. The turned-up portion 280 on the upstream side in the attaching direction is a turned-up shape in which the second portion 252*b* extending from the fifth portion 252*e* of the projection portion 252 and inclined downward in the Z direction toward the upstream side in the attaching direction, and the inclined surface 280*b* extending from the upper surface 270 of the developing frame member 250 and inclined downward in the Z direction toward the downstream side in the attaching direction are connected to each other at the apex 280*a*.

Next, how the projection portion 252 is deformed in the configuration described above will be described with reference to FIG. 36B. When an external force is applied to an abutted portion 254 of the fifth portion 252*e*, the turned-up portion 280 moves in a direction in which the apex 280*a* moves away from the fifth portion 252*e* in the Y direction, that is, in a direction in which the two apices 280*a* in FIG. 36B move away from each other in the Y direction. More specifically, the apex 280*a* connected to the first portion 252*a* of FIG. 36B moves toward the front side in the Y direction, and the apex 280*a* connected to the second portion 252*b* moves toward the rear side in the Y direction. At this time, the movement of the apexes 280*a* is made possible by elastic deformation of the turned-up portion 280 including the inclined surface 280*b* in the Y direction. Therefore, the shape of the inclined surface 280*b* is preferably set to be easily deformable, by, for example, making the wall thereof thin, or the length thereof measured in the cross-section perpendicular to the X direction illustrated in FIGS. 36A and 36B large. Then, when the apexes 280*a* move in the direction away from the fifth portion 252*e* in the Y direction, the inclination of the first portion 252*a* and the second portion 252*b* become less steep in the Y direction, that is, the inclination angles thereof with respect to the Z direction become larger. As a result, downward displacement of the abutted portion 254 of the fifth portion 252*e* in the Z direction is allowed.

To be noted, in the present embodiment, an example in which the wall thickness of each of the first portion 252*a*, the second portion 252*b*, and the turned-up portion 280 is smaller than the wall thickness of the other part of the developer accommodating portion 250*c* has been described. Alternatively, as long as the elastic deformation easily occurs when receiving the external force, a configuration in which the wall thickness of only part of the first portion 252*a*, the second portion 252*b*, and the turned-up portion 280 is small may be employed in place of this. In addition, although an example in which only one turned-up portion 280 is provided has been described, a plurality of turned-up portions 280 may be provided to form a bellows shape, that is, a wavy shape in section view. The more turned-up portions 280 are provided, the more the amount of deformation of the fifth portion 252*e* serving as the abutted portion 254 can be increased in the Z direction. Further, if the length of the inclined surface 280*b* in the Z direction is larger, the turned-up portion 280 is more easily deformed and the apex 280*a* is more easily moved, and thus the elastic deformation in which the fifth portion 252*e* including the abutted portion 254 moves in the Z direction more easily occurs. Therefore, considering above, the wall thickness of the first portion 252*a*, the second portion 252*b*, and the turned-up portion 280, the number of the turned-up portions 280, and the length of the inclined surface 280*b* in the Z direction may be appropriately selected for design in accordance with the amount of deformation of the fifth portion 252*e* in the Z direction. In addition, although the projection portion 252 of the present embodiment has been described as part of the shape of the first frame member 250*a*, a configuration in which the turned-up portion 280 and the projection portion 252 are formed as separate parts and are connected to the first frame member 250*a* by a method such as ultrasonic welding or adhesion may be employed.

Here, similarly to the projection portion 52 of the first embodiment, the projection portion 252 also functions as a handle for the operator to use to grip the developing cartridge 5. For example, the operator may grip the developing cartridge 5 by gripping the first portion 252*a* of the projection portion 252 and a rear surface 250*b*1 of the second frame member 250*b*. As described above, the projection portion 252 projects upward from the upper surface of the developing frame member 250 such that the developing cartridge 5 is easy to grip. Therefore, the operator may grip the developing cartridge 5 in any posture the operator is comfortable with in addition to the example described above.

To be noted, one or more ribs or ridges extending in the X direction may be provided on at least one side surface of the projection portion 252 in the Y direction such that the operator can grip the developing cartridge 5 more stably. In addition, instead of the rib, recess or projection patterns of a lattice shape may be formed on a side surface of the projection portion 252, surface roughening treatment may be performed on the side surface, or a rubber sheet having a high friction coefficient may be stuck to the side surface. In addition, instead of a configuration in which the operator grips the projection portion 252 or the side surface of the developing frame member 250, a configuration in which a handle for the operator to grip may be additionally provided at a position different from the projection portion 252 on the upper surface 270 of the developing frame member 250.

Change in Posture of Developing Cartridges in Accordance with Movement of Cartridge Tray How the developing cartridges 5Y to 5K transition from the detaching posture to the image forming posture in accordance with the movement of the cartridge tray 3 in the fifth embodiment will be described with reference to FIGS. 37A to 37C. In the image forming apparatus illustrated in FIGS. 37A to 37C, the developing cartridge 5 according to the fifth embodiment is used as each of the developing cartridges 5Y to 5K accommodating developer of respective colors.

Figure 37A:
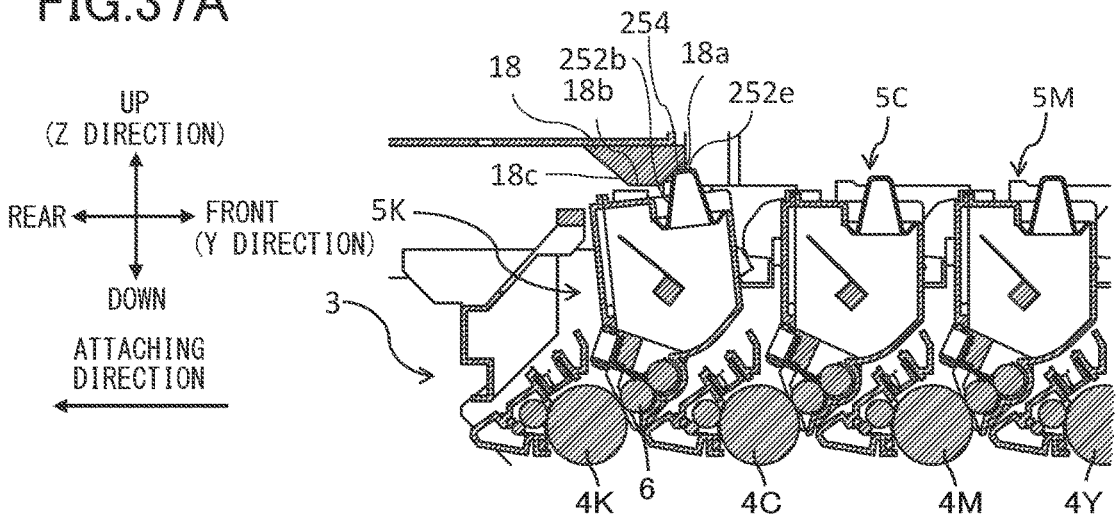
FIGS. 37A to 37C are each a diagram for describing the posture change of the developing cartridge in accordance with the movement of a cartridge tray according to the fifth embodiment.
Figure 37B:
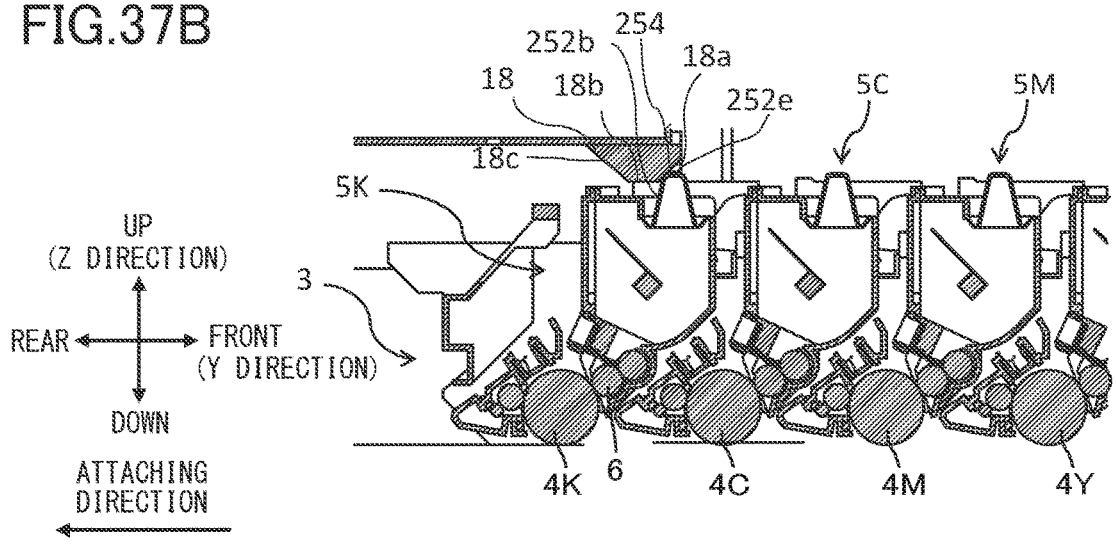
Figure 37C:
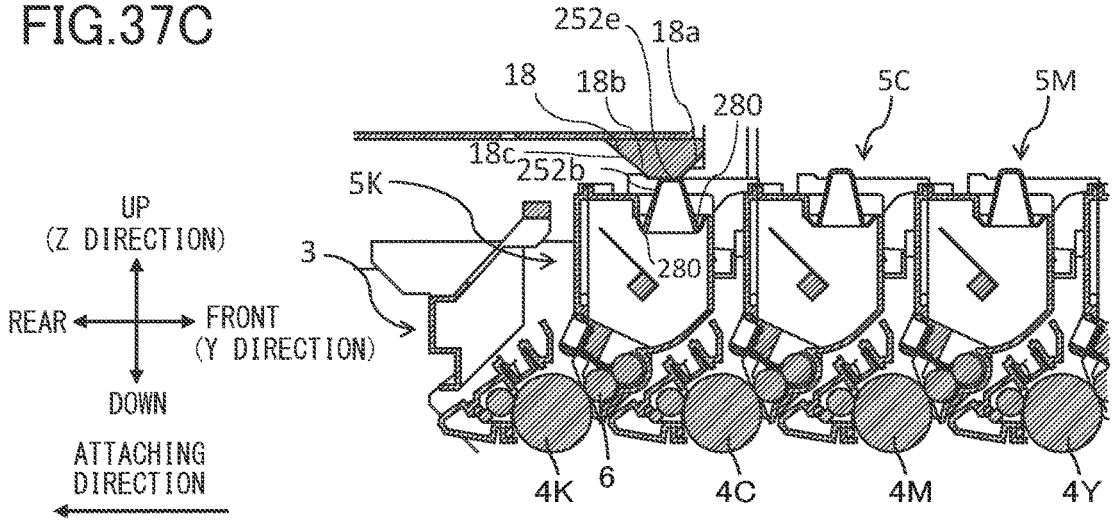

FIGS. 37A to 37C are each a section view of the image forming apparatus 1 illustrating a cross-section taken along a virtual plane perpendicular to the X direction as viewed in the X direction, and illustrates how the cartridge tray 3 is moved in the attaching direction from the first position toward the second position. Here, a case where attachment of the cartridge tray 3 is performed in a state in which the black developing cartridge 5K is in the detaching posture and the developing cartridges 5Y, 5M, and 5C of the other colors are in the image forming posture is illustrated.

When the operator moves the cartridge tray 3 in the attaching direction from the first position toward the second position, the abutted portion 254 of the projection portion 252 of the black developing cartridge 5K abuts the abutting portion 18 of the apparatus body 2 as illustrated in FIG. 37A. More specifically, a connecting portion between the second portion 252*b* and the fifth portion 252*e* of the projection portion 252 abuts the first abutting portion 18*a* of the abutting portion 18. Then, the abutted portion 254 is pressed toward the front side in the Y direction, that is, toward the upstream side in the attaching direction, and downward in the Z direction by the first abutting portion 18*a*. As a result of this pressing force, that is, the reaction force, the developing cartridge 5K pivots to the front side in the Y direction about the rotation axis of the developing roller 6 and moves from the detaching posture serving as a first posture to the image forming posture serving as a second posture.

Also when the movement of the developing cartridge 5K from the detaching posture to the image forming posture is complete, the projection portion 252 is still abutting the abutting portion 18 as illustrated in FIG. 37B.

When the operator further moves the cartridge tray 3 toward the second position, the projection portion 252 is elastically deformed downward in the Z direction by the reaction force from the first abutting portion 18*a* as illustrated in FIG. 37C. At this time, in the projection portion 252, as a result of the apex 280*a* moving away from the fifth portion 252*e* in the Y direction and the inclination of the first portion 252*a* and the second portion 252*b* in the Y direction becoming less steep, the fifth portion 252*e* moves downward in the Z direction. To be noted, FIG. 37C schematically illustrates a state in which the entirety of the projection portion 252 has elastically deformed downward in the Z direction. In some actual cases, the deformation is a combination of elastic deformation toward the front side in the Y direction, elastic deformation toward the lower side in the Z direction, local elastic deformation of the abutted part, elastic deformation in which the center portion of the projection portion 252 in the X direction is twisted with respect to the other part, and so forth.

When the cartridge tray 3 continues moving toward the second position, the projection portions 252 of the developing cartridges 5C, 5M, and 5Y of the other colors in the image forming posture sequentially abut the abutting portion 18 and are deformed, and sequentially pass through the space under the abutting portion 18 while sliding on the horizontal portion 18*b*. Then, the cartridge tray 3 is completely inserted to the second position and the front door 17 is closed, and thus the attachment of the developing cartridges 5Y to 5K and the cartridge tray 3 to the apparatus body 2 is completed.

As described above, also in the present embodiment, similarly to the first embodiment, the projection portion 252 provided with the abutted portion 254 that is abutted by the abutting portion 18 of the apparatus body 2 in accordance with the movement of the cartridge tray 3 in the attaching direction are provided in each of the developing cartridges 5Y to 5K. Therefore, the developing cartridges 5Y to 5K can be moved from the detaching posture to the image forming posture when attaching the cartridge tray 3, and attachment of the developing cartridges 5Y to 5K to the apparatus body 2 in the detaching posture can be suppressed.

In addition, in the present embodiment, the turned-up portion 280 having at least one mountain shape or valley shape is provided in the connection portion between the upper surface 270 and the projection portion 252 including the abutted portion 254. As a result of this, the projection portion 252 can be elastically deformed downward in the Z direction by a smaller external force than the projection portion 52 of the first embodiment. As a result of this, the operational load for the operator to attach the cartridge tray 3 can be reduced.

In addition, the projection portions 252 abutted by the abutting portion 18 are provided in portions or regions including the center positions X0 of the developing cartridges 5Y to 5K in the X direction. Therefore, when moving the developing cartridges 5Y to 5K from the detaching posture to the image forming posture, a force from the abutting portion 18 can be caused to act on the center portions of the developing cartridges 5Y to 5K in the X direction. Therefore, the developing cartridges 5Y to 5K can be moved from the detaching posture to the image forming posture by a simple configuration while maintaining the balance of the developing cartridges 5Y to 5K in the X direction.

Other Embodiments

Although an image forming apparatus that forms a color image by using developer of a plurality of colors has been described in the embodiments described above, the present technique may be also applied to an image forming apparatus that forms a monochromatic image by using one kind of developer. In addition, although a device that performs exposure using laser light has been described as an example of the exposing unit 10, the present technique may be also applied to a device that performs exposure using a light emitting diode: LED.

In addition, although a configuration in which the projection portions or ribs serving as abutted portions of the developing cartridges 5Y to 5K pass through the space under the abutting portion 18 while being elastically deformed has been described, a configuration in which the abutting portion 18 is constituted by an elastic member or the abutting portion 18 is configured as a member movable with respect to the apparatus body 2 may be employed. For example, the first abutting portion 18*a* and the horizontal portion 18*b* of the abutting portion 18 illustrated in FIG. 2 are formed as elastic members that can be elastically deformed upward by a force of a predetermined value or more. The predetermined value is larger than the value of the force required for changing the developing cartridges 5Y to 5K from the detaching posture to the image forming posture by the abutting portion 18 abutting the abutted portion in accordance with the movement of the cartridge tray 3 in the attaching direction. In addition, after the developing cartridges 5Y to 5K has transitioned from the detaching posture to the image forming posture, the abutting portion 18 is elastically deformed upward by the force received from the abutted portion, and allows the passage of the abutted portion. In addition, for example, a configuration in which the abutting portion 18 is attached to the apparatus body 2 via a spring member, and after the abutting portion 18 abuts the abutted portion and causes the developing cartridges 5Y to 5K to transition from the detaching posture to the image forming posture, the abutting portion 18 pressed by the abutted portion retracts upward may be employed.

In addition, the abutting portion 18 may be a rotary member rotatably supported by the apparatus body 2. For example, a rotary member including a shaft portion supported by the frame member of the apparatus body 2 and extending in the X direction and a rotatable portion having a cylindrical shape that rotates about the shaft portion is disposed at the same position as the abutting portion 18 of the embodiments described above illustrated in FIG. 2. Similarly to the abutting portion 18 of the embodiments described above, the rotary member can abut the projection portions or the ribs serving as the abutted portions of the developing cartridges 5Y to 5K in accordance with the movement of the cartridge tray 3 in the attaching direction to change the developing cartridges 5Y to 5K from the detaching posture to the image forming posture. In addition, since the rotary member rotates by the frictional force received from the abutted portion after moving the developing cartridges 5Y to 5K, the frictional drag that the abutted portion receives when passing through the space under the rotary member can be reduced, and thus the operational load of the attachment operation of the cartridge tray 3 can be suppressed.

In addition, although a configuration in which the abutting portion 18 of the apparatus body 2 abuts the abutted portions of the developing cartridges 5Y to 5K at one position in the X direction has been described as an example in the embodiments described above, a configuration in which the abutting portion 18 abut the abutted portions at a plurality of positions apart from each other in the X direction may be employed. As a result of this, the generation of the rotational moment on the developing cartridges 5Y to 5K when the abutting portion 18 abuts the abutted portions can be suppressed more. In this case, an arrangement in which the abutting portion 18 abuts the abutted portions at a plurality of positions symmetrical with respect to the center position X0 of the developing frame member in the X direction is preferable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-217022, filed on Dec. 25, 2020, which is hereby incorporated by reference herein in its entirety.

What is claimed is:

1. An image forming apparatus comprising:

an apparatus body comprising an abutting portion;

a cartridge comprising a frame having a developer accommodating portion configured to accommodate developer, a developing roller configured to bear the developer in the developer accommodating portion, and an abutted portion configured to be abutted by the abutting portion; and a movable member comprising an attachment portion to and from which the cartridge is attachable and detachable, the movable member being movable between a first position and a second position in a direction perpendicular to a rotation axis direction of the developing roller, the first position being a position where the movable member is drawn out from the apparatus body such that the cartridge is attachable to and detachable from the attachment portion, the second position being a position where the cartridge attached to the attachment portion is accommodated in the apparatus body, wherein the abutted portion is configured to, in a case where the movable member is moved in an attaching direction from the first position toward the second position in a state in which the cartridge having a first posture is attached to the attachment portion, be abutted by the abutting portion of the apparatus body such that the cartridge is transitioned from the first posture to a second posture different from the first posture and the movable member reaches the second position in a state in which the cartridge having the second posture is attached to the attachment portion, wherein the cartridge comprises a projection portion provided in a first region of an upper surface of the frame in a vertical direction, the first region comprising a center position of the cartridge in the rotation axis direction of the developing roller, the projection portion projecting more upward than second regions of the upper surface between which the first region is interposed in the rotation axis direction, wherein at least a part of the first region is positioned downstream in the attaching direction from a center position of the upper surface in the attaching direction, wherein an inside of the projection portion is a space that is part of the developer accommodating portion, wherein the abutted portion is part of the projection portion, and wherein the projection portion is configured to, after the cartridge is transitioned from the first posture to the second posture in accordance with movement of the cartridge in the attaching direction, pass through a space under the abutting portion while being elastically deformed by the abutted portion being pressed by the abutting portion of the apparatus body.

2. The image forming apparatus according to claim 1, wherein a thickness of the frame in at least part of the projection portion is smaller than a thickness of part of the frame constituting a wall of the developer accommodating portion different from the projection portion.

3. The image forming apparatus according to claim 1, wherein a center position of the projection portion in the attaching direction is positioned upstream of the center position of the upper surface of the frame in the attaching direction.

4. An image forming apparatus comprising:

an apparatus body comprising an abutting portion;

a cartridge comprising a frame having a developer accommodating portion configured to accommodate developer, a developing roller configured to bear the developer in the developer accommodating portion, and an abutted portion configured to be abutted by the abutting portion; and a movable member comprising an attachment portion to and from which the cartridge is attachable and detachable, the movable member being movable between a first position and a second position in a direction perpendicular to a rotation axis direction of the developing roller, the first position being a position where the movable member is drawn out from the apparatus body such that the cartridge is attachable to and detachable from the attachment portion, the second position being a position where the cartridge attached to the attachment portion is accommodated in the apparatus body, wherein the abutted portion is configured to, in a case where the movable member is moved in an attaching direction from the first position toward the second position in a state in which the cartridge having a first posture is attached to the attachment portion, be abutted by the abutting portion of the apparatus body such that the cartridge is transitioned from the first posture to a second posture different from the first posture and the movable member reaches the second position in a state in which the cartridge having the second posture is attached to the attachment portion, wherein the cartridge comprises a projection portion provided in a first region of an upper surface of the frame in a vertical direction, the first region comprising a center position of the cartridge in the rotation axis direction of the developing roller, the projection portion projecting more upward than second regions of the upper surface between which the first region is interposed in the rotation axis direction, wherein at least part of the first region is positioned downstream in the attaching direction of a center position of the upper surface in the attaching direction, wherein an inside of the projection portion is a space that is part of the developer accommodating portion, wherein the abutted portion is a rib provided on the frame differently from the projection portion, the rib projecting more upward than an upper surface of the projection portion, and wherein the rib is configured to pass through a space under the abutting portion while being pressed and elastically deformed by the abutting portion after the cartridge is transitioned from the first posture to the second posture in accordance with movement of the cartridge in the attaching direction.

5. The image forming apparatus according to claim 4, wherein the rib has a plate shape whose thickness in the attaching direction is larger than a width thereof in the vertical direction.

6. The image forming apparatus according to claim 4, wherein the rib projects upward from the upper surface of the frame at a position downstream of the projection portion in the attaching direction.

7. The image forming apparatus according to claim 4, wherein the frame comprises a first frame member having an opening directed downstream in the attaching direction and comprising a first flange surrounding the opening, and a second frame member comprising a second flange opposing the first flange, the second frame member being connected to the first frame member so as to block the opening, and wherein the rib projects upward from an upper end of one of the first flange and the second flange.

8. The image forming apparatus according to claim 4, wherein the rib extends upward and downstream in the attaching direction from a downstream end of the projection portion in the attaching direction.

9. An image forming apparatus comprising:

an apparatus body comprising an abutting portion;

a cartridge comprising a frame having a developer accommodating portion configured to accommodate developer, a developing roller configured to bear the developer in the developer accommodating portion, and an abutted portion configured to be abutted by the abutting portion; and a movable member comprising an attachment portion to and from which the cartridge is attachable and detachable, the movable member being movable between a first position and a second position in a direction perpendicular to a rotation axis direction of the developing roller, the first position being a position where the movable member is drawn out from the apparatus body such that the cartridge is attachable to and detachable from the attachment portion, the second position being a position where the cartridge attached to the attachment portion is accommodated in the apparatus body, wherein the abutted portion is configured to, in a case where the movable member is moved in an attaching direction from the first position toward the second position in a state in which the cartridge having a first posture is attached to the attachment portion, be abutted by the abutting portion of the apparatus body such that the cartridge is transitioned from the first posture to a second posture different from the first posture and the movable member reaches the second position in a state in which the cartridge having the second posture is attached to the attachment portion, wherein the cartridge comprises a handle configured to be gripped when handling the cartridge, wherein the handle comprises a first end portion connected to an upper surface of the frame in a vertical direction at a position on a first side with respect to a center position of the cartridge in the rotation axis direction of the developing roller, a second end portion connected to the upper surface of the frame in the vertical direction at a position on a second side with respect to the center position of the cartridge in the rotation axis direction, and a rib extending in the rotation axis direction at a position above the upper surface and interconnecting the first end portion and the second end portion, wherein a first region of the upper surface of the frame overlapping with the rib as viewed in the vertical direction is at least not recessed downward as compared with second regions of the upper surface between which the first region is interposed in the rotation axis direction, wherein the abutted portion is provided on the rib, and wherein the rib is configured to pass through a space under the abutting portion while being pressed and elastically deformed by the abutting portion after the cartridge is transitioned from the first posture to the second posture in accordance with movement of the cartridge in the attaching direction.

10. The image forming apparatus according to claim 9, wherein the rib has a plate shape whose thickness in the attaching direction is smaller than a width thereof in the attaching direction.

11. The image forming apparatus according to claim 9, wherein the first end portion and the second end portion are respectively a first projection portion and a second projection portion each projecting upward from the upper surface of the frame, and wherein an inside of the first end portion and an inside of the second end portion are each a space that is part of the developer accommodating portion.

* * * * *